US009162506B2

(12) United States Patent
Shinkawa

(10) Patent No.: US 9,162,506 B2
(45) Date of Patent: Oct. 20, 2015

(54) PRINTING APPARATUS AND METHOD OF CONTROLLING PRINTING APPARATUS

(71) Applicant: Seiko Epson Corporation, Tokyo (JP)

(72) Inventor: Osamu Shinkawa, Chino (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/479,766

(22) Filed: Sep. 8, 2014

(65) Prior Publication Data

US 2015/0070420 A1 Mar. 12, 2015

(30) Foreign Application Priority Data

Sep. 9, 2013 (JP) ..... 2013-186455

(51) Int. Cl.
*B41J 29/393* (2006.01)
*B41J 29/38* (2006.01)
*B41J 2/045* (2006.01)

(52) U.S. Cl.
CPC ..... *B41J 29/38* (2013.01); *B41J 2/0451* (2013.01); *B41J 2/04541* (2013.01); *B41J 2/04581* (2013.01); *B41J 2/04588* (2013.01)

(58) Field of Classification Search
CPC ..... B41J 29/38
See application file for complete search history.

(56) References Cited

U.S. PATENT DOCUMENTS

2012/0249638 A1* 10/2012 Takano et al. ..... 347/10
2013/0083107 A1* 4/2013 Nishikawa et al. ..... 347/10

FOREIGN PATENT DOCUMENTS

JP 2013-028183 A 2/2013

* cited by examiner

*Primary Examiner* — Shelby Fidler
*Assistant Examiner* — Tracey McMillion
(74) *Attorney, Agent, or Firm* — Harness, Dickey & Pierce, P.L.C.

(57) ABSTRACT

A printing apparatus includes an ejection unit including a piezoelectric element that is displaced according to a driving signal, and a nozzle capable of ejecting the liquid; a driving signal supply unit that supplies the driving signal; a detection unit that detects change of an electromotive force of the piezoelectric element; a determination unit that determines an ejection state of the liquid in the ejection unit based on the detection result of the detection unit; and a decision unit that is capable of performing a first process of deciding a waveform of the driving signal for inspection such that the liquid is not ejected from the nozzle when the driving signal for inspection is supplied to the piezoelectric element and a second process of correcting the waveform decided in the first process and deciding the corrected waveform as a waveform of the driving signal for inspection.

9 Claims, 27 Drawing Sheets

TESTED VALUE AND CALCULATED VALUE OF RESIDUAL VIBRATION (NORMAL TIME)

TESTED VALUE AND CALCULATED VALUE OF RESIDUAL VIBRATION (BUBBLE)

TESTED VALUE AND CALCULATED VALUE OF RESIDUAL VIBRATION (DRYING)

TESTED VALUE AND CALCULATED VALUE
OF RESIDUAL VIBRATION (PAPER DUST)

FIG. 16

| SI (b1, b2, b3) | Ts1 | | | Ts2 | | |
|---|---|---|---|---|---|---|
| | Sa | Sb | Sc | Sa | Sb | Sc |
| (1, 1, 0) | H | L | L | H | L | L |
| (1, 0, 0) | H | L | L | L | H | L |
| (0, 1, 0) | L | H | L | H | L | L |
| (0, 0, 0) | L | H | L | L | H | L |
| (0, 0, 1) | L | L | H | L | L | H |

| Flag | NTc (CONTENTS TO BE COMPARED) | Rs |
|---|---|---|
| 1 | NTc < NTx1 | 2: EJECTION ABNORMALITY (BUBBLE) |
| | NTx1 ≤ NTc ≤ NTx2 | 1: NORMAL |
| | NTx2 < NTc ≤ NTx3 | 3: EJECTION ABNORMALITY (PAPER DUST) |
| | NTx3 < NTc | 4: EJECTION ABNORMALITY (THICKENING) |
| 0 | N/A | 5: EJECTION ABNORMALITY |

PRINTING APPARATUS AND METHOD OF CONTROLLING PRINTING APPARATUS

BACKGROUND

1. Technical Field

The present invention relates to a printing apparatus and a method of controlling a printing apparatus.

2. Related Art

An ink jet printer allows an ink filled into an ejection unit to be ejected and forms an image on a recording medium by allowing a piezoelectric element provided in the ejection unit to be driven by a driving signal.

However, when the ink in the ejection unit is thickened, ejection abnormality occurs and the image quality of the image to be printed is degraded in some cases. Further, in a case where the ink in the ejection unit includes bubbles or paper dust is adhered to the vicinity of a nozzle of the ejection unit, ejection abnormality occurs and the image quality of the image to be printed is degraded in some cases. Accordingly, it is preferable to inspect an ejection state of the ink in the ejection unit for realizing high grade printing.

JP-A-2013-028183 discloses a technique of detecting residual vibration generated by allowing the piezoelectric element to be driven by the driving signal and inspecting the ejection state of the ink in the ejection unit based on detection results.

However, the inspection of the ejection state of the ink in the ejection unit is performed using residual vibration when the piezoelectric element is driven such that the ink is not ejected from the ejection unit. In a case where the inspection of the ejection state is performed without allowing the ink to be ejected, the inspection can be performed when the ejection unit is located in a position in which the ink can be ejected to the recording medium while the printing process is performed or the like. Therefore, it is possible to detect ejection abnormality in real time and to prevent the printing process from being delayed by the inspection.

However, in order to perform the inspection of the ejection state without allowing the ink to be ejected, it is necessary to set a waveform of a driving signal such that the piezoelectric element is driven to a degree that the ink is not ejected from the ejection unit. For this reason, there is a problem in that the ink is ejected in the inspection so that the recording medium is stained with the ink in a case where the waveform of the driving signal is not appropriately set.

Particularly, even in a case where the waveform of the driving signal is set such that the ink is not ejected, the ink is ejected when the piezoelectric element is driven by the driving signal if the viscosity of the ink or the temperature of the ejection unit is changed.

SUMMARY

An advantage of some aspects of the invention is to provide a technique of deciding a driving signal for performing inspection of an ejection state of an ink in an ejection unit without allowing the ink to be ejected.

According to an aspect of the invention, there is provided a printing apparatus including an ejection unit that includes a piezoelectric element that is displaced according to a driving signal, a pressure chamber whose inside is filled with a liquid and in which a pressure inside is increased or decreased by the displacement of the piezoelectric element based on the driving signal, and a nozzle that communicates with the pressure chamber and capable of ejecting the liquid filled into the inside of the pressure chamber through the increase or decrease of the pressure in the inside of the pressure chamber; a driving signal supply unit that supplies the driving signal to the piezoelectric element; a detection unit that detects change of an electromotive force of the piezoelectric element as a residual vibration signal based on the change of the pressure in the inside of the pressure chamber, which is generated after the driving signal is supplied to the piezoelectric element; a determination unit that determines an ejection state of the liquid in the ejection unit based on the detection result of the detection unit in a case where the driving signal for inspection is supplied to the piezoelectric element; and a decision unit that is capable of performing a first process of deciding a waveform of the driving signal for inspection such that the liquid is not ejected from the nozzles when the driving signal for inspection is supplied to the piezoelectric element and a second process of correcting the waveform decided in the first process and deciding the corrected waveform as a waveform of the driving signal for inspection, in which, in the second process, the decision unit decides the corrected waveform such that the liquid is not ejected from the nozzles when the driving signal for inspection which has the corrected waveform is supplied to the piezoelectric element.

According to the aspect of the invention, the waveform of the driving signal for inspection is decided in the first process and the decided waveform can be corrected in the second process. Accordingly, for example, even in a case in which the temperature or the viscosity of the liquid filled into the pressure chamber is changed and the liquid is ejected from the nozzles when the driving signal for inspection, which has the waveform decided in the first process, is supplied to the piezoelectric element after the waveform of the driving signal for inspection is decided in the first process, it is possible to correct the waveform of the driving signal for the inspection to a waveform which allows the liquid not to be ejected from the nozzles in the second process. Accordingly, even when the temperature or the viscosity of the liquid filled into the pressure chamber is changed, it is possible to determine the ejection state of the liquid in the ejection unit without allowing the liquid to be ejected from the nozzle.

Further, in the above-described printing apparatus, it is preferable that the decision unit perform the first process when the printing apparatus is activated for the first time.

According to the aspect, the first process may be performed by an initialization operation in which the printing apparatus is performed when the printing apparatus is activated for the first time.

Here, the initialization operation is an operation including a filling process of filling the liquid into the pressure chamber and a reading/writing process of initial setting values.

Further, in the above-described printing apparatus, it is preferable that the decision unit perform the second process when the printing apparatus is activated for the second or subsequent time.

According to the aspect, since the second process is performed when the printing apparatus is activated for the second or subsequent time after the first process is performed when the printing apparatus is activated for the first time, it is possible to determine the ejection state of the ejection unit without allowing the liquid to be ejected from the nozzles even when the viscosity or the like of the liquid in the pressure chamber has changed between the activation for the first time and the start for the second or subsequent time.

Further, according to the aspect, the second process may be performed during an activating operation in which the printing apparatus is performed when the printing apparatus is activated for the second or subsequent time.

Here, the activating operation is an operation which is performed by the printing apparatus after the initialization operation is performed and includes cleaning of the ejection unit or warming the ink.

Further, in the above-described printing apparatus, it is preferable that the decision unit decide a waveform of the driving signal for inspection such that a cycle of a waveform indicated by the residual vibration signal detected by the detection unit when the driving signal for inspection is supplied to the piezoelectric element becomes longer than any cycle of the waveform indicated by the residual vibration signal detected by the detection unit when the liquid is ejected from the nozzles due to the displacement of the piezoelectric element according to the driving signal.

For accurately detecting the ejection state in the ejection unit based on the residual vibration, it is preferable to maximize the amplitude of the residual vibration. In addition, in a case where the residual vibration having the large amplitude in the piezoelectric element is allowed to be generated, the cycle of the residual vibration to be detected becomes longer.

According to the aspect, the waveform of the driving signal for inspection is decided such that the cycle of the residual vibration generated when the driving signal for inspection is supplied becomes longer than the cycle of the residual vibration generated when the liquid is ejected from the nozzle. Accordingly, it is possible to make the amplitude of the residual vibration generated when the driving signal for inspection is supplied larger by comparing the amplitude with the amplitude of the residual vibration in a case where the liquid is ejected from the nozzle. As a result, it is possible to accurately determine the ejection state of the liquid in the ejection unit based on the residual vibration signal.

Further, in the above-described printing apparatus, it is preferable that the ejection unit be driven such that the liquid is ejected or not ejected from the nozzles due to the increase of the pressure in the inside of the pressure chamber, which is generated by a potential indicated by the driving signal being changed by the driving voltage, and the decision unit perform a first setting process of setting the driving voltage as an initial voltage such that the liquid is not ejected from the nozzles when the driving signal is not supplied to the piezoelectric element, a first change process of allowing the driving voltage of the driving signal supplied to the piezoelectric element to be increased by a predetermined change voltage from the initial voltage, a boundary decision process of deciding the driving voltage of the driving signal supplied to the piezoelectric element when the liquid is ejected from the nozzles for the first time in the first change process as a boundary voltage, and a first decision process of deciding an inspection voltage in which a difference voltage having a size of more than or equal to the change voltage is subtracted from the boundary voltage as the driving voltage of the driving signal for inspection.

Further, in the above-described printing apparatus, it is preferable that the ejection unit be driven such that the liquid is ejected or not ejected from the nozzles due to the increase of the pressure in the inside of the pressure chamber, which is generated by the potential indicated by the driving signal being changed by the driving voltage, and the decision unit perform a second setting process of setting the driving voltage of the driving signal as the initial voltage and setting a driving voltage of a driving signal for comparison as a voltage in which the difference voltage is added to the initial voltage, a second change process of allowing the driving voltage of the driving signal supplied to the piezoelectric element to be increased or decreased by at least a predetermined change voltage from the initial voltage and allowing the driving voltage of the driving signal for comparison supplied to the piezoelectric element to be increased or decreased such that a difference between the driving voltage of the driving signal and the driving voltage of the driving signal for comparison is maintained by the difference voltage, and a second decision process of deciding the driving voltage of the driving signal as an inspection voltage and deciding the inspection voltage as a driving voltage of a driving signal for inspection in a case where a cycle of a waveform indicated by the residual vibration signal detected by the detection unit when the driving signal is supplied to the piezoelectric element becomes longer than a cycle of a waveform indicated by the residual vibration signal detected by the detection unit when the driving signal for comparison is supplied to the piezoelectric element and in a case where the cycle of the waveform indicated by the residual vibration signal detected by the detection unit when a signal in which the driving voltage of the driving signal is decreased by the change voltage is supplied to the piezoelectric element becomes shorter than the cycle of the waveform indicated by the residual vibration signal detected by the detection unit when a signal in which the driving voltage of the driving signal for comparison is decreased by the change voltage is supplied to the piezoelectric element.

Further, in the above-described printing apparatus, it is preferable that the decision unit perform a third setting process of setting the driving voltage of the driving signal as the inspection voltage in the second process, an ejection determining process of determining whether the liquid is ejected from the nozzles when the driving signal using the inspection voltage as the driving voltage is supplied to the piezoelectric element, a third change process of allowing the driving voltage of the driving signal supplied to the piezoelectric element to be decreased by the change voltage from the inspection voltage in a case where a result of determination in the ejection determining process is positive and allowing the driving voltage of the driving signal supplied to the piezoelectric element to be increased by the change voltage from the inspection voltage in a case where the result of determination in the ejection determining process is negative, a corrected boundary decision process of deciding the driving voltage of the driving signal supplied to the piezoelectric element in a case where the liquid is ejected from the nozzles for the last time in the third change process as a corrected boundary voltage when the result of determination in the ejection determining process is positive and deciding the driving voltage of the driving signal supplied to the piezoelectric element in a case where the liquid is ejected from the nozzles for the first time in the third change process as the corrected boundary voltage when the result of determination in the ejection determining process is negative, and a third decision process of deciding a corrected inspection voltage in which the difference voltage is subtracted from the corrected boundary voltage as the driving voltage of the driving signal for inspection.

Further, in the above-described printing apparatus, it is preferable that the decision unit perform a fourth setting process of setting the driving voltage of the driving signal as the inspection voltage in the second process and setting a driving voltage of a driving signal for comparison as a voltage in which the difference voltage is added to the inspection voltage, a fourth change process of allowing the driving voltage of the driving signal supplied to the piezoelectric element to be increased or decreased by at least the change voltage from the inspection voltage and allowing the driving voltage of the driving signal for comparison supplied to the piezoelectric element to be increased or decreased such that the difference between the driving voltage of the driving signal and the driving voltage of the driving signal for comparison is maintained by the difference voltage, and a fourth deciding process of deciding the driving voltage of the driving signal as a corrected inspection voltage and deciding the corrected inspection voltage as the driving voltage of the driving signal for inspection in a case where the cycle of the waveform indicated by the residual vibration signal detected by the detection unit when the driving signal is supplied to the piezoelectric element is longer than the cycle of the waveform indicated by the residual vibration signal detected by the detection unit when the driving signal for comparison is supplied to the piezoelectric element and in a case where the cycle of the waveform indicated by the residual vibration signal detected by the detection unit when the signal in which the driving voltage of the driving signal is decreased by the change voltage is supplied to the piezoelectric element becomes shorter than the cycle of the waveform indicated by the residual vibration signal detected by the detection unit when the signal in which the driving voltage of the driving signal for comparison is decreased by the change voltage is supplied to the piezoelectric element.

Further, according to another aspect of the invention, there is provided a method of controlling a printing apparatus that includes an ejection unit including a piezoelectric element that is displaced according to a driving signal, a pressure chamber whose inside is filled with a liquid and in which a pressure inside is increased or decreased by the displacement of the piezoelectric element based on the driving signal, and a nozzle that communicates with the pressure chamber and capable of ejecting the liquid filled into the inside of the pressure chamber through the increase or decrease of the pressure in the inside of the pressure chamber; a driving signal supply unit that supplies the driving signal to the piezoelectric element; a detection unit that detects change of an electromotive force of the piezoelectric element as a residual vibration signal based on the change of the pressure in the inside of the pressure chamber, which is generated after the driving signal is supplied to the piezoelectric element; and a determination unit that determines an ejection state of the liquid in the ejection unit based on the detection result of the detection unit in a case where the driving signal for inspection is supplied to the piezoelectric element, the method of controlling a printing apparatus including a first process of deciding a waveform of the driving signal for inspection such that the liquid is not ejected from the nozzles when the driving signal for inspection is supplied to the piezoelectric element, and a second process of correcting the waveform decided in the first process and deciding the corrected waveform as a waveform of the driving signal for inspection, in which, in the second process, the corrected waveform is decided such that the liquid is not ejected from the nozzles when the driving signal for inspection which has the corrected waveform is supplied to the piezoelectric element.

BRIEF DESCRIPTION OF THE DRAWINGS

The invention will be described with reference to the accompanying drawings, wherein like numbers reference like elements.

FIG. 16 is an explanatory diagram illustrating the contents of decoding of a decoder.

DESCRIPTION OF EXEMPLARY EMBODIMENTS

Hereinafter, embodiments for implementing the present invention will be described with reference to the drawings. However, throughout the drawings, dimensions and scaling of the respective parts are appropriately different from those of actual parts. Moreover, since embodiments described herein are preferred concrete examples of the present invention, the embodiments are provided with various limitations that are technologically preferred, but the scope of the present invention is not limited to the embodiments unless there is particularly a disclosure which limits the present invention in the following description.

A. FIRST EMBODIMENT

In the present embodiment, it will be described that an ink jet printer that ejects ink (one example of a "liquid") to form an image on recording paper P is exemplified as a printer.

1. Configuration of Ink Jet Printer

Figure 1:
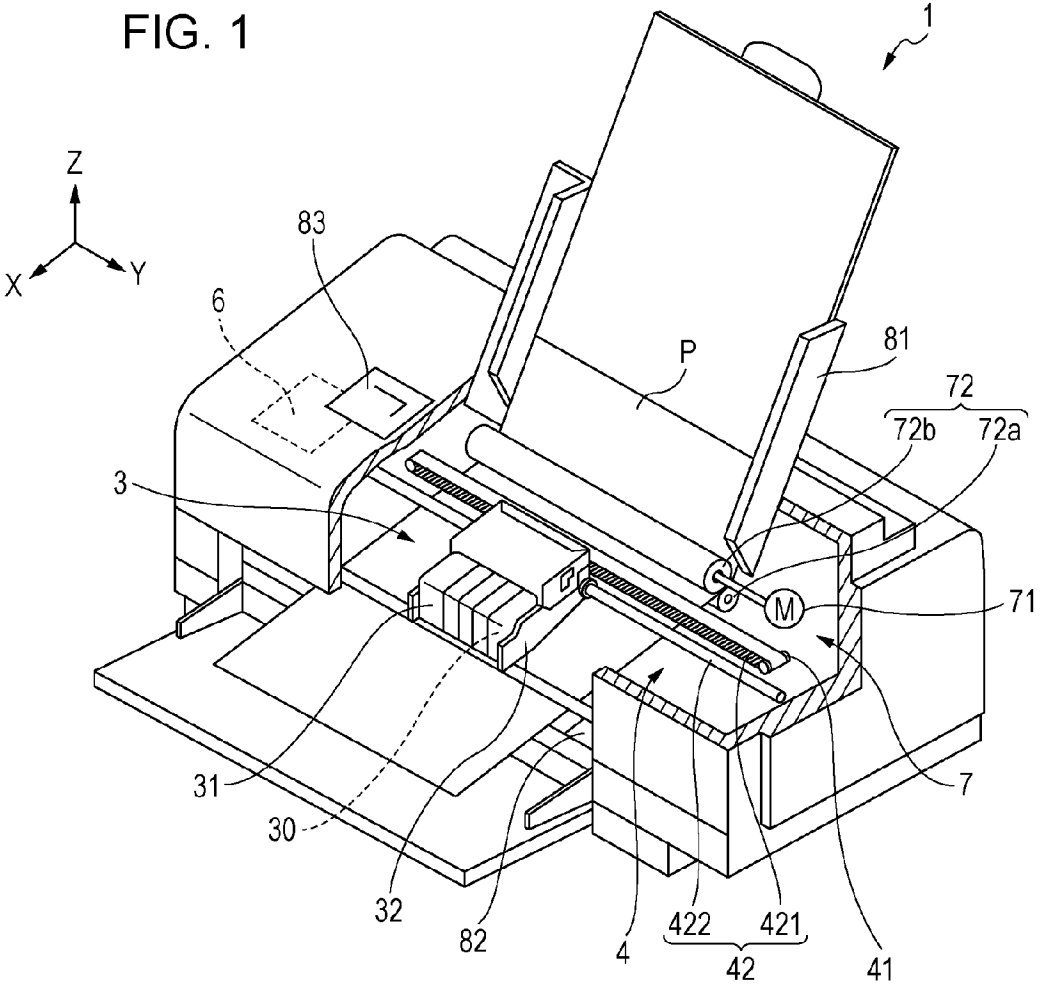
FIG. 1 is a schematic view illustrating an outline of a configuration of an ink jet printer according to a first embodiment of the invention.

FIG. 1 is a schematic perspective view illustrating a configuration of an ink jet printer 1 according to the present embodiment. The configuration of the ink jet printer 1 will be described with reference to FIG. 1. Further, in the following description, in FIG. 1, an upper side (+Z direction) is also referred to an "upper part", a lower side (−Z direction) is also referred to as a "lower part."

As illustrated in FIG. 1, the ink jet printer 1 includes a tray 81 that positions the recording paper P on an upper rear side, a paper delivery port 82 that delivers the recording paper P on a front lower side, and an operation panel 83 on an upper surface.

The operation panel 83 includes a liquid-crystal display, an organic EL display, or an LED lamp, and includes a display unit (not illustrated) that displays an error message, and an operation unit (not illustrated) that includes various switches. The display unit of the operation panel 83 functions as a notification unit.

Moreover, as illustrated in FIG. 1, the ink jet printer 1 includes a printing unit 4 having a moving body 3 that reciprocates.

The moving body 3 includes a head unit 30 that includes M number of ejection units 35, four ink cartridges 31, and a carriage 32 on which the head unit 30 and the four ink cartridges 31 are mounted (M is a natural number of two or more). The respective ejection units 35 may have the insides thereof filled with inks supplied from the ink cartridges 31, and eject the filled inks. Moreover, the four ink cartridges 31 are provided in a one-to-one correspondence with four colors of yellow, cyan, magenta and black, and the respective ink cartridges 31 are filled with inks of colors corresponding to the ink cartridges 31. Each of the M number of ejection units 35 receives the ink from any one of the four ink cartridges 31. Accordingly, the four colors of inks can be ejected from the M number of ejection units 35 as a whole, so that full color printing is realized.

Further, the ink jet printer 1 according to the present embodiment includes the four ink cartridges 31 corresponding to the four colors of inks, but the present invention is not limited thereto. Ink cartridges 31 filled with inks of colors different from the four colors may be further included, or only ink cartridges 31 corresponding to some colors of the four colors may be included.

Moreover, the ink cartridges 31 may be provided at another location on the ink jet printer 1 other than the carriage 32.

As illustrated in FIG. 1, the printing unit 4 includes a carriage motor 41 serving as a driving source that allows the moving body 3 to move (reciprocate) in a main scanning direction, and a reciprocating mechanism 42 that receives a rotation of the carriage motor 41 to allow the moving body 3 to reciprocate. Further, the main scanning direction is a direction in which a Y axis extends in FIG. 1. The reciprocating mechanism 42 has a carriage guide shaft 422 whose both ends are supported by a frame (not illustrated), and a timing belt 421 that extends in parallel with the carriage guide shaft 422. The carriage 32 of the moving body 3 is supported by the carriage guide shaft 422 of the reciprocating mechanism 42 to be able to reciprocate, and is fixed to a part of the timing belt 421. For this reason, when the timing belt 421 is moved in a forward or reverse direction through a pulley by an operation of the carriage motor 41, the moving body 3 is guided by the carriage guide shaft 422 to reciprocate.

Moreover, as illustrated in FIG. 1, the ink jet printer 1 includes a paper feed device 7 that supplies or discharges the recording paper P to or from the printing unit 4.

The paper feed device 7 includes a paper feed motor 71 serving as a driving source thereof, and paper feed rollers 72 rotated by an operation of the paper feed motor 71. The paper feed rollers 72 include a driven roller 72*a* and a driving roller 72*b* that face in upper and lower sides with a transportation route (the recording paper P) of the recording paper P interposed therebetween, and the driving roller 72*b* is connected to the paper feed motor 71. Thus, the paper feed rollers 72 send a plurality of sheets of recording paper P positioned in the tray 81 toward the printing unit 4 one by one, or discharge the plurality of sheets of recording paper from the printing unit 4 one by one. Further, a paper feed cassette that accommodates the recording paper P may be detachably attached instead of the tray 81.

Moreover, as illustrated in FIG. 1, the ink jet printer 1 includes a control unit 6 that controls the printing unit 4 and the paper feed device 7.

The control unit 6 performs a printing process on the recording paper P by controlling the printing unit 4 and the paper feed device 7 based on image data Img input from a host computer 9 such as a personal computer or a digital camera.

Specifically, the control unit 6 intermittently sends the recording paper P in a sub scanning direction (an X-axis direction) one by one by controlling the paper feed device 7. Moreover, the control unit 6 controls the moving body 3 to reciprocate in the main scanning direction (a Y-axis direction) crossing with the sending direction (the X-axis direction) of the recording paper P. That is, the control unit 6 performs the printing process on the recording paper P by ejecting the inks from the respective ejection units 35 based on the image data Img or controlling the driving of the head unit 30 to discharge the inks while controlling the moving body 3 to reciprocate in the main scanning direction and controlling the paper feed device 7 to intermittently send the recording paper P in the sub scanning direction.

Further, the control unit 6 displays an error message on the display unit of the operation panel 83, or turns on and off the LED lamp. The control unit allows the respective parts to perform the corresponding processes based on depression signals of various switches input from the operation unit of the operation panel 83. Furthermore, the control unit 6 may perform a process of transferring information of ejection abnormality or an error message to the host computer 9 if necessary.

Figure 2:
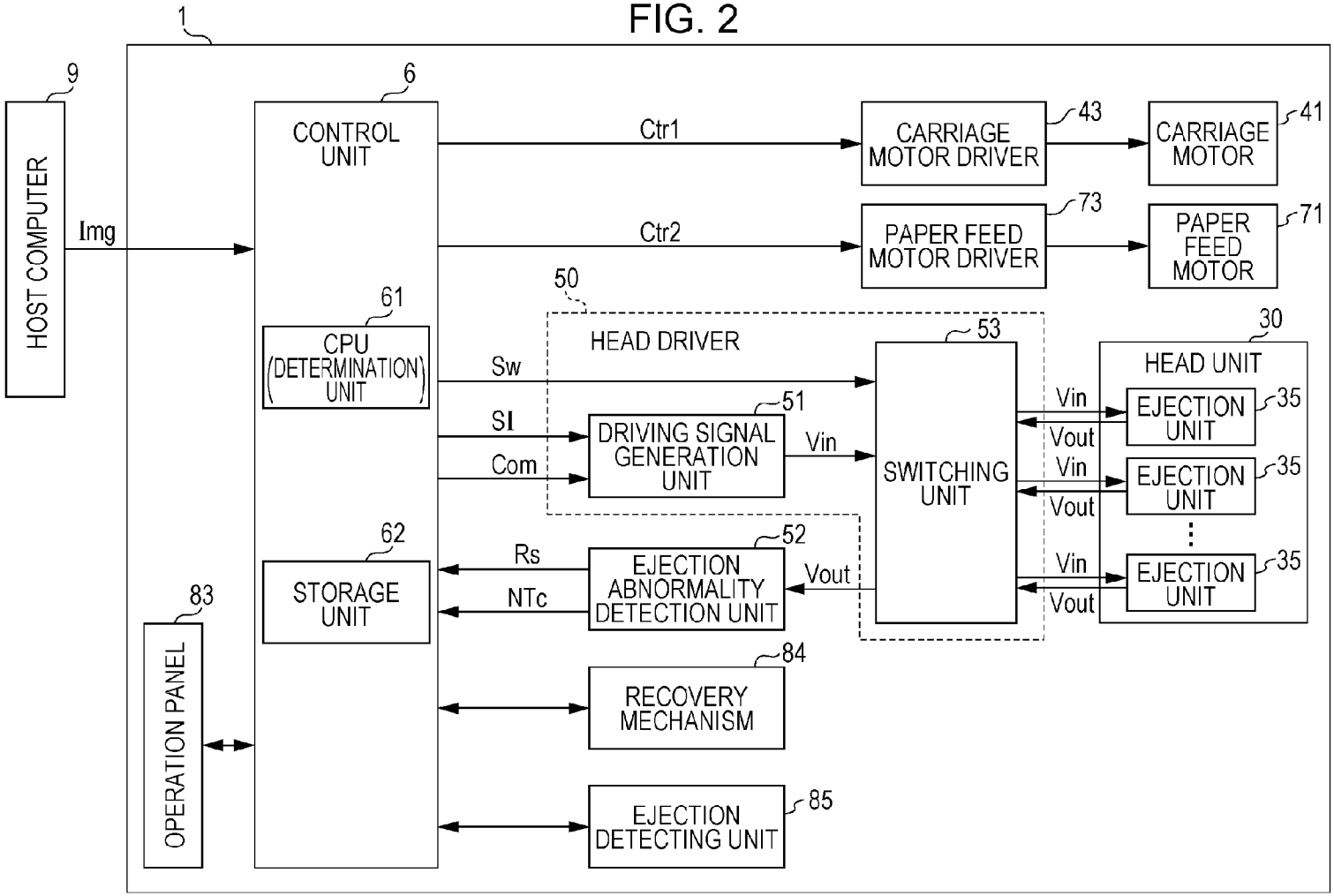
FIG. 2 is a block diagram illustrating the configuration of the ink jet printer.

FIG. 2 is a functional block diagram illustrating the configuration of the ink jet printer 1 according to the present embodiment.

The ink jet printer 1 includes the head unit 30 including the M number of ejection units 35, a head driver 50 (one example of a "driving signal supplying unit") that drives the head unit 30, an ejection abnormality detection unit 52 that detects ejection abnormality of the ejection unit 35, and a recovery mechanism 84 that recovers the ejection unit 35 from the ejection abnormality to normality when the ejection abnormality of the ejection unit 35 is detected.

Moreover, the ink jet printer 1 includes the carriage motor 41 for allowing the head unit 30 to reciprocate, a carriage motor driver 43 that drives the carriage motor 41, the paper feed motor 71 for transporting the recording paper P, and a paper feed motor driver 73 that drives the paper feed motor 71.

Moreover, the ink jet printer 1 includes the control unit 6 for controlling the operations of the respective parts of the ink jet printer 1.

As illustrated in FIG. 2, the control unit 6 includes a CPU 61, and a storage unit 62.

The storage unit 62 includes an EEPPROM (Electrically Erasable Programmable Read-Only Memory) which is a kind of a non-volatile semiconductor memory that stores the image data Img supplied through a non-illustrated interface unit from the host computer 9 in a data storage area. Moreover, the storage unit 62 includes a RAM (Random Access Memory) that temporarily stores data required to perform various processes such as a printing process and the like and temporarily develops a control program for executing various processes such as a printing process and the like. Moreover, the control unit 62 includes a PROM which is a kind of a non-volatile semiconductor memory that stores the control program for controlling the respective parts of the ink jet printer 1.

The CPU 61 stores the image date Img supplied from the host computer 9 in the storage unit 62. Moreover, based on various data such as the image data Img stored in the storage unit 62, the CPU 61 generates a driver control signal Ctr1 for controlling the operation of the carriage motor driver 43, a driver control signal Ctr2 for controlling the operation of the paper feed motor driver 73, a printing signal SI for controlling the operation of the head driver 50 to drive the ejection units 35, various signals such as a switching control signal Sw and a driving waveform signal Com, a signal for controlling the operation of the recovery mechanism 84, and a signal for controlling the operation of the operation panel 83, and outputs the generated signals.

The head driver 50 includes a driving signal generation unit 51, an ejection abnormality detection unit 52, and a switching unit 53.

The driving signal generation unit 51 generates a driving signal Vin for driving the ejection units 35 included in the head unit 30 based on the printing signal SI and the driving waveform signal Com supplied from the control unit 6. Further, although details will be described below, the driving waveform signal Com in the present embodiment includes driving waveform signals Com-A, Com-B and Com-C.

The ejection abnormality detection unit 52 detects, as a residual vibration signal Vout, a change of an internal pressure of the ejection unit 35 caused by vibration of the ink within the ejection unit 35 which is generated after the ejection unit 35 is driven by the driving signal Vin. Moreover, the ejection abnormality detection unit 52 determines an ejection state of the ink in the ejection unit 35 such as whether or not the ejection abnormality occurs in the ejection unit 35 based on the residual vibration signal Vout, and outputs a determination result signal Rs representing the determination result. Moreover, the ejection abnormality detection unit 52 outputs a detection signal NTc representing a cycle Tc corresponding to one wavelength of a waveform represented by the residual vibration signal Vout.

The switching unit 53 electrically connects the respective ejection units 35 to any one of the driving signal generation unit 51 and the ejection abnormality detection unit 52, based on the switching control signal Sw supplied from the control unit 6.

Moreover, the ink jet printer 1 includes an ejection detection unit 85 that detects whether or not the ejection unit 35 ejects the ink.

The ejection detection unit 85 detects whether the ejection unit 35 ejects the ink by using, for example, an optical unit, and outputs the detection result.

As stated above, the control unit 6 (the CPU 61) controls the respective parts of the ink jet printer 1 such as the carriage motor driver 43, the paper feed motor driver 73, the head driver 50, the operation panel 83 and the recovery mechanism 84 by generating various signals such as the driver control signal Ctr1, the driver control signal Ctr2, the printing signal SI, the driving waveform signal Com and the switching control signal Sw to supply the generated signals to the respective parts of the ink jet printer 1.

Thus, the control unit 6 (the CPU 61) executes various processes such as the printing process, the ejection abnormality detecting process, the inspection waveform determining process and the recovery process.

Here, the printing process is a process of ejecting the ink from the ejection unit 35 to form an image on the recording paper P by controlling the operation of the head driver 50 by the control unit 6 based on the image data Img.

Moreover, the ejection abnormality detecting process is a process of generating residual vibration in the ejection unit 35 to inspect the ejection state of the ink in the ejection unit 35 based on the generated residual vibration by controlling the operation of the head driver 50 to supply the driving signal Vin for inspection to the ejection unit 35 by the control unit 6.

Moreover, the inspection waveform determining process is a process of determining a waveform of the driving signal Vin for inspection supplied from the head driver 50 to the ejection unit 35 serving as a target of the ejection abnormality detecting process.

Moreover, the recovery process is referred to as a process for recovering the ejection state of the ink of the ejection unit 35 to the normality such as a wiping process of wiping a foreign substance such as paper powder attached to a nozzle plate 240 of the ejection unit 35 by a wiper (not illustrated) when the ejection abnormality of the ink is detected in the ejection unit 35 in the ejection abnormality detecting process using the recovery mechanism 84, a pumping process of sucking ink or bubbles thickened within a cavity 245 of the ejection unit 35 by a tube pump (not illustrated), or a flushing process of preliminarily ejecting the ink from the ejection unit 35. The control unit 6 selects one or two or more recovery processes appropriate to recover the ejection state of the ejection unit 35 from among the flushing process, the wiping process and the pumping process, and executes the selected recovery process.

2. Configuration of Head Unit

Next, configurations of the head unit 30 and the ejection unit 35 including the head unit 30 will be described with reference to FIGS. 3 and 4.

Figure 3:
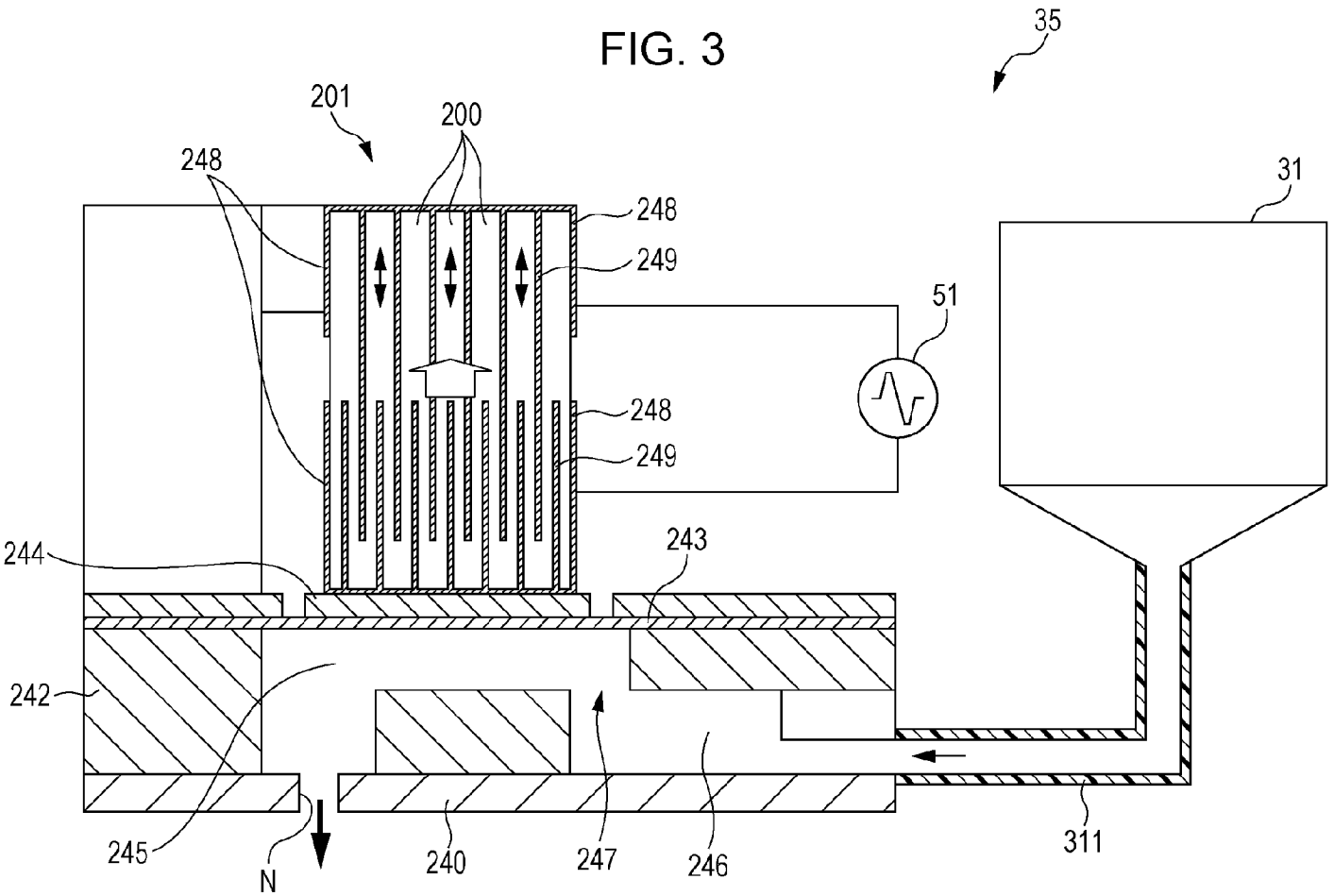
FIG. 3 is a cross-sectional view schematically illustrating an ejection unit.

FIG. 3 is a schematic cross-sectional view of the ejection unit 35 included in the head unit 30. The ejection unit 35 illustrated in FIG. 3 is a unit that ejects the ink (one example of a "liquid") within the cavity 245 (one example of a "pressure chamber") from nozzles N by driving of piezoelectric elements 200. The ejection unit 35 includes the nozzle plate 240 at which the nozzles N are formed, a cavity plate 242, a vibration plate 243, and a laminated piezoelectric element 201 in which the plurality of piezoelectric elements 200 is laminated.

The cavity plate 242 is formed in a predetermined shape (a shape in which a concave portion is formed), and, thus, the cavity 245 and a reservoir 246 are formed. The cavity 245 and the reservoir 246 communicates with an ink supplying opening 247. In addition, the reservoir 246 communicates with the ink cartridge the ink supply tube 311.

In FIG. 3, a lower end of the laminated piezoelectric element 201 is bonded to the vibration plate 243 through an intermediate layer 244. A plurality of outer electrodes 248 and a plurality of inner electrodes 249 are bonded to the laminated piezoelectric element 201. That is, the outer electrodes 248 are bonded to an outer surface of the laminated piezoelectric element 201, and the inner electrodes 249 are provided between the piezoelectric elements 200 constituting the laminated piezoelectric element 201. In this case, some of the outer electrodes 248 and the inner electrodes 249 are alternately arranged so as to be overlapped in a thickness direction of the piezoelectric element 200.

In addition, the laminated piezoelectric element 201 is deformed as indicated by arrow of FIG. 3 (expands and contracts in an up and down direction in FIG. 3) to vibrate by supplying the driving signal Vin between the outer electrodes 248 and the inner electrodes 249 from the driving signal generation unit 51, and the vibration plate 243 vibrates by the vibration. A volume of the cavity 245 (a pressure within the cavity) is changed by the vibration of the vibration plate 243, and the ink (the liquid) filled into the cavity 245 is ejected from the nozzles N as the liquid.

When the ink within the cavity 245 is reduced by the ejection of the ink, the ink is supplied from the reservoir 246. Moreover, the ink is supplied from the ink cartridge 31 through an ink supply tube 311 to the reservoir 246.

Figure 4:
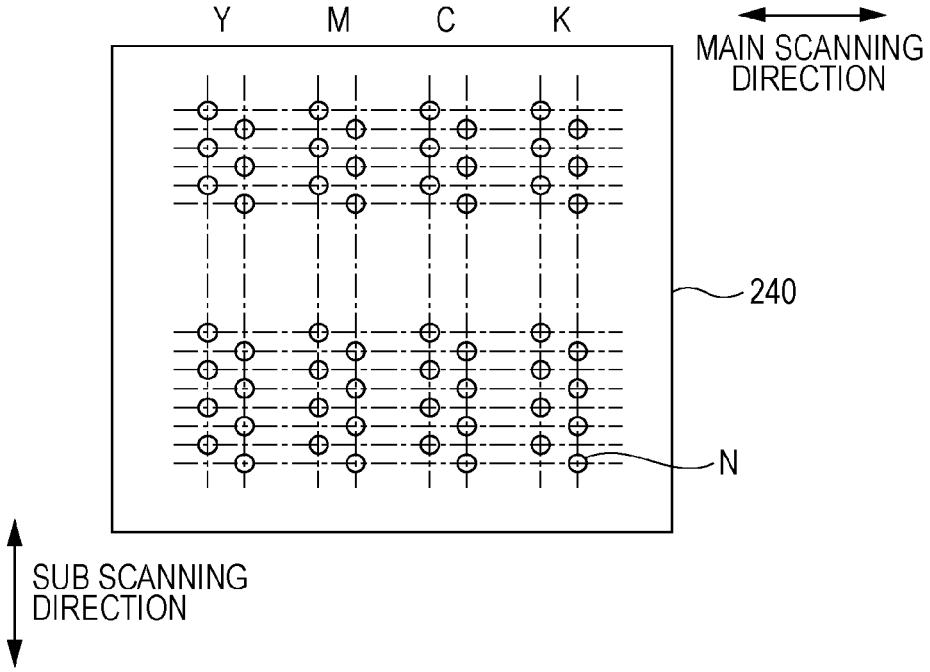
FIG. 4 is a plan view schematically illustrating a nozzle plate included in a head unit.

Further, an arrangement pattern of the nozzles N formed at the nozzle plate 240 illustrated in FIG. 3 is performed such that columns thereof are shifted like a nozzle arrangement pattern illustrated in FIG. 4. In addition, pitches between the nozzles N can be appropriately obtained according to printing resolution (dpi: dot per inch) Further, in FIG. 4, the arrangement pattern of the nozzles N is illustrated when the inks of four colors (the ink cartridges) are applied.

Figure 5:
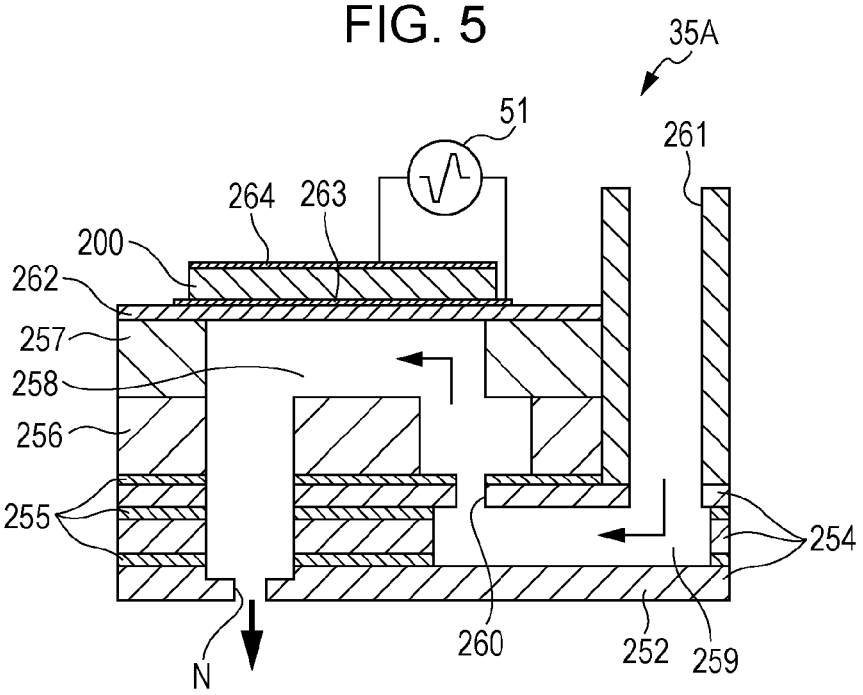
FIG. 5 is a cross-sectional view schematically illustrating an ejection unit.

Next, another example of the ejection unit will be described. An ejection unit 35A illustrated in FIG. 5 is a unit that ejects an ink (a liquid) within a cavity 258 from nozzles N by vibration of a vibration plate 262 caused by the vibration of the piezoelectric elements 200. A metal plate 254 made of stainless steel is bonded to a nozzle plate 252 at which the nozzles N are formed and which is made of stainless steel through an adhesive film 255, and a metal plate 254 made of the same stainless steel is bonded to the nozzle plate through an adhesive film 255. In addition, a communicating opening forming plate 256 and a cavity plate 257 are sequentially bonded to the metal plate.

The nozzle plate 252, the metal plate 254, the adhesive film 255, the communicating opening forming plate 256 and the cavity plate 257 are formed in a predetermined shape (a shape in which a concave portion is formed) and these plates are overlapped, so that a cavity 258 and a reservoir 259 are formed. The cavity 258 and the reservoir 259 communicate with an ink supplying opening 260. Moreover, the reservoir 259 communicates with an ink intake port 261.

The vibration plate 262 is provided at a top opening of the cavity plate 257, and the piezoelectric element 200 is bonded to the vibration plate 262 through lower electrodes 263. Moreover, upper electrodes 264 are bonded to an opposite side to the lower electrodes 263 of the piezoelectric element 200.

The driving signal generation unit 51 supplies the driving signal Vin between the upper electrodes 264 and the lower electrodes 263, and, thus the piezoelectric element 200 vibrates. The vibration plate 262 bonded to the piezoelectric element vibrates. The volume of the cavity 258 (the pressure within the cavity) is changed by the vibration of the vibration plate 262, and the ink (the liquid) filled within the cavity 258 is ejected through the nozzles N.

When the ink is ejected and the amount of ink within the cavity 258 is reduced, the ink is supplied from the reservoir 259. Moreover, the ink is supplied from the ink intake port 261 to the reservoir 259.

Figure 6A:
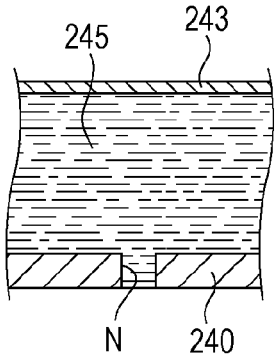
FIGS. 6A to 6C are an explanatory diagram for describing change in cross-sectional shape of the ejection unit when a driving signal is supplied.
Figure 6B:
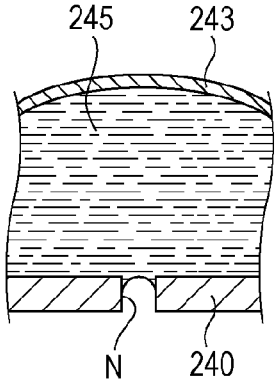
Figure 6C:
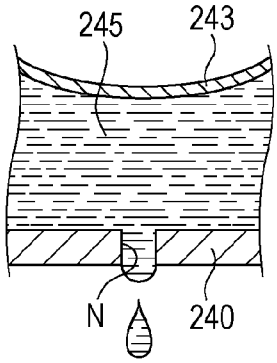

Next, the ejection of the ink will be described with reference to FIGS. 6A-6C.

When the driving signal Vin is supplied to the piezoelectric element 200 illustrated in FIG. 3 (FIG. 5) from the driving signal generation unit 51, distortion proportional to an electric field applied between the electrodes occurs. Thus, the vibration plate 243 (262) is bent in the up and down direction of FIG. 3 (FIG. 5) from an initial state illustrated in FIG. 6A, and the volume of the cavity 245 (258) is increased as illustrated in FIG. 6B. In this state, when a voltage representing the driving signal Vin is changed under the control of the driving signal generation unit 51, the vibration plate 243 (262) is restored by an elastic restoring force, and moves downwards over a position of the vibration plate 243 (262) in the initial state. The volume of the cavity 245 (258) is rapidly contracted as illustrated in FIG. 6C. At this time, some of the ink filled into the cavity 245 (258) is ejected as ink droplets from the nozzles N that communicate with the cavity 245 (258) by a compression pressure generated within the cavity 245 (258).

The vibration plate 243 of the cavity 245 damping-vibrates until the subsequent ink ejecting operation starts after a series of ink ejecting operations are finished. Hereinafter, the damping-vibration is also referred to as residual vibration. It is assumed that the residual vibration of the vibration plate 243 has a natural vibration frequency determined by shapes of the nozzles N and the ink supplying opening 247, or an acoustic resistance r due to ink viscosity, an inertance m due to an ink weight within a flow path, and a compliance Cm of the vibration plate 243.

3. Regarding to Residual Vibration

A calculation model of the residual vibration of the vibration plate 243 based on the assumption will be described.

Figure 7:
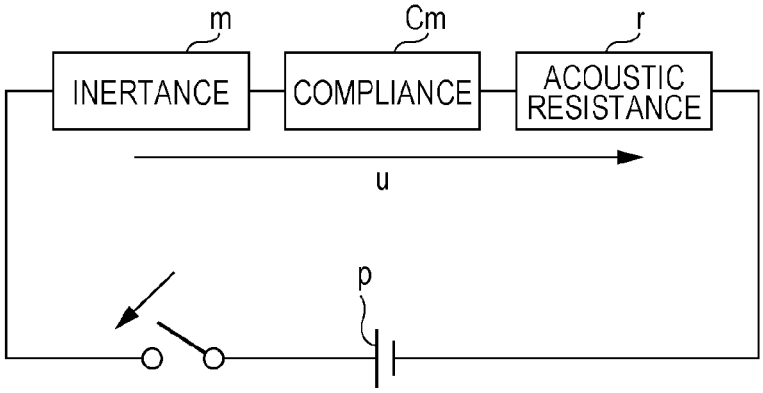
FIG. 7 is a circuit view illustrating a model of simple vibration indicating residual vibration in the ejection unit.

FIG. 7 is a circuit view illustrating the calculation model of simple harmonic vibration which assumes the residual vibration of the vibration plate 243.

As described above, the calculation model of the residual vibration of the vibration plate 243 is expressed by an acoustic pressure p, the aforementioned inertance m, acoustic resistance r and compliance Cm. Furthermore, if a step response is calculated for a volume velocity u when the acoustic pressure p is applied in the circuit of FIG. 7, the following equation is obtained.

$$u=\{p/(\omega\cdot m)\}e^{-\alpha t}\cdot\sin(\omega t)$$

$$\omega=\{1/(m\cdot Cm)-\alpha^2\}^{1/2}$$

$$\alpha=r/(2m)$$

Figure 8:
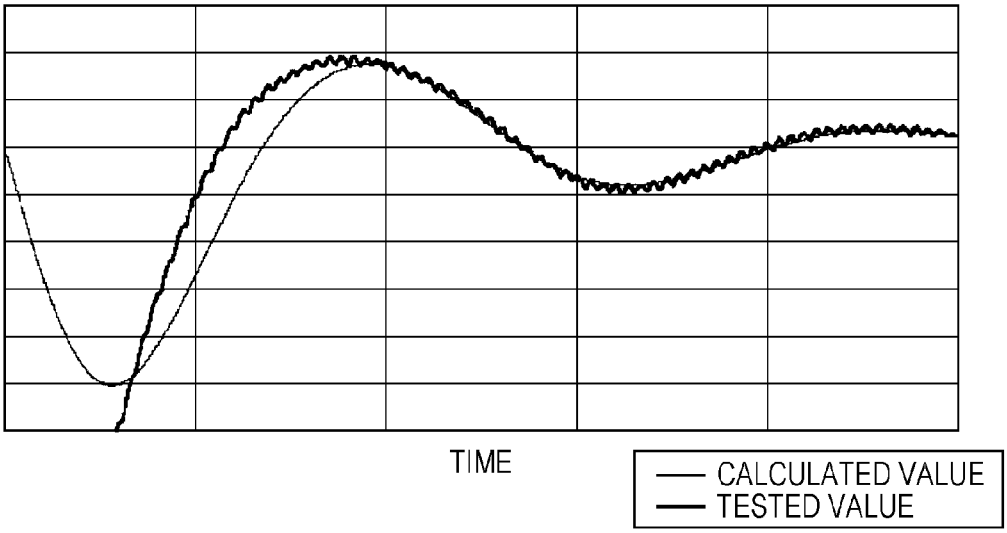
FIG. 8 is a graph illustrating a relationship between test values and calculated values of the residual vibration when the ejection state is normal in the ejection unit.

The calculation result obtained from the equation is compared with an experimental result in an experiment of the residual vibration of the vibration plate 243 after the ink droplets are separately ejected. FIG. 8 is a graph representing a relation between test values of the residual vibration of the vibration plate 243 and calculated values. As can be seen from the graph of FIG. 8, two waveforms of the test values and the calculated values roughly coincide.

In the ejection unit 35, a phenomenon where the ink droplets are not normally ejected from the nozzles N even though the ejecting operation described above is performed, that is, the ejection abnormality of the liquid droplets may occur. As a cause by which the ejection abnormality is generated, there are (1) mixing of bubbles into the cavity 245, (2) drying and thickening (adhering) of the ink in the vicinity of the nozzles N, and (3) attaching of paper powder in the vicinity of outlets of the nozzles N.

When the ejection abnormality is caused, as a result, the liquid droplets are not typically ejected from the nozzles N, that is, the non-ejection phenomenon of the liquid droplets is exhibited. In this case, dot omission of a pixel in an image printed on the recording paper P occurs. Moreover, when the ejection abnormality is caused, even though the liquid droplets are ejected from the nozzles N, the amount of the liquid droplets is too small, or a scattering direction (a trajectory) of the liquid droplets is deviated. Thus, since impact is not appropriately performed, the dot omission of the pixel appears. In this way, in the following description, the ejection abnormality of the liquid droplets is also referred to as "dot omission."

In the following description, based on the comparison result represented in FIG. 8, at least one value of the acoustic resistance r and the inertance m is adjusted so as to allow the calculated values of the residual vibration of the vibration plate 243 and the test values to match (roughly coincide) for each cause of the dot omission (ejection abnormality) phenomenon (liquid-droplet non-ejection phenomenon) occurring in the ejection unit 35 when the printing process is performed.

Figure 9:
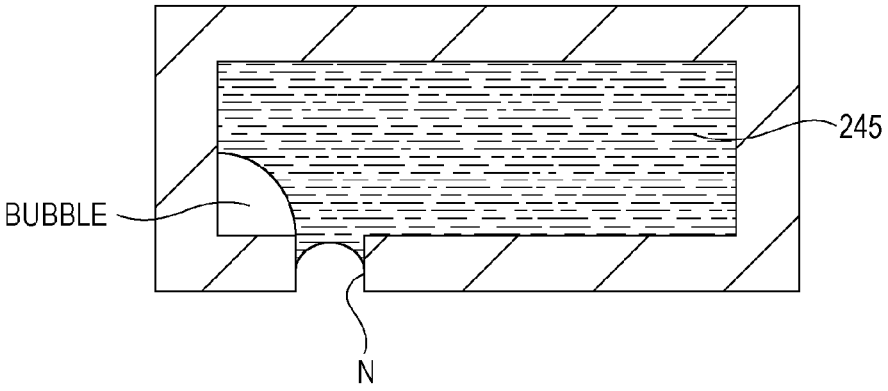
FIG. 9 is an explanatory diagram illustrating a state of the ejection unit when bubbles are mixed into the inside of a cavity.

Firstly, (1) the mixing of bubbles into the cavity 245 which is one cause of the dot omission is examined. FIG. 9 is a conceptual view in the vicinity of the nozzles N when the bubbles are mixed into the cavity 245. As illustrated in FIG. 9, it is assumed that the generated bubbles are generated and attached to a wall surface of the cavity 245.

As mentioned above, when the bubbles are mixed into the cavity 245, it is considered that the total weight of the ink filled into the cavity 245 is reduced and the inertance m is decreased. Moreover, as exemplified in FIG. 9, when the bubbles are attached in the vicinity of the nozzles N, it is considered that diameters of the nozzles N become larger by as much as diameters of the bubbles and the acoustic resistance r is decreased.

Figure 10:
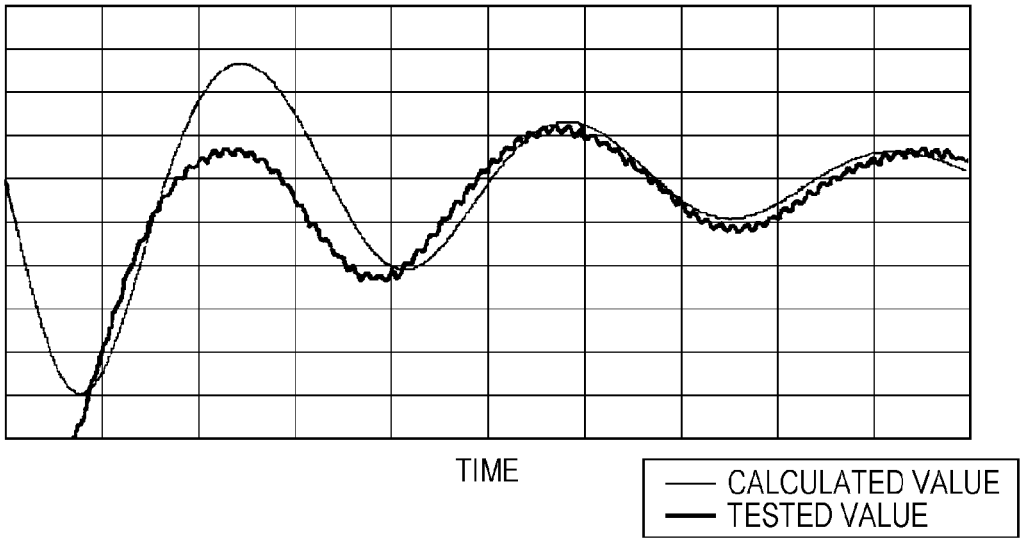
FIG. 10 is a graph illustrating test values and calculated values of the residual vibration in a state in which an ink cannot be ejected due to the mixture of bubbles into the inside of the cavity.

Accordingly, in the case of FIG. 8 where the ink is normally ejected, the acoustic resistance r and the inertance m are set to be small to match the test values of the residual vibration when the bubbles are mixed in, so that a result (a graph) represented in FIG. 10 is obtained. As can be seen from the graphs of FIGS. 8 and 10, when the bubbles are mixed into the cavity 245, a distinctive residual vibration waveform having a frequency higher than that in the case of normal ejection is obtained. Further, it can be seen that since the acoustic resistance r is decreased, a damping rate of an amplitude of the residual vibration is also decreased, so that the amplitude of the residual vibration is slowly decreased.

Figure 11:
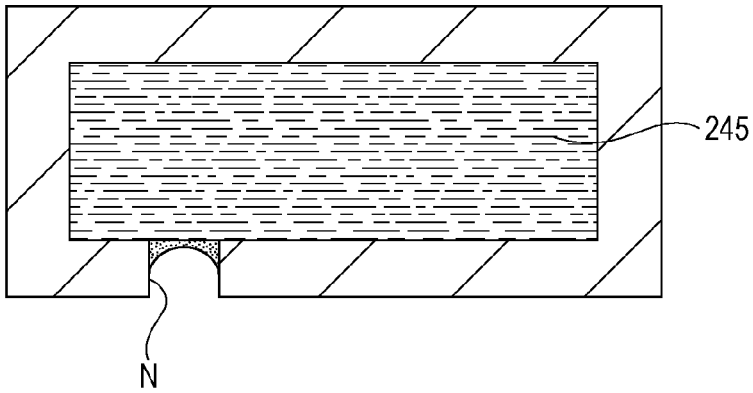
FIG. 11 is an explanatory diagram illustrating a state of the ejection unit when the ink is adhered to the vicinity of a nozzle.

Next, (2) the drying (fixation, thickening) of the ink in the vicinity of the nozzles N which is another cause of the dot omission is examined. FIG. 11 is a conceptual view in the vicinity of the nozzles N when the ink in the vicinity of the nozzles N of FIG. 3 adheres by drying. As illustrated in FIG. 11, when the ink in the vicinity of the nozzles N is dried and adheres, the ink within the cavity 245 is enclosed within the cavity 245. As stated above, when the ink in the vicinity of the nozzles N is dried and thickened, it is considered that the acoustic resistance r is increased.

Figure 12:
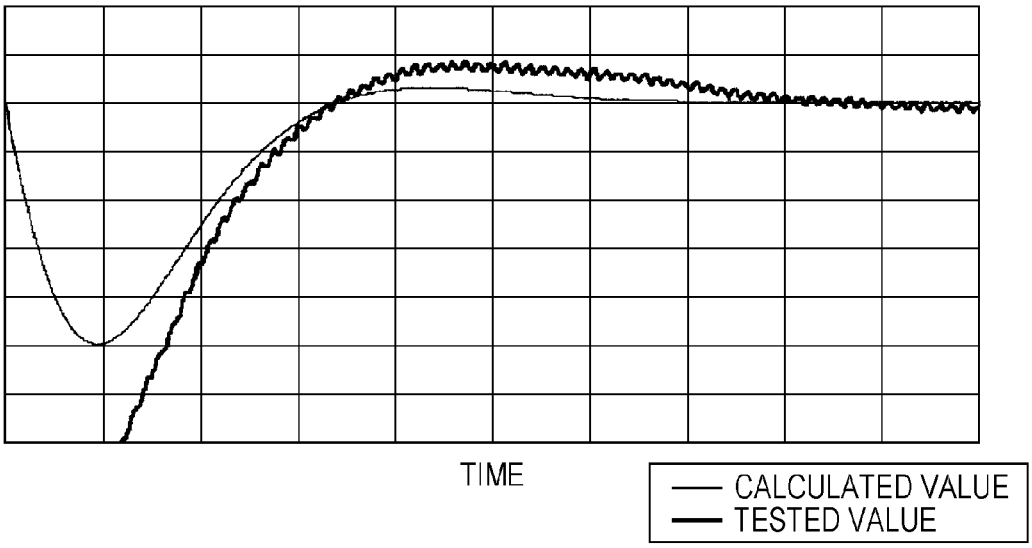
FIG. 12 is a graph illustrating test values and calculated values of the residual vibration in a state in which the ink cannot be ejected due to fixation of the ink to the vicinity of the nozzle.

Accordingly, in the case of FIG. 8 where the ink is normally ejected, the acoustic resistance r is set to be large to coincide with the test values of the residual vibration when the ink in the vicinity of the nozzles N is dried and adheres (thickened), so that a result (a graph) represented in FIG. 12 is obtained. Further, the test values represented in FIG. 12 are obtained by measuring the residual vibration of the vibration plate 243 while the ejection units 35 are placed without attaching caps for several days and the ink is not ejected (the ink adheres) by drying and thickening of the ink in the vicinity of the nozzles N. As can be seen from the graphs of FIGS. 8 and 12, when the ink adheres by drying of the ink in the vicinity of the nozzles N, the frequency is extremely decreased as compared to the normal ejection, and the distinctive residual vibration waveform in which the residual vibration is over-damped is obtained. This is because after the ink is allowed to flow into the cavity 245 from the reservoir by pulling the vibration plate 243 upwards in FIG. 3 in order to eject the ink droplets, since there is no retreat route of the ink within the cavity 245 at the time of moving the vibration plate 243 downwards in FIG. 3, it is difficult for the vibration plate 243 to rapidly vibrate (over-damping).

Figure 13:
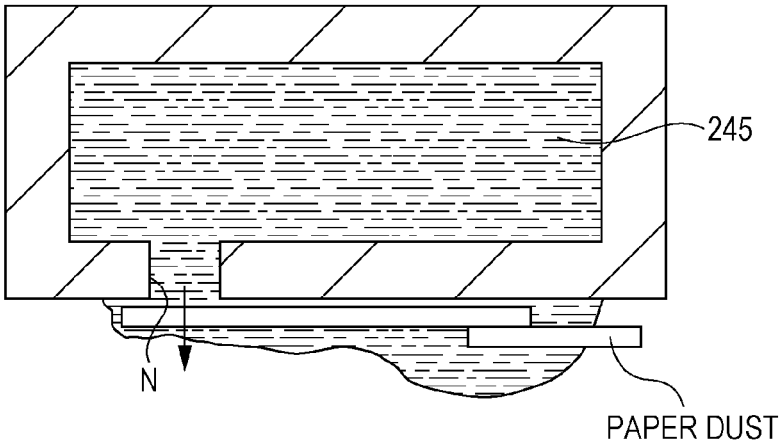
FIG. 13 is an explanatory diagram illustrating a state of the ejection unit in a case where paper dust is adhered to the vicinity of the outlet of the nozzle.

Next, (3) the attaching of paper powder in the vicinity of outlets of the nozzles N which is the other cause of the dot omission is examined. FIG. 13 is a conceptual view in the vicinity of the nozzles N when the paper powder is attached in the vicinity of the nozzles N of FIG. 3. As illustrated in FIG. 13, when the paper powder is attached in the vicinity of the nozzles N, the ink is exuded from the inside of the cavity 245 through the paper powder, and it is difficult to eject the ink from the nozzles N. As stated above, when the paper powder is attached in the vicinity of the nozzles N and the ink is exuded from the nozzles N, since the ink within the cavity 245 and the exuded ink are more increased than that of the normal state when viewed from the vibration plate 243, it is considered that the inertance m is increased. Moreover, it is considered that the acoustic resistance r is increased by fibers of the paper powder attached to the outlets of the nozzles N.

Figure 14:
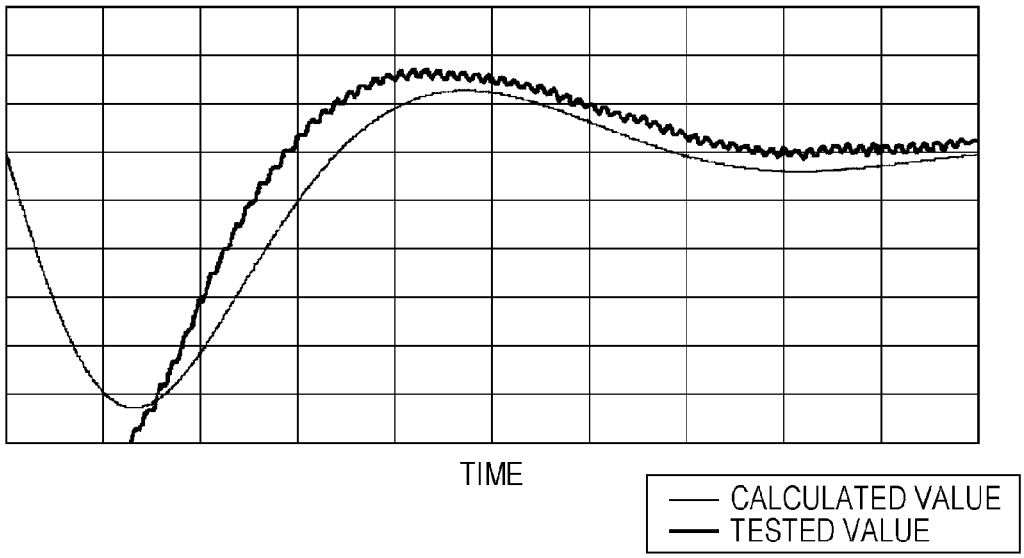
FIG. 14 is a graph illustrating test values and calculated values of the residual vibration in a state in which the ink cannot be ejected due to the adhesion of paper dust to the vicinity of the outlet of the nozzle.

Accordingly, in the case of FIG. 8 where the ink is normally ejected, the inertance m and the acoustic resistance r are set to be large to match the test values of the residual vibration when the paper powder is attached in the vicinity of the nozzles N, so that a result (a graph) of FIG. 14 is obtained. As can be seen from the graphs of FIGS. 8 and 14, when the paper powder is attached in the vicinity of the nozzles N, the distinctive residual vibration waveform having a frequency lower than that in the normal ejection is obtained.

Further, as can be seen from the graphs of FIGS. 12 and 14, when the paper powder is attached, the frequency of the residual vibration is higher than that when the ink is dried.

Here, the frequency of the damped vibration when the ink in the vicinity of the nozzles N is dried and thickened and also when the paper powder is attached in the vicinity of the outlets of the nozzles N is lower than that when the ink is normally ejected. In order to specify the causes of the two dot omission (ink non-ejection: ejection abnormality) from the waveform of the residual vibration of the vibration plate 243, it is possible to compare the frequency or the cycle of the damped vibration and the phase with predetermined threshold values, or specify a cycle change of the residual vibration (damped vibration) or the damping rate of the amplitude change. By doing this, it is possible to detect the ejection abnormality of the ejection unit 35 by the change of the residual vibration of the vibration plate 243, particularly, the change of the frequency thereof when the ink droplets are ejected from the nozzles N in the ejection unit 35. Moreover, by comparing the frequency of the residual vibration in this case with the frequency of the residual vibration in the normal ejection, it is possible to specify the causes of the ejection abnormality.

The ink jet printer 1 according to the present invention analyzes the residual vibration to perform the ejection abnormality detecting process for detecting the ejection abnormality.

4. Configurations and Operations of Head Driver and Ejection Abnormality Detection Unit Next, the configurations and the operations of the head driver 50 (the driving signal generation unit 51 and the switching unit 53) and the ejection abnormality detection unit 52 will be described with reference to FIGS. 15 to 22.

Figure 15:
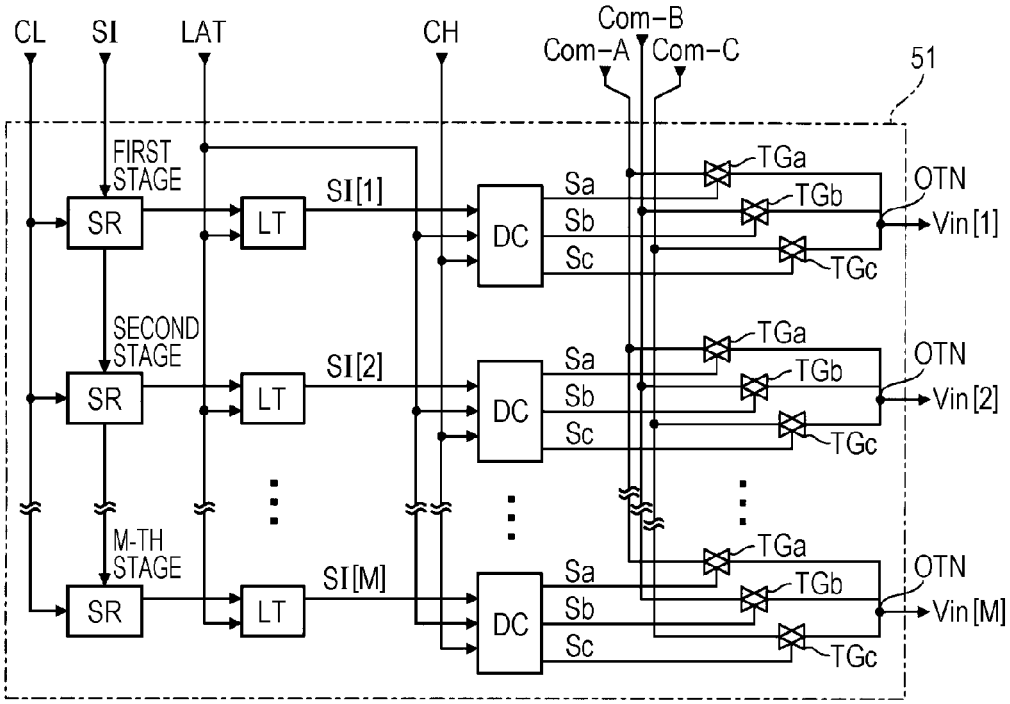
FIG. 15 is a block diagram illustrating the configuration of a driving signal generation unit.

FIG. 15 is a block diagram illustrating the configuration of the driving signal generation unit 51 of the head driver 50. As illustrated in FIG. 15, the driving signal generation unit 51 has M number of sets each including shift registers SR, latch circuits LT, decoders DC, and transmission gates TGa, TGb and TGc so as to be in a one-to-one correspondence with the M number of ejection units 35. In the following description, the respective parts constituting the M number of sets are referred to as a first stage, a second stage, . . . , and a M-th stage in sequence from the top in the drawing (in FIG. 15, only the stages of the shift register SR are illustrated for purposes of simplifying illustration).

Further, although details will be described below, the ejection abnormality detection unit 52 includes M number of ejection abnormality detection circuits DT (DT[1], DT[2], . . . , and DT[M]) so as to be in a one-to-one correspondence with the M number of ejection units 35.

Clock signals CL, printing signals SI, latch signals LAT, change signals CH, and driving waveform signals Com (Com-A, Com-B and Com-C) are supplied to the driving signal generation unit 51, from the control unit 6.

Here, the printing signal SI is a digital signal that defines the amount of ink ejected from the ejection unit 35 (the nozzles N) in forming one dot of an image. More specifically, the printing signals SI according to the present embodiment are signals that define the amount of inks ejected from the ejection units 35 (the nozzles N) by 3 bits of a high-order bit b1, a middle-order bit b2 and a low-order bit b3, and are serially supplied to the driving signal generation unit 51 in synchronization with the clock signals CL from the control unit 6. By controlling the amount of inks ejected from the ejection units 35 by the printing signals SI, it is possible to express four gradation steps of non-recording, a small dot, a medium dot and a large dot in the respective dots of the recording paper P, and it is possible to generate the residual vibration to generate the driving signal Vin for inspection for inspecting the ejection state of the ink.

The shift registers SR temporarily hold the printing signals SI of 3 bits corresponding to the ejection units 35. Specifically, the M number of shift registers SR having the first stage, the second stage, . . . , and the M-th stage in a one-to-one correspondence with the M number of ejection units 35 are cascade-connected to each other, and the printing signals SI serially supplied are sequentially transferred to the subsequent stage in response to the clock signals CL. Furthermore, the supply of the clock signals CL is stopped at a point of time when the printing signals SI are transferred to all of the M number of shift registers SR, and each of the M number of shift registers SR maintains a state where each shift register holds data of 3 bits corresponding to each shift register among the printing signals SI.

The M number of latch circuits LT simultaneously latch the printing signals SI of 3 bits corresponding to the respective stages held by the respective M number of shift registers SR at a timing when the latch signals LAT rise. In FIG. 15, SI[1], SI[2], . . . , SI[M] are the printing signals SI of 3 bits latched by the latch circuits LT corresponding to the shift registers SR of first, second, . . . and M stages.

Incidentally, an operation period during which the ink jet printer 1 performs at least one process of the printing process, the ejection abnormality detecting process and the inspection waveform determining process includes a plurality of unit operation periods Tu. The unit operation period Tu includes a control period Ts1 and a control period Ts2 subsequent to the control period Ts1. In the present embodiment, the control periods Ts1 and Ts2 have an equal time length to each other.

Further, the plurality of unit operation periods Tu constituting the operation period may include four types of unit operation periods Us that include a unit operation period Tu during which the printing process is performed, a unit operation period Tu during which the ejection abnormality detecting process is performed, a unit operation period Tu during which both of the printing process and the ejection abnormality detecting process are performed, and a unit operation period Tu during which the inspection waveform determining process is performed.

The control unit 6 supplies the printing signals SI during each unit operation period Tu to the driving signal generation unit 51, and controls the driving signal generation unit 51 to allow the latch circuits LT to latch the printing signals SI[1], SI[2], . . . , SI[M] during each unit operation period Tu. That is, the control unit 6 controls the driving signal generation unit 51 to supply the driving signals Vin to the M number of ejection unit 35 during each unit operation period Tu.

More specifically, when only the printing process is performed during the unit operation period Tu, the control unit 6 controls the driving signal generation unit 51 to supply the driving signals Vin for printing to the M number of ejection units 35. Thus, the M number of ejection units 35 eject the amount of inks corresponding to the image data Img on the recording paper P, and an image corresponding to the image data Img is formed on the recording paper P.

Meanwhile, when only the ejection abnormality detecting process is performed during the unit operation period Tu, the control unit 6 controls the driving signal generation unit 51 to supply the driving signals Vin for inspection to the M number of ejection units 35.

Moreover, when both of the printing process and the ejection abnormality detecting process are performed during the unit operation period Tu, the control unit 6 controls the driving signal generation unit 51 to supply the driving signals Vin for printing to some of the M number of ejection units 35 and to supply the driving signals Vin for inspection to the rest of the ejection units 35.

Further, when the inspection waveform determining process is performed during the unit operation period Tu, the control unit 6 controls the driving signal generation unit 51 to supply the driving signals Vin for inspection to the M number of ejection units 35. However, although details will be described below, in the inspection waveform determining process, the driving signals Vin for inspection supplied to the ejection units 35 are driving signals Vin for deciding the waveform of the driving signal Vin for inspection used in the ejection abnormality detecting process, and do not necessarily coincide with the driving signals Vin for inspection used in the ejection abnormality detecting process.

The decoder DC decodes the printing signal SI of 3 bits latched by the latch circuit LT, and outputs selection signals Sa, Sb and Sc during each of the control periods Ts1 and Ts2.

FIG. 16 is an explanatory diagram (a table) illustrating decoding performed by the decoder DC. As illustrated in the drawing, when the printing signals SI [m] corresponding to the m stages (m is a natural number which satisfies $1 \leq m \leq M$) indicate, for example, (b1, b2, b3)=(1, 0, 0), the decoders DC of M stages set the selection signal Sa to a high level H and set the selection signals Sb and Sc to a low level L during the control period Ts1. In addition, the decoders set the selection signals Sa and Sc to a low level L and set the selection signal Sb to a high level H during the control period Ts2.

Moreover, when the low-order bit b3 is "1," that is, (b1, b2, b3)=(0, 0, 1), the decoders DC of m stages set the selection signals Sa and Sb to a low level L and set the selection signal Sc to a high level H during the control periods Ts1 and Ts2.

The description returns to FIG. 15.

As illustrated in FIG. 15, the driving signal generation unit 51 includes M number of sets including transmission gates TGa, TGb and TGc. The M number of sets including transmission gates TGa TGb and TGc are provided in a one-to-one correspondence with the M number of ejection units 35.

The transmission gate TGa is turned on when the selection signal Sa is in a high level H, and is turned off when the selection signal Sa is in a low level L. The transmission gate TGb is turned on when the selection signal Sb is in a high level H, and is turned off when the selection signal Sb is in a low level L. The transmission gate TGc is turned on when the selection signal Sc is in a high level H, and is turned off when the selection signal Sc is in a low level L.

For example, in the m-th stage, when the content indicated by the printing signal Si[m] is (b1, b2, b3)=(1, 0, 0), the transmission gate TGa is turned on and the transmission gates TGb and TGc are turned off during the control period Ts1, and the transmission gate TGb is turned on and the transmission gates TGb and TGc are turned off during the control period Ts2.

The driving waveform signal Com-A is supplied to one terminal of the transmission gate TGa, the driving waveform signal Com-B is supplied to one terminal of the transmission gate TGb, and the driving waveform signal Com-C is supplied to one terminal of the transmission gate TGc. Moreover, the other terminals of the transmission gates TGa, TGb and TGc are commonly connected to an output terminal OTN to the switching unit 53.

The transmission gates TGa, TGb and TGc are exclusively turned on, and the driving waveform signal Com-A, Com-B or Com-C selected for the control periods Ts1 and Ts2 are output to the output terminal OTN, as the driving signals Vin[m], and supplied to the ejection unit 35 of the m-th stage through the switching unit 53.

Figure 17:
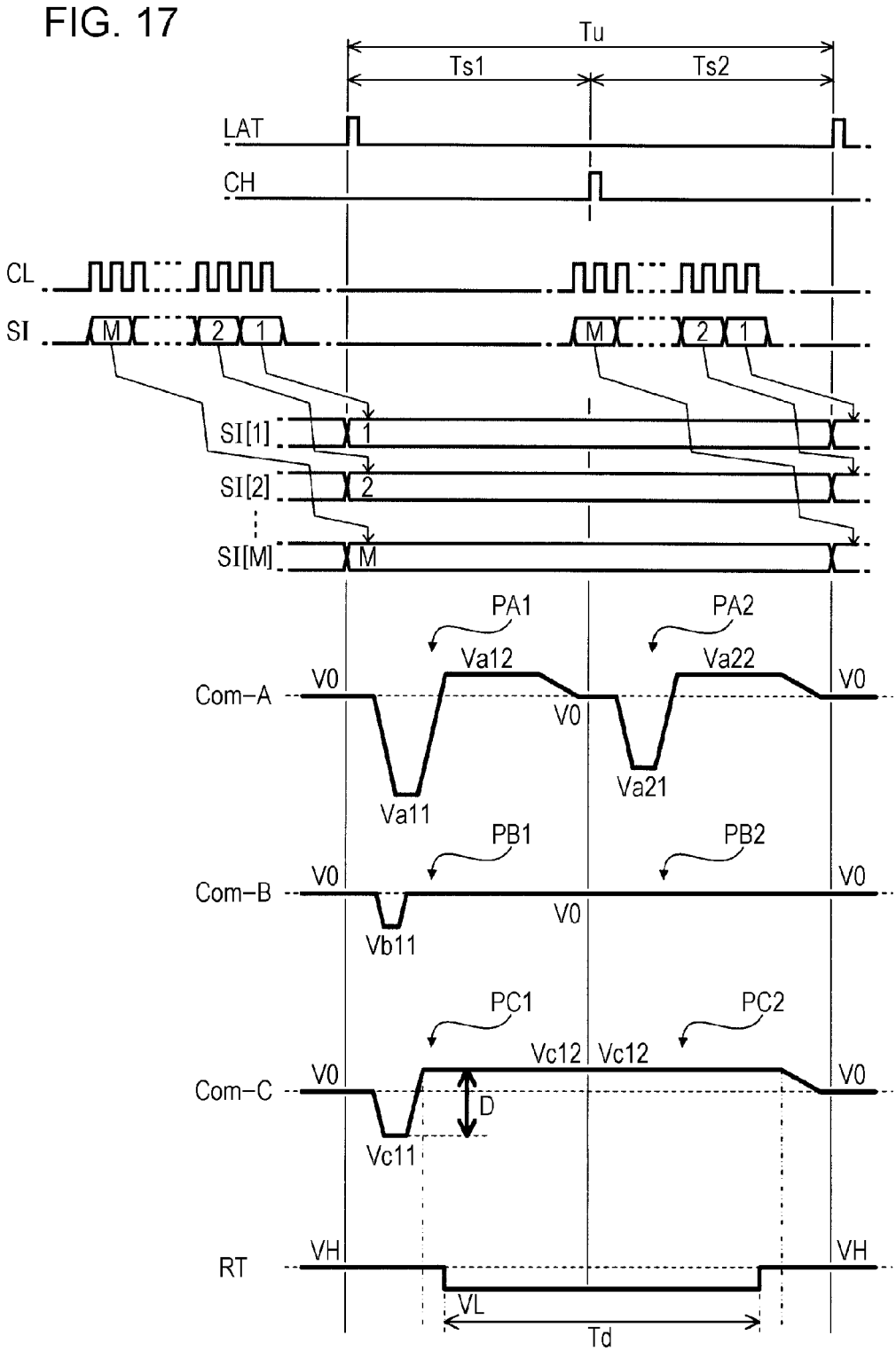
FIG. 17 is a timing chart illustrating an operation of the driving signal generation unit in a unit operation period.

FIG. 17 is a timing chart for describing the operation of the driving signal generation unit 51 during the unit operation period Tu. As illustrated in FIG. 17, the unit operation period Tu is defined by the latch signal LAT output from the control unit 6. Moreover, the control periods Ts1 and Ts2 included in the unit operation period Tu are defined by the latch signal LAT and the change signal CH output from the control unit 6.

The driving waveform signal Com-A supplied from the control unit 6 during the unit operation period Tu is a signal for generating the driving signal Vin for printing, and has a waveform that continuously connects a unit waveform PA1 disposed in the control period Ts1 of the unit operation period Tu and a unit waveform PA2 disposed in the control period Ts2 as illustrated in FIG. 17. Potentials at a timing when the unit waveform PA1 and the unit waveform PA2 start and end are both reference potentials V0. Moreover, as illustrated in the drawing, a potential difference between a potential Va11 and a potential Va12 of the unit waveform PA1 is larger than a potential difference between a potential Va21 and a potential Va22 of the unit waveform PA2. For this reason, the amount of the ink ejected from the nozzles N included in the ejection unit 35 when the piezoelectric elements 200 included in the ejection unit 35 are driven by the unit waveform PA1 is larger than the amount of the ink ejected when the piezoelectric elements are driven by the unit waveform PA2.

The driving waveform signal Com-B supplied from the control unit 6 during the unit operation period Tu is a signal for generating the driving signal Vin for printing, and has a waveform that continuously connects a unit waveform PB1 disposed in the control period Ts1 and a unit waveform PB2 disposed in the control period Ts2.

Potentials at a timing when the unit waveform PB1 starts and ends are both reference potentials V0, and the unit waveform PB2 is maintained at the reference potential V0 over the control period Ts2. Moreover, a potential difference between a potential Vb11 of the unit waveform PB1 and a reference potential V0 is smaller than a potential difference between a potential Va21 and a potential Va22 of the unit waveform PA2. In addition, even when the piezoelectric elements 200 included in the ejection unit 35 are driven by the unit waveform PB1, the ink is not ejected from the nozzles N included in the ejection unit 35. Similarly, even when the unit waveform PB2 is supplied to the piezoelectric elements 200, the ink is not ejected from the nozzles N.

The driving waveform signal Com-C supplied from the control unit 6 during the unit operation period Tu is a signal for generating the driving signal Vin for inspection, and has a waveform that continuously connects a unit waveform PC1 disposed in the control period Ts1 and a unit waveform PC2 disposed in the control period Ts2. A potential at a timing when the unit waveform PC1 starts and a potential at a timing when the unit waveform PC2 ends are both reference potentials V0. The potential of the unit waveform PC1 is changed from the reference potential V0 to a potential Vc11, and is then changed from the potential Vc11 to a potential Vc12. Thereafter, the potential of the unit waveform PC1 is maintained at the potential Vc12 until the control period Ts1 ends.

Moreover, the potential of the unit waveform PC2 is maintained at the potential Vc12, and is then changed from the potential Vc12 to the reference potential V0 before the control period Ts2 ends. A driving voltage D which is a potential difference between the potential Vc11 and the potential Vc12 is set to a voltage so as not to eject the ink from the nozzles N included in the ejection unit 35 by the inspection waveform determining process to be described blow even when the piezoelectric elements 200 included in the ejection unit 35 are driven by the unit waveform PC1 (and the unit waveform PC2).

As illustrated in FIG. 17, the m number of latch circuits Lt output the printing signals SI[1], SI[2], . . . , and SI[M] at a timing when the latch signals LAT rise, that is, at a timing when the unit operation period Tu starts.

Further, the m-th stage decoder DC outputs selection signals Sa, Sb, and Sc based on the contents of the table illustrated in FIG. 16 in respective control periods Ts1 and Ts2 according to the printing signal SI[m] as described above.

Moreover, as described above, the transmission gates TGa, TGb and TGc of the m-th stage select any one of the driving waveform signals Com-A, Com-B and Com-C based on the selection signals Sa, Sb, and Sc, and output the selected driving waveform signal Com as the driving signal Vin[m].

Further, a switching period designation signal RT illustrated in FIG. 17 is a signal that defines a switching period Td. The switching period designation signal RT and the switching period Td will be described below.

A waveform of the driving signal Vin output from the driving signal generation unit 51 during the unit operation period Tu will be described with reference to FIG. 18 in addition to FIGS. 15 to 17.

Since the printing signal SI[m] supplied during the unit operation period Tu indicates (b1, b2, b3)=(1, 1, 0), since the selection signals Sa, Sb and Sc are in a high level H, a low level L, and a low level L during the control period Ts1, the driving waveform signal Com-A is selected by the transmission gate TGa, and the unit waveform PA1 is output as the driving signal Vin[m]. Moreover, similarly to the control period Ts1, during the control period Ts2, the driving waveform signal Com-A is selected by the transmission gate TGa, and the unit waveform PA2 is output as the driving signal Vin[m].

Figure 18:
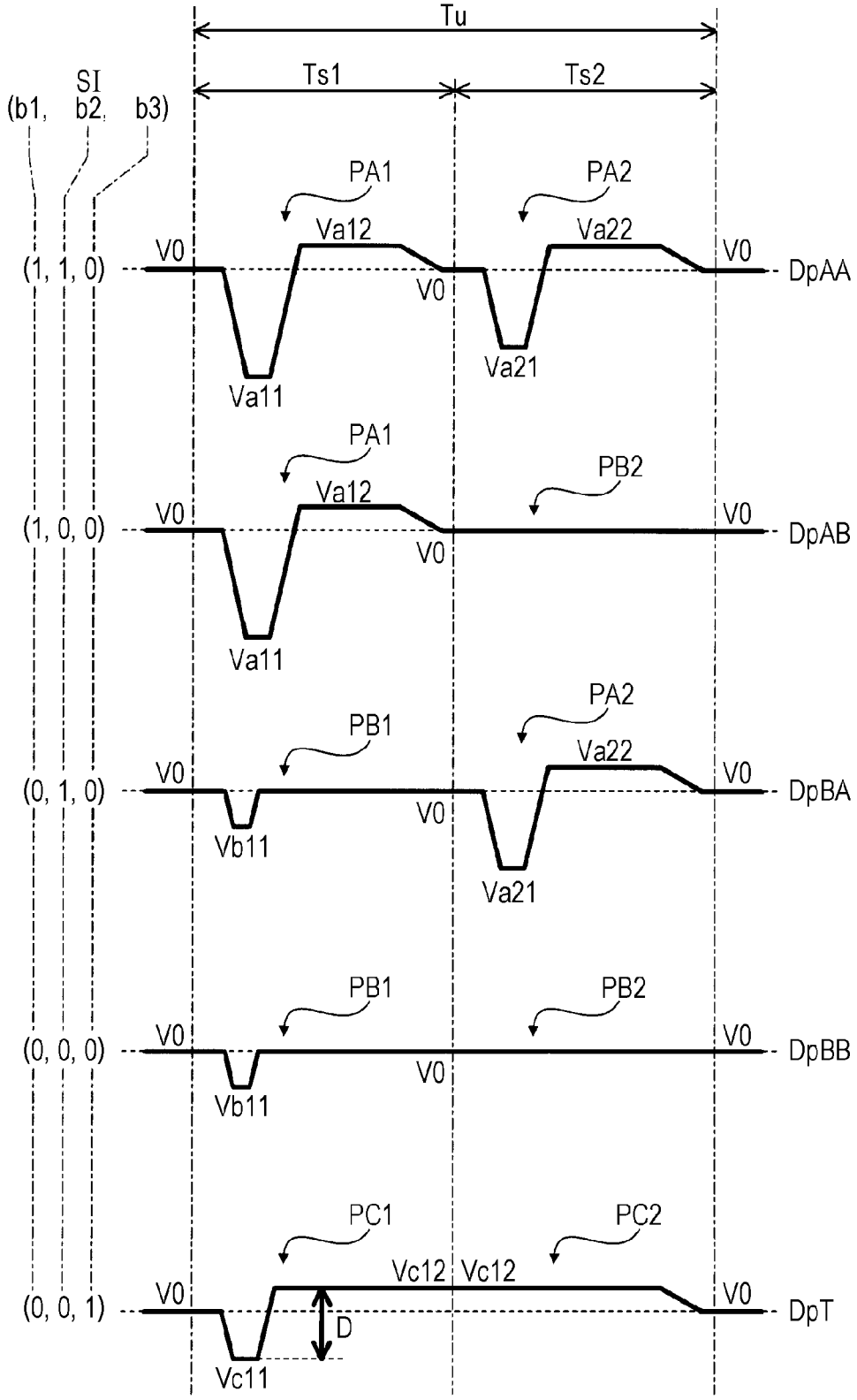
FIG. 18 is a timing chart illustrating a waveform of a driving signal in the unit operation period.

That is, when the printing signal SI[m] indicates (b1, b2, b3)=(1, 1, 0), the driving signal Vin[m] supplied to the ejection unit 35 of the m-th stage during the unit operation period Tu is the driving signal Vin for printing, and as illustrated in FIG. 18, a waveform thereof is a waveform DpAA including the unit waveform PA1 and the unit waveform PA2. As a result, during the unit operation period Tu, the ejection unit 35 of the m-th stage performs ejection of the medium amount of ink based on the unit waveform PA1 and ejection of the small amount of ink based on the unit waveform PA2, and the inks ejected twice are united on label paper P, so that a large dot is formed on the label paper P.

When the printing signal SI[m] supplied during the unit operation period Tu indicates (b1, b2, b3)=(1, 0, 0), since the selection signals Sa, Sb and Sc are in a high level H, a low level L and a low level L during the control period Ts1, the driving waveform signal Com-A is selected by the transmission gate TGa, and the unit waveform PA1 is output as the driving signal Vin[m]. Moreover, since the selection signals Sa, Sb and Sc are in a low level L, a high level H and low level L during the control period Ts2, the driving waveform signal Com-B is selected by the transmission gate TGb, and the unit waveform PB2 is output as the driving signal Vin[m].

That is, when the printing signal SI[m] indicates (b1, b2, b3)=(1, 0, 0), the driving signal Vin[m] supplied to the ejection unit 35 of the m-th stage during the unit operation period Tu is the driving signal Vin for printing, and as illustrated in FIG. 18, a waveform thereof is a waveform DpAB including the unit waveform PA1 and the unit waveform PB2. As a result, the ejection unit 35 of the m-th stage performs ejection of the medium amount of ink based on the unit waveform PA1 during the unit operation period Tu, so that a medium dot is formed on the label paper P.

When the printing signal SI[m] supplied during the unit operation period Tu indicates (b1, b2, b3)=(0, 1, 0), since the selection signals Sa, Sb and Sc are in a low level L, a high level H and a low level L during the control period Ts1, the driving waveform signal Com-B is selected by the transmission gate TGb, and the unit waveform PB1 is output as the driving signal Vin[m]. Moreover, since the selection signals Sa, Sb and Sc are in a high level H, a low level L and a low level L during the control period Ts2, the driving waveform signal Com-A is selected by the transmission gate TGa, and the unit waveform PA2 is output as the driving signal Vin[m].

That is, when the printing signal SI[m] indicates (b1, b2, b3)=(0, 1, 0), the driving signal Vin[m] supplied to the ejection unit 35 of the m-th stage during the unit operation period Tu is the driving signal Vin for printing, and as illustrated in FIG. 18, a waveform thereof is a waveform DpBA including the unit waveform PB1 and the unit form PA2. As a result, the ejection unit 35 of the m-th stage performs ejection of the small amount of ink based on the unit waveform PA2 during the unit operation period Tu, and a small dot is formed on the label paper P.

When the printing signal SI[m] supplied during the unit operation period Tu indicates (b1, b2, b3)=(0, 0, 0), the selection signals Sa, Sb and Sc are in a low level L, a high level H and low level L during the control period Ts1, the driving waveform signal Com-B is selected by the transmission gate TGb, and the unit waveform PB1 is output as the driving signal Vin[m]. Moreover, similarly to the control period Ts1, the driving waveform signal Com-B is selected by the transmission gate TGb during the control period Ts2, and the unit waveform PB2 is output as the driving signal Vin[m].

That is, when the printing signal SI[m] indicates (b1, b2, b3)=(0, 0, 0), the driving signal Vin[m] supplied to the ejection unit 35 of the m-th stage during the unit operation period Tu is the driving signal Vin for printing, and as illustrated in FIG. 18, a waveform thereof is a waveform DpBB including the unit waveform PB1 and the unit waveform PB2. As a result, the ink is not ejected from the ejection unit 35 of the m-th stage during the unit operation period Tu, and the dot is not formed on the label paper P (non-recording).

When the printing signal SI[m] supplied during the unit operation period Tu indicates (b1, b2, b3)=(0, 0, 1), since the selection signals Sa, Sb and Sc are in a low level L, a low level L and a high level H, the driving waveform signal Com-C is selected by the transmission gate TGc during the control period Ts1, and the unit waveform PC1 is output as the driving signal Vin[m]. Moreover, similarly to the control period Ts1, the driving waveform signal Com-C is selected by the transmission gate TGc during the control period Ts2, and the unit waveform PC2 is output as the driving signal Vin[m].

That is, when the printing signal SI[m] indicates (b1, b2, b3)=(0, 0, 1), the driving signal Vin[m] supplied to the ejection unit 35 of the m-th stage during the unit operation period Tu is the driving signal Vin for inspection, and as illustrated in FIG. 18, a waveform thereof is a waveform DpT including the unit waveform PC1 and the unit waveform PC2.

Further, the waveform DpT (magnitude of the driving voltage D) is determined as a waveform such that the ink is not ejected from the ejection unit 35 even though the driving signal Vin having the waveform DpT is supplied to the ejection unit 35 in the inspection waveform determining process.

Figure 19:
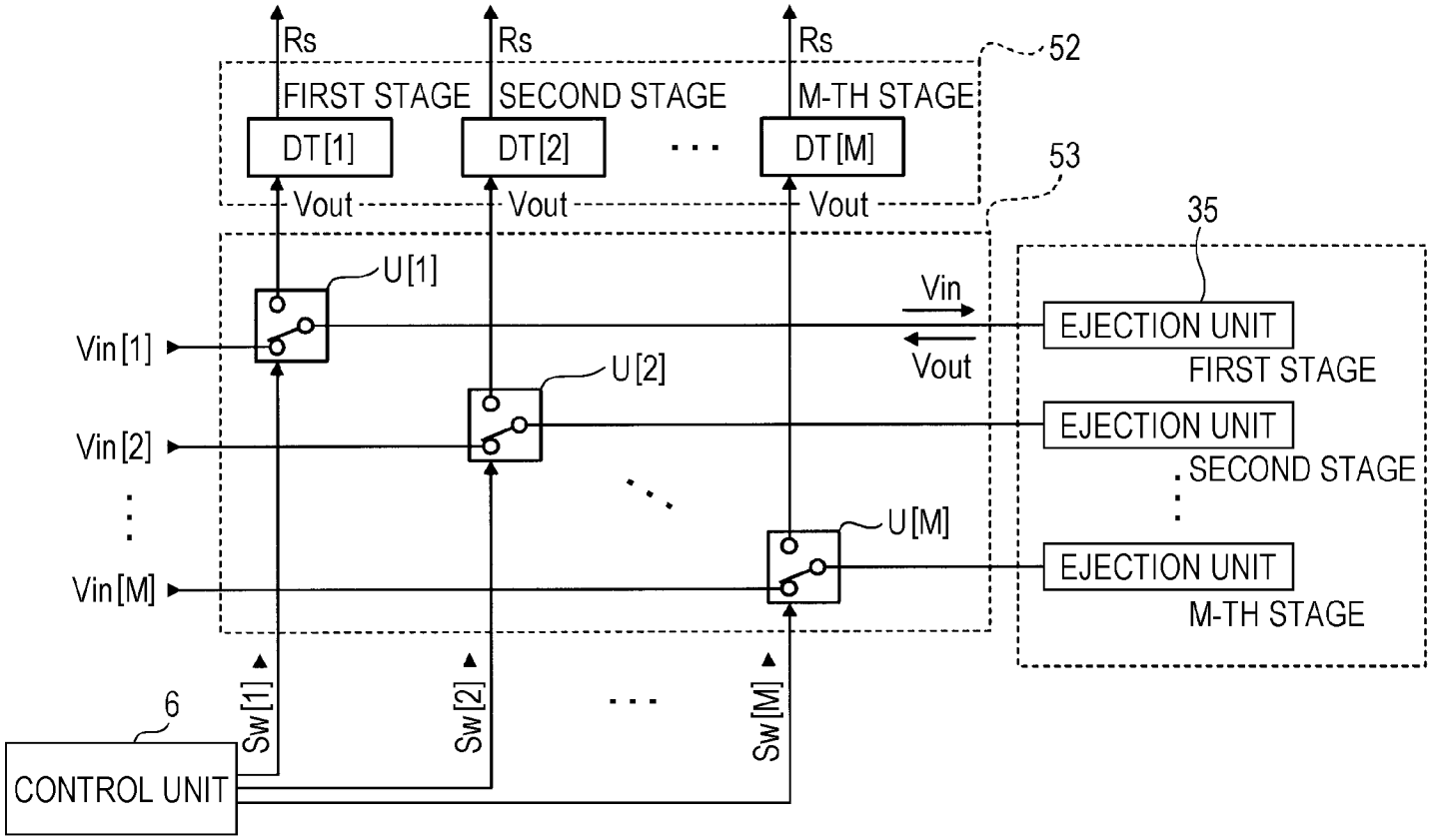
FIG. 19 is a block diagram illustrating the configuration of a switching unit.

FIG. 19 is a block diagram illustrating a configuration of the switching unit 53 of the head driver 50 and electric connection relations between the switching unit 53 and the ejection abnormality detection unit 52, head unit 30 and driving signal generation unit 51.

As illustrated in FIG. 19, the switching unit 53 includes M number of switching circuits U (U[1], U[2], . . . , and U[M]) having first to M-th stages corresponding to the M number of ejection units 35. Moreover, the ejection abnormality detection unit 52 includes M number of ejection abnormality detection circuits DT (DT[q], DT[q], and DT[q]) having first to M-th stages corresponding to the M number of ejection units 35.

The switching circuit U[m] of the m-th stage electrically connects the piezoelectric elements 200 of the ejection unit 35 of the m-th stage to any one of an output terminal OTN of the m-th stage included in the driving signal generation unit 51 and the ejection abnormality detection circuit DT[m] of the m-th stage included in the ejection abnormality detection unit 52.

In the following description, in the switching circuits U, a state where the ejection unit 35 and the output terminal OTN of the driving signal generation unit 51 are electrically connected is referred to as a first connection state. Moreover, a stage where the ejection unit 35 and the ejection abnormality detection circuit DT of the ejection abnormality detection unit 52 are electrically connected is referred to as a second connection state.

The control unit 6 outputs the switching control signals Sw for controlling the connection states of the switching circuits U to the switching circuits U.

Specifically, when the ejection unit 35 of the m-th stage is used to perform the printing process during the unit operation period Tu, the control unit 6 supplies the switching control signal Sw[m] to the switching circuit U[m] so as to allow the switching circuit U[m] corresponding to the ejection unit 35 of the m-th stage to maintain the first connection state over the entire period of the unit operation period Tu.

Meanwhile, when the ejection unit 35 of the m-th stage is a target of the ejection abnormality detecting process during the unit operation period Tu, the control unit 6 supplies the switching control signal Sw[m] to the switching circuit U[m] so as to allow the switching circuit U[m] corresponding to the ejection unit 35 of the m-th stage to enter the first connection state during a period other than the switching period Td of the unit operation period Tu and to enter the second connection state during the switching period Td of the unit operation period Tu. For this reason, the driving signal Vin is supplied to the ejection unit 35 which becomes the target of the ejection abnormality detecting process (or the inspection waveform determining process) from the driving signal generation unit 51 during the period other than the switching period Td of the unit operation period Tu, and the residual vibration signal Vout is supplied to the ejection abnormality detection circuit DT from the ejection unit 35 during the switching period Td of the unit operation period Tu.

Further, as illustrated in FIG. 17, the switching period Td is a period during which the switching period designation signal RT generated by the control unit 6 is set to a potential VL. Specifically, the switching period Td is a period determined such that a period of the unit operation period Tu becomes a partial period or the entire period of a period during which the driving waveform signal Com-C (that is, the waveform DpT) maintains the potential Vc12.

The ejection abnormality detection circuit DT detects a change of electromotive force of the piezoelectric elements 200 of the ejection unit 35 to which the driving signal Vin for inspection is supplied during the switching period Td, as the residual vibration signal Vout.

Figure 20:
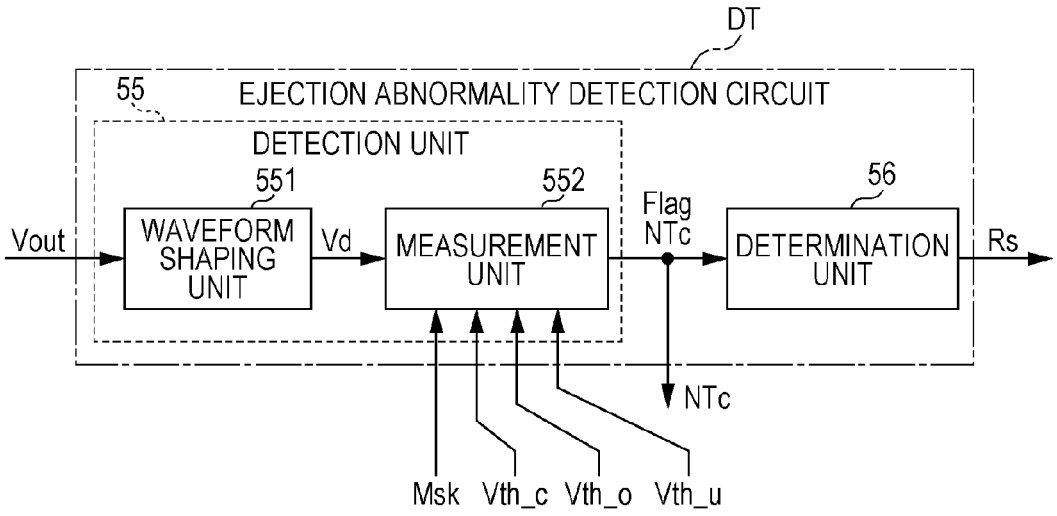
FIG. 20 is a block diagram illustrating the configuration of an ejection abnormality detection circuit.

FIG. 20 is a block diagram illustrating a configuration of the ejection abnormality detection circuit DT included in the ejection abnormality detection unit 52.

As illustrated in FIG. 20, the ejection abnormality detection circuit Dt includes a detection unit 55 that outputs a detection signal NTc representing a time length corresponding to one cycle of the residual vibration of the ejection unit 35 based on the residual vibration signal Vout, and a determination unit 56 that determines whether or not the ejection abnormality of the ejection unit 35 occurs based on the detection signal NTc and the ejection state when the ejection abnormality occurs to output a determination result signal Rs representing the determination result.

Among them, the detection unit 55 includes a waveform shaping unit 551 that generates a shaping waveform signal Vd obtained by removing a noise component from the residual vibration signal Vout output from the ejection unit 35, and a measurement unit 552 that generates the detection signal NTc based on the shaping waveform signal Vd.

The waveform shaping unit 551 includes a high-pass filter for outputting a signal in which a low-band frequency component lower than a frequency band of the residual vibration signal Vout is damped, and a low-pass filter for outputting a signal in which a high-band frequency component is higher than the frequency band of the residual vibration signal Vout, and a configuration capable of limiting a frequency range of the residual vibration signal Vout to outputting the shaping waveform signal Vd from which the noise component is removed.

Moreover, the waveform shaping unit 551 may include a negative feedback type amplifier for adjusting the amplitude of the residual vibration signal Vout and a voltage follower for converting an impedance of the residual vibration signal Vout to output the shaping waveform signal Vd of a low impedance.

The shaping waveform signal Vd obtained by shaping the residual vibration signal Vout in the waveform shaping unit 551, a mask signal Msk generated by the control unit 6, a threshold potential Vth_c determined as a potential of an amplitude center level of the shaping waveform signal Vd, a threshold potential Vth_o determined as a high potential higher than the threshold potential Vth_c, and a threshold potential Vth_u determined as a low potential lower than the threshold potential Vth_c are supplied to the measurement unit 552. The measurement unit 552 outputs the detection signal NTc and an effective flag Flag indicating whether the detection signal NTc is an effective value.

Figure 21:
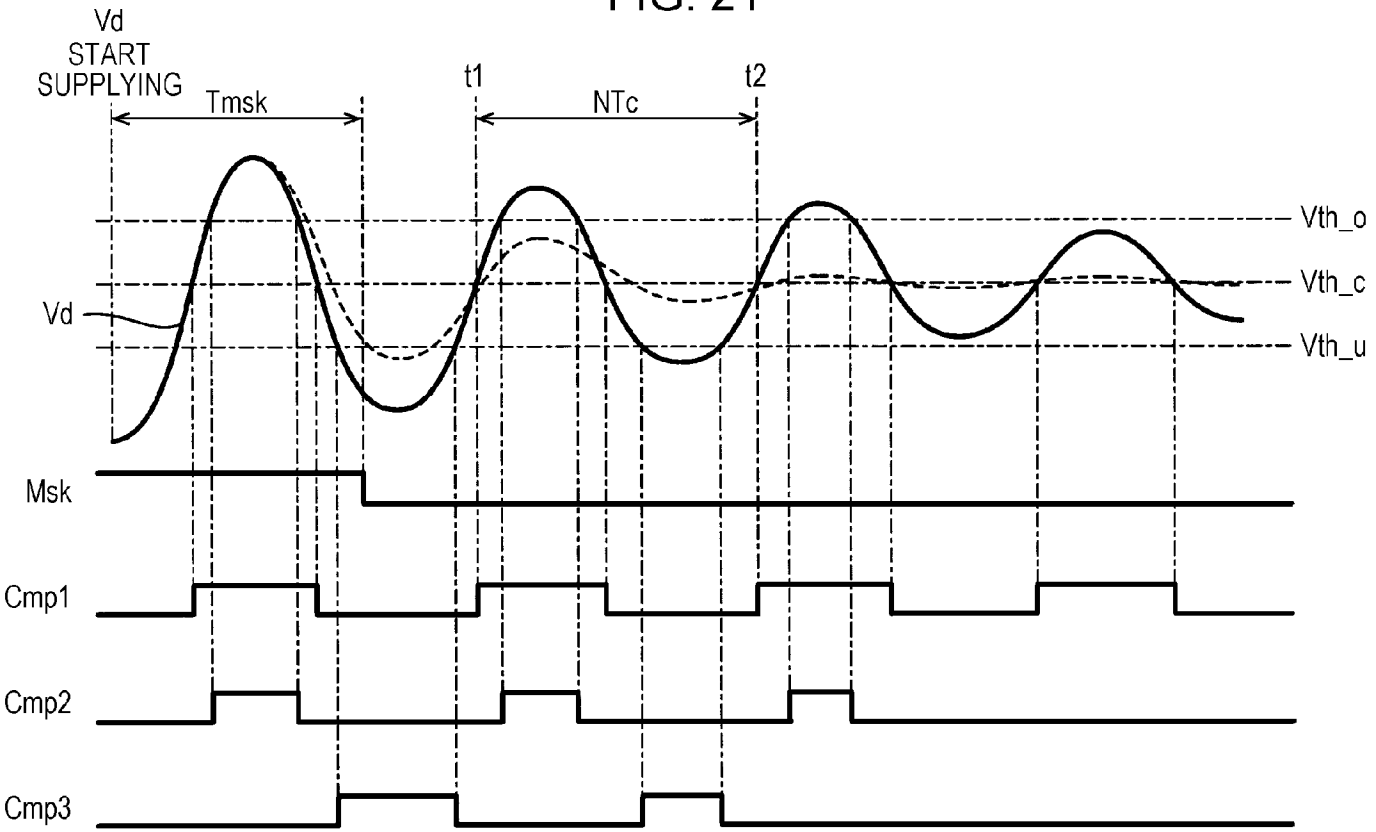
FIG. 21 is a timing chart illustrating an operation of the ejection abnormality detection circuit.

FIG. 21 is a timing chart illustrating an operation of the measurement unit 552.

As illustrated in the drawing, the measurement unit 552 compares a potential indicated by the shaping waveform signal Vd with the threshold potential Vth_c, and generates a comparison signal Cmp1 which is in a high level when the potential indicated by the shaping waveform signal Vd is equal to or more than the threshold potential Vth_c and is in a low level when the potential indicated by the shaping waveform signal Vd is less than the threshold potential Vth-c.

Moreover, the measurement unit 552 compares the potential indicated by the shaping waveform signal Vd with the threshold potential Vth_o, and generates a comparison signal Cmp2 which is in a high level when the potential indicated by the shaping waveform signal Vd is equal to or more than the threshold potential Vth_o and is in a low level when the potential indicated by the shaping waveform signal Vd is less than the threshold potential Vth_o.

Moreover, the measurement unit 552 compares the potential indicated by the shaping waveform signal Vd with the threshold potential Vth_u, and generates a comparison signal Cmp3 which is in a high level when the potential indicated by the shaping waveform signal Vd is less than the threshold potential Vth_u and is in a low level when the potential indicated by the shaping waveform signal Vd is equal to or more than the threshold potential Vth_u.

The mask signal Msk is a signal which is in a high level only during a predetermined period Tmsk after the supply of the shaping waveform signal Vd from the waveform shaping signal 551 is started. In the present embodiment, it is possible to obtain a high-accuracy detection signal NTc from which the superimposed noise components are removed immediately after the residual vibration starts by generating the detection signal NTc with only the shaping waveform signal Vd after the period Tmsk elapses as a target among the shaping waveform signals.

The measurement unit 552 includes a counter (not illustrated). After the mask signal Msk falls to a low level, the counter starts to count the clock signal (not illustrated) at a time t1 which is a timing when the potential indicated by the shaping waveform signal Vd is equal to the threshold potential Vth_c for the first time. That is, after the mask signal Msk falls to the low level, the counter starts to count at a time t1 which is an earlier timing to a timing when the comparison signal Cmp1 rises to a high level for the first time and a timing when the comparison signal Cmp1 falls to a low level for the first time.

In addition, after the counter starts, the counter stops counting the clock signal at a time t2 which is a timing when the potential indicated by the shaping waveform signal Vd becomes the threshold potential Vth_c for the second time, and outputs the obtained count value as the detection signal NTc. That is, after the mask signal Msk falls to the low level, the counter stops counting at a time t2 which is an earlier timing to a timing when the comparison signal Cmp1 rises to a high level for the second time and a timing when the comparison signal Cmp1 falls to a low level for the second time.

As stated above, the measurement unit 552 generates the detection signal NTc by measuring a time length from the time t1 to the time t2 as a time length corresponding to one cycle of the shaping waveform signal Vd.

Incidentally, when the amplitude of the shaping waveform signal Vd is small as indicated by a dashed line in FIG. 21, it is highly likely that it is difficult to accurately measure the detection signal NTc. Moreover, when the amplitude of the shaping waveform signal Vd is small, even though it is determined that the ejection state of the ejection unit 35 is normal based on only the result of the detection signal NTc, it is likely that the ejection abnormality may occur. For example, when the amplitude of the shaping waveform signal Vd is small, it is considered that since the ink is not injected into the cavity 245, it is difficult to eject the ink.

Here, in the present embodiment, it is determined whether the amplitude of the shaping waveform signal Vd has a magnitude sufficient to measure the detection signal NTc to output the determination result as the effective flag Flag.

Specifically, the measurement unit 552 outputs the effective flag Flag by setting a value of the effective flag Flag to a value "1" indicating that the detection signal NTc is effective when the potential indicated by the shaping waveform signal Vd is more than the threshold potential Vth_o and is less than the threshold potential Vth-u and by setting the value of the effective flag to "0" in the other cases during the period during which the counting is performed by the counter, that is, the period from the time t1 to the time t2. More specifically, the measurement unit 552 sets the value of the effective flag Flag to "1" when the comparison signal Cmp2 rises to the high level from the low level and then falls to the low level again and the compassion signal Cmp3 rises to the high level from the low level and then falls to the low level again during the period from the time t1 to the time t2, and sets the value of the effective flag Flag to "0."

In the present embodiment, since the measurement unit 552 determines whether the shaping waveform signal Vd has the amplitude of magnitude sufficient to measure the detection signal NTc in addition to generating the detection signal NTc indicating the time length corresponding to the one cycle of the shaping waveform signal Vd, it is possible to more accurately detect the ejection abnormality.

Further, the detection signal NTc output from the measurement unit 552 is supplied to the determination unit 56 and is also supplied to the control unit 6.

The determination unit 56 determines the ejection state of the ink in the ejection unit 35 based on the detection signal NTc and the effective flag Flag, and outputs the determination result as the determination result signal Rs.

Figures 22, 23:
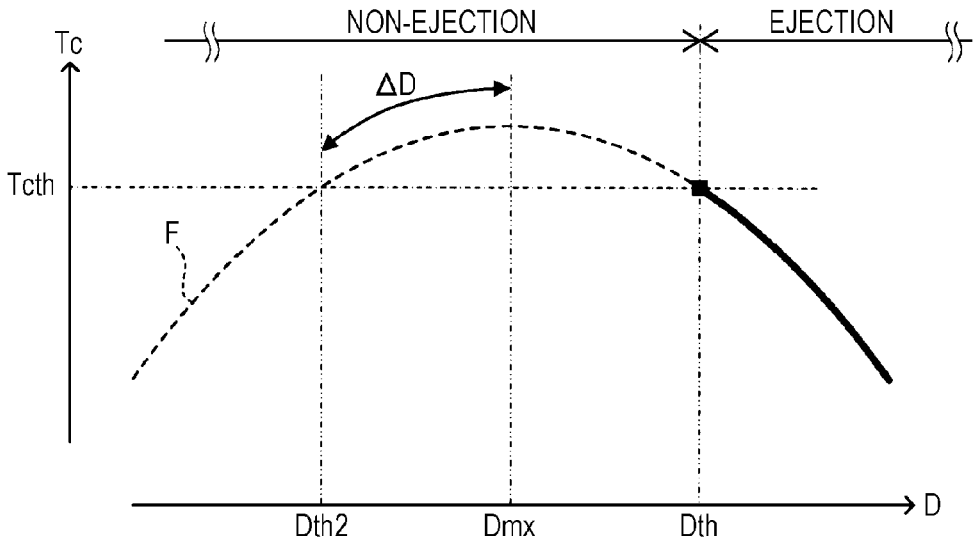
FIG. 22 is an explanatory diagram describing generation of a determination result signal in a determination unit.
FIG. 23 is an explanatory diagram illustrating a relationship between a driving voltage of a driving signal supplied to the ejection unit and a cycle of the residual vibration in the ejection unit.

FIG. 22 is an explanatory diagram for describing the determining of the determination unit 56. As illustrated in the drawing, the determination unit 56 compares a threshold value NTx1, a threshold value NTx2 representing a time length longer than the threshold value NTx1 and a threshold value NTx3 representing a time length longer than the threshold value NTx2.

Here, the threshold NTx1 is a value for indicating a boundary between a time length corresponding to one cycle of the residual vibration when the bubbles are generated within the cavity 245 to increase the frequency of the residual vibration and a time length corresponding to one cycle of the residual vibration when the ejection state is normal.

Moreover, the threshold value NTx 2 is a value for indicating a boundary between a time length corresponding to one cycle of the residual vibration when the paper powder is attached in the vicinity of the nozzles N to decrease the frequency of the residual vibration and a time length corresponding to one cycle of the residual vibration when the ejection state is normal.

Moreover, the threshold value NTx3 is a value indicating a time length corresponding to one cycle of the residual vibration when the frequency of the residual vibration becomes further smaller than that when the paper powder is attached by adhering or thickening of the ink in the vicinity of the nozzles N and a time length corresponding to one cycle of the residual vibration when the paper powder is attached in the vicinity of the outlets of the nozzles N.

As illustrated in FIG. 22, when the value of the effective flag Flag is "1" and satisfies "NTx1 NTc NTx2," the determination unit 56 determines that the ejection state of the ink in the ejection unit 35 is normal, and sets the determination result signal Rs to a value "1" indicating that the ejection state is normal.

Moreover, when the value of the effective flag Flag is "1" and satisfies "NTc<NTx1," the determination unit 56 determines that the ejection abnormality occurs due to the bubbles generated in the cavity 245, and sets the determination result signal Rs to a value "2" indicating that the ejection abnormality occurs due to the bubbles.

Moreover, when the value of the effective flag Flag is "1" and satisfies "NTx2<NTc≤NTx3," the determination unit 56 determines that the ejection abnormality occurs due to the paper powder attached in the vicinity of the outlets of the nozzles N, and sets the determination result signal Rs to a value "3" indicating that the ejection abnormality occurs due to the paper powder.

Moreover, when the value of the effective flag is "1" and satisfies "NTx3<NTc," the determination unit 56 determines that the ejection abnormality occurs due to the thickening of the ink in the vicinity of the nozzles N, and sets the determination result signal Rs to a value indicating that the ejection abnormality occurs due to the thickening of the ink.

Moreover, when the value of the effective flag Flag is "0," the determination unit 56 sets the determination result signal to a value "5" indicating that the ejection abnormality occurs due to some causes such as non-injection of the ink.

As described above, the determination unit 56 determines whether the ejection abnormality occurs in the ejection unit 35, and outputs the determination result as the determination result signal Rs. For this reason, when the ejection abnormality occurs, the control unit 6 stops the printing process when necessary and moves the head unit 30 to a position where the recovery process can be performed by the recover mechanism 84, so that it is possible to perform an appropriate recovery process depending on the ejection abnormality indicated by the determination result signal Rs.

Further, the determination of the determination unit 56 may be performed in the control unit 6 (the CPU 61). In this case, the ejection abnormality detection circuit DT of the ejection abnormality detection unit 52 may be configured without including the determination unit 56, and may output the detection signal NTc generated by the detection unit 55 to the control unit 6.

5. Inspection Waveform Decision Process

Next, a relationship between the driving voltage D of the driving signal Vin for inspection and the operation of the ejection unit 35 will be described and then details of the inspection waveform decision process will be described.

FIG. 23 is an explanatory diagram for describing a relationship between the size of the driving voltage D of the driving signal Vin supplied to the ejection unit 35 and the time length of the cycle Tc of the residual vibration generated in the ejection unit 35 when the driving signal Vin is supplied.

The horizontal axis of the graph illustrated in the figure represents the size of the driving voltage D in the driving signal Vin for inspection and the vertical axis of the graph represents the time length of the cycle Tc of the residual vibration generated in the ejection unit 35 to which the driving signal Vin for inspection is supplied. In addition, a curve F illustrated in the graph is a curve representing the change of the cycle Tc of the residual vibration generated in the ejection unit 35 in a case where the size of the driving voltage D of the driving signal Vin supplied to the ejection unit 35 is changed.

As illustrated in FIG. 23, in a case where the driving voltage D of the driving signal Vin supplied to the ejection unit 35 is gradually increased from a small voltage such as "0" or the like, a theoretical voltage when the ink is ejected from the ejection unit 35 for the first time is referred to as a threshold voltage Dth. That is, the ink is ejected from the ejection unit 35 in a case where the driving voltage D of the driving signal Vin supplied to the ejection unit 35 is more than or equal to the threshold voltage Dth. In FIG. 23, a portion in which the driving voltage D is more than or equal to the threshold voltage D in the curve F (that is, a portion in which the ink is ejected) is indicated by a solid line and a portion in which the driving voltage D is less than the threshold voltage Dth (that is, a portion in which the ink is not ejected) is indicated by a dashed line (the same applied to the figures below).

In addition, as illustrated in FIG. 23, the theoretical voltage in which the cycle Tc of the residual vibration generated in the ejection unit 35 becomes maximum in the driving voltage D of the driving signal Vin supplied to the ejection unit 35 is referred to as a voltage Dmx. In general, a relationship of "Dmx<Dth" is satisfied between the threshold voltage Dth and a maximum cycle voltage Dmx. Accordingly, when the driving voltage D of the driving signal Vin is less than or equal to the maximum cycle voltage Dmx, the ink is not ejected from the ejection unit 35 in principle.

In addition, as illustrated in FIG. 23, when the ejection unit 35 is driven by the driving signal Vin which sets the driving voltage D as the threshold voltage Dth, the cycle Tc of the residual vibration generated in the ejection unit 35 is referred to as a threshold cycle Tcth.

In addition, as illustrated in FIG. 23, in the driving voltage D, the cycle Tc of the residual vibration generated in the ejection unit 35 becomes the threshold cycle Tcth and the theoretical voltage in which the ink is not ejected from the ejection unit 35 is referred to as a threshold corresponding voltage Dth2. As is obvious from the figure, a relationship of "Dth2<Dms" is satisfied between the threshold corresponding voltage Dth2 and the maximum cycle voltage Dmx.

In a case where the ejection state of the liquid in the ejection unit 35 is determined based on the residual vibration generated in the ejection unit 35, it is preferable to make the amplitude of the residual vibration generated in the ejection unit 35 maximum for accurately perform the determination of the ejection state. In addition, for making the amplitude of the residual vibration generated in the ejection unit 35 maximum, it is necessary to make the size of the driving voltage D of the driving signal Vin supplied to the ejection unit 35 maximum.

On the other hand, for performing the ejection abnormality detecting process without allowing the ink to be ejected from the ejection unit 35, it is desired that the driving voltage D of the driving signal Vin is less than the threshold voltage Dth and, preferably, the driving voltage D of the driving signal Vin is less than or equal to the maximum cycle voltage Dmx.

Here, in the present embodiment, the driving voltage D of the driving signal Vin for inspection is decided as a value satisfying both of the conditions (1) and (2) below.

(1) The driving voltage D of the driving signal Vin for inspection is less than or equal to the maximum cycle voltage Dmx.

(2) The cycle Tc of the residual vibration generated in the ejection unit 35 driven by the driving signal Vin for inspection is longer than the cycle Tc in all cases where the ink is ejected from the ejection unit 35.

That is, in the inspection waveform decision process in the present embodiment, the driving voltage D of the driving signal Vin for inspection is decided to be larger than the threshold corresponding voltage Dth2 and contained in a set range ΔD less than or equal to the maximum cycle voltage Dmx. In this manner, it is possible to prevent ejection of the ink from the ejection unit 35 in the ejection abnormality detecting process and to accurately determine the ejection state by setting the size of the amplitude of the residual vibration in the ejection unit 35 to be sufficient.

Further, the shape or the like of the above-described threshold voltage Dth, the maximum cycle voltage Dmx, the threshold corresponding voltage Dth2, and the curve F are changed due to the temperature of the ejection unit 35, the viscosity or the ink in the ejection unit 35, or the like. In addition, the threshold voltage Dth and the like tend to have values different from one another for each of the M ejection units 35. Here, in the present embodiment, the inspection waveform decision process is performed for each of the ejection units 35 to decide the driving voltage D of the driving signal Vin for inspection for each of the ejection units 35 by a method illustrated in FIGS. 24 to 29.

Hereinafter, specific contents of the inspection waveform decision process will be described with reference to FIGS. 24 to 29.

The inspection waveform decision process is performed during the initialization operation of the ink jet printer 1, which is performed at the time of installing the ink jet printer 1 or starting the ink jet printer 1 for the first time, and is also performed during the start operation of the ink jet printer 1, which is performed at the time of starting the ink jet printer 2 for the second or subsequent time or as warming-up before the start operation of the ink jet printer 1.

Here, the initialization operation is an operation performed for enabling the ink jet printer 1 to perform the printing process in a case where the ink jet printer 1 is installed or the like, and is an operation including filling the ink in the cavity 245 or the process of reading/writing the initialized value.

Further, the start operation is an operation for performing the printing process appropriately after the initialization operation is performed and the ink jet printer 1 is turned on, or before the ink jet printer 1 performs the printing process, and is an operation including cleaning the ejection unit 35 (recovery process) or warming the ink.

Further, hereinafter, in the inspection waveform decision process, a process performed during the initialization process is referred to as a waveform setting process (an example of the "first process") and a process performed during the start operation is referred to as a waveform correction process (an example of the "second process").

5.1. Waveform Setting Process

Hereinafter, specific contents of the waveform setting process in the inspection waveform decision process will be described with reference to FIGS. 24 and 25.

Figure 24:
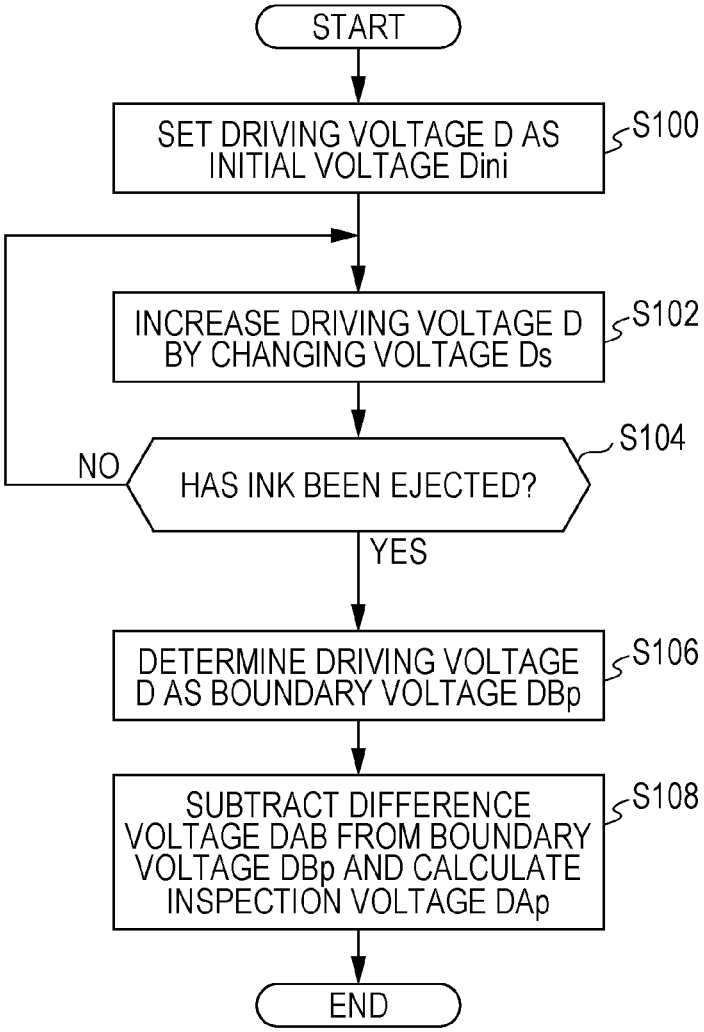
FIG. 24 is a flowchart illustrating an operation of the ink jet printer in a waveform setting process.

FIG. 24 is a flowchart illustrating an example of the operation of the ink jet printer 1 in the waveform setting process of the inspection waveform decision process.

Further, in the inspection waveform decision process (the waveform setting process and the waveform correction process), the control unit 6 supplies the printing signal SI which is (b1, b2, b3)=(0, 0, 1) to the driving signal generation unit 51 and decides the waveform of the driving signal Vin for inspection while changing the value of the driving voltage D included in the driving waveform signal Com. That is, in the inspection waveform decision process, decides the driving voltage D such that the value thereof becomes appropriate for performing the ejection abnormality process in the ejection unit 35 by supplying the driving signal Vin having the waveform DpT to each of the ejection units 35 while changing the driving voltage D.

As illustrated in FIG. 24, in the waveform setting process, firstly, the CPU 61 sets the driving voltage D of the driving signal Vin as an initial voltage Dini, and then allows the ejection unit 35 to be driven by the driving signal Vin (Step S100). Here, the initial voltage Dini is a predetermined voltage based on measurement data in the related art so as to be smaller than the threshold corresponding voltage Dth2. That is, in Step S100, in a case where the driving voltage D drives the ejection unit 35 by the driving signal Vin set as the initial voltage Dini, the ink is not ejected from the ejection unit 35. The value of the initial voltage Dini is stored in the storage unit 62 and the CPU 61 generates the initial voltage Dini by referencing the storage unit 62 in Step S100. In addition, the process in Step S100 is an example of a "first setting process."

Next, the CPU 61 sets the driving voltage D of the driving signal Vin as a voltage increased by a predetermined change voltage Ds and allows the ejection unit 35 to be driven by the driving signal Vin (Step S102). The process in Step S102 is an example of a "first change process."

In addition, the CPU 61 determines whether the ink is ejected from the ejection unit 35 based on the detection result output from an ejection detection unit 85 when the ejection unit 35 is driven in Step S102 (Step S104).

In a case where the determination result in Step S104 is negative, the CPU 61 proceeds the process to Step S102. That is, the CPU 61 sets the driving voltage D as the initial voltage Dini and increases the driving voltage D by the change voltage Ds from the initial voltage Dini until the ink is ejected from the ejection unit 35.

In contrast, in a case where the determination result in Step S104 is positive, that is, in a case where the ink is ejected from the ejection unit 35, the CPU 61 decides the driving voltage D of the driving signal Vin supplied to the ejection unit 35 as a boundary voltage DBp and allows the value to be stored in the storage unit 62 (Step S106). In addition, the process in Step S106 is an example of a "boundary decision process."

Subsequently, the CPU 61 calculates an inspection voltage DAp by subtracting the difference voltage DAB from the boundary voltage DBp, decides the calculated inspection voltage DAp as the driving voltage D of the driving signal Vin for inspection, and allows the value to be stored in the storage unit 62 (Step S108).

Here, the difference voltage DAB is a predetermined voltage based on the measurement data in the related art so as to be larger than a difference between the threshold voltage Dth and the maximum cycle voltage Dmx.

Further, the process in Step S108 is an example off a "first decision process."

Figure 25:
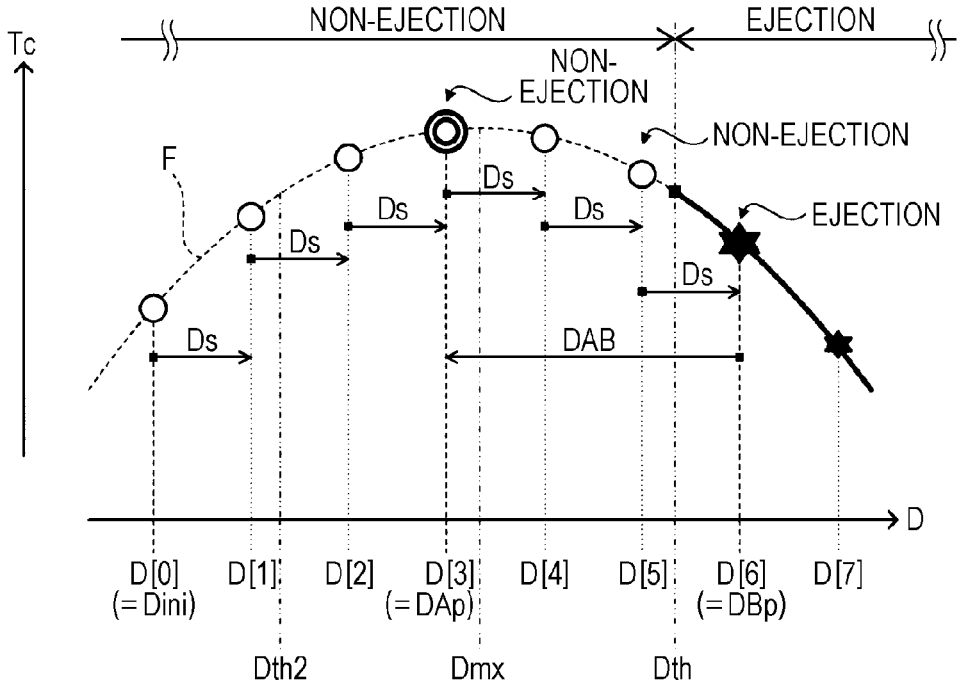
FIG. 25 is an explanatory diagram illustrating a relationship between the driving voltage of the driving signal supplied to the ejection unit and the cycle of the residual vibration in the ejection unit in the waveform setting process.

FIG. 25 is an explanatory diagram illustrating an example of a relationship among the driving voltage D set in each step (in the example, the driving voltage D set in each step is represented by D[0], D[1], D[2], . . . , D[6], and the like), the boundary voltage DBp and the inspection voltage DAp decided in the waveform setting process, and the cycle Tc of the residual vibration generated in the ejection unit 35 when the waveform setting process illustrated in FIG. 24 is performed.

In the figure, white outlined figures such as "○" or "⊙" represent the state in which the ink is not ejected from the ejection unit 35 and filled figures such as "●", "■", "★" represent the state in which the ink is ejected (the same applies the figures below).

As illustrated in the figure, the CPU 61 increases the driving voltage D of the driving signal Vin supplied to the ejection unit 35 by the change voltage Ds so as to be D[1], D[2], . . . , D[6] from the initial value D[0] set as the initial voltage Dini in Steps S100, S102, and S104. Further, in the example illustrated in the figure in Step S106, the CPU 61 decides D[6] which is the driving voltage D of the driving signal Vin supplied to the ejection unit 35 when the ink is ejected from the ejection unit 35 for the first time as the boundary voltage DBp. Subsequently, the CPU 61 sets the voltage in which the difference voltage DAB is subtracted from D[6] decided as the boundary voltage DBp as the inspection voltage DAp in Step S108. In the figure, a case in which D[3] becomes the inspection voltage DAp is exemplified.

In this manner, in the waveform setting process, the driving voltage D is decided as the boundary voltage DBp when the ink is ejected from the ejection unit 35 for the first time and the inspection voltage DAp in which the difference voltage DAB is subtracted from the boundary voltage DBp as the driving voltage D of the driving signal Vin for inspection in a case where the driving voltage D of the driving signal Vin having the waveform DpT supplied to the ejection unit 35 is increased by the change voltage Ds. Accordingly, it is possible to prevent ejection of the ink from the ejection unit 35 in a case where the ejection unit 35 is driven by the driving signal Vin for inspection.

Moreover, in the waveform setting process, since the inspection voltage DAp is decided such that the cycle Tc of the residual vibration which is generated in the ejection unit 35 driven by the driving signal Vin deciding the inspection voltage DAp as the driving voltage D to be longer than any cycle Tc of the residual vibration generated in the ejection unit 35 in a case where the ink is ejected, it is possible to make the driving voltage of the driving signal Vin for inspection larger than the threshold corresponding voltage Dth2 and to accurately determine the ejection state of the ejection unit 35.

In addition, the waveform setting process according to the invention is not limited to the process illustrated in FIGS. 24 and 25. Therefore, hereinafter, the waveform setting process illustrated in FIGS. 24 and 25 is referred to as a "first waveform setting process" in some cases.

Moreover, the waveform setting process according to the present embodiment decides such that the driving voltage D of the driving signal Vin for inspection is larger than the threshold corresponding voltage Dth2 and is included in the set range ΔD less than or equal to the maximum cycle voltage Dmx, but the waveform setting process according to the invention is not limited thereto.

For example, the driving voltage D of the driving signal Vin for inspection may be decided such that the driving voltage D is larger than the threshold corresponding voltage Dth2 and is smaller than the threshold voltage Dth. In this case, the inspection voltage DAp may be decided by deciding the difference voltage DAB as a voltage more than or equal to the change voltage Ds and subtracting the difference voltage DAB having a size more than or equal to the change voltage Ds.

In the example illustrated in FIG. 25, the boundary voltage DBp is D[6] and the voltage in which the change voltage Ds is subtracted from the boundary voltage DBp is D[5]. In a case where the ejection unit 35 is driven by the driving signal Vin setting the driving voltage D as D[5], the ink is not ejected from the ejection unit 35. That is, it is possible to decide the driving voltage D of the driving signal Vin for inspection such that the ink is not ejected from the ejection unit 35 by making the difference voltage DAB more than or equal to the change voltage Ds.

On the other hand, as described above, the shape of the threshold voltage Dth or the curve F is changed due to the temperature of the ejection unit 35, the temperature and the viscosity of the ink in the inside of the ejection unit 35.

Figure 26:
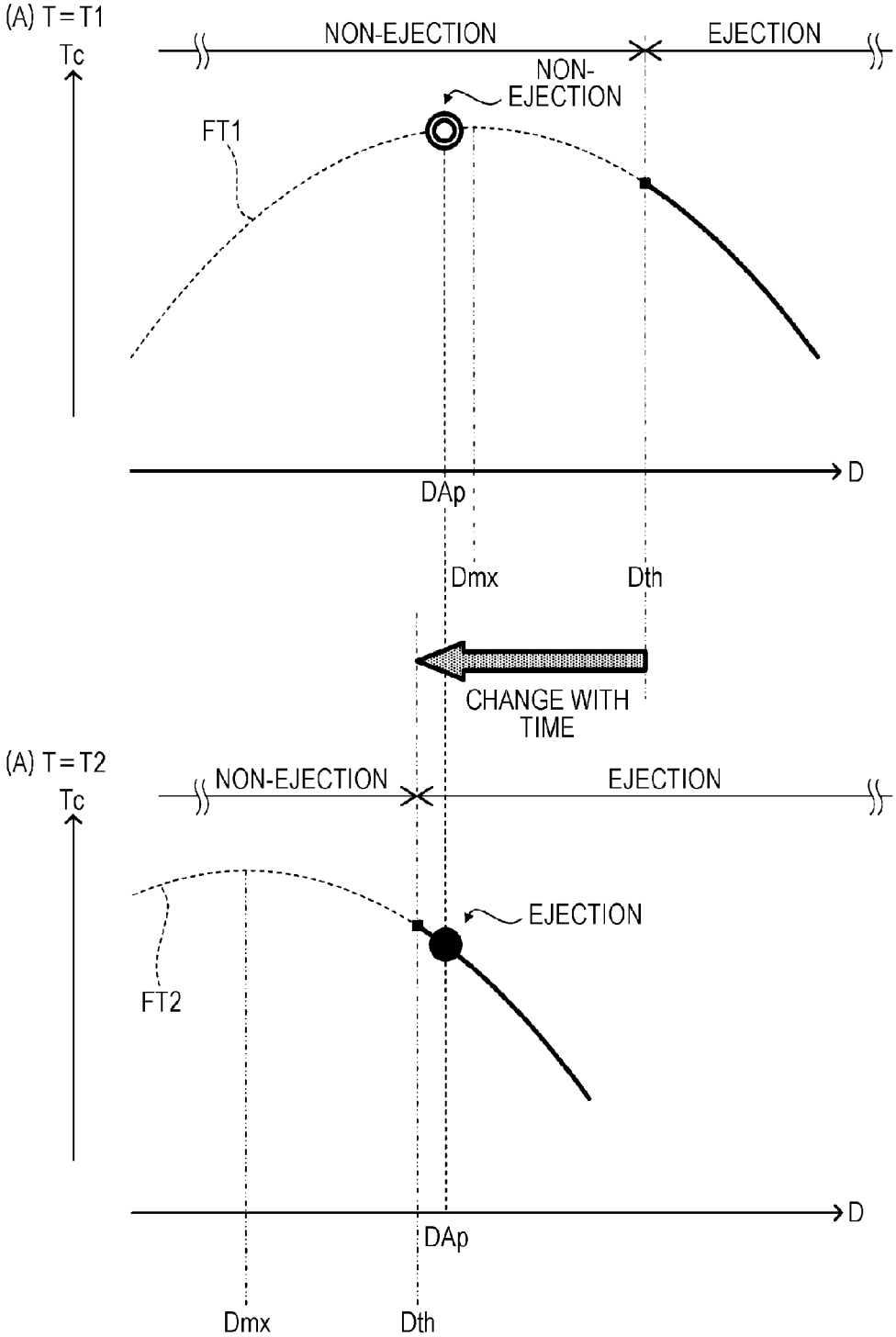
FIG. 26 is an explanatory diagram illustrating the change of a relationship between the driving voltage of the driving signal supplied to the ejection unit and the cycle of the residual vibration in the ejection unit with time.

For example, as illustrated in FIG. 26, at a specific time T=T1, even in a case where a relationship between the driving voltage D and the cycle Tc is indicated by a curve FT1, the relationship between the driving voltage D and the cycle Tc is changed to the relationship indicated by a curve FT2 different from the curve FT1 in some cases as illustrated in FIG. 26 at a time T=T2 different from the time T=T1.

In this case, there is a possibility that the threshold voltage Dth at the time T=T1 becomes a voltage different from the threshold voltage Dth at the time T=T2. Consequently, even in a case where a relationship of "DAp<Dth" is established between the inspection voltage DAp and the threshold voltage Dth at time T=T1, there is a possibility that the relationship is changed to a relationship of "DAp≥Dth" at the time T=T2.

That is, even in a case where the driving voltage D is set as the inspection voltage DAp such that the ink is not ejected from the ejection unit 35 driven by the driving signal Vin for inspection at the time T=T1, the ink is ejected from the ejection unit 35 when the ejection unit 35 is driven due to the driving signal Vin for inspection at the time T=T2 in some cases.

Here, in the present embodiment, the waveform setting process is performed during the initialization operation as the inspection waveform decision process, and the waveform correction process is performed during the start operation which is performed after the initialization operation. In this manner, even when the curve F is changed from the curve FT1 to the curve FT2 in a period from the time (time T=T1) at which the initialization operation is performed to the time (time T=T2) at which the start operation is performed, it is possible to decide a waveform of the driving signal Vin for inspection appropriate for the state of the ink jet printer 1 at the time T=T2. As a result, even in a case where the temperature in the inside of the ejection unit 35 or the viscosity of the ink is changed, it is possible to perform the ejection abnormality detecting process without allowing the ink to be ejected from the ejection unit 35.

5.2. Waveform Correction Process

Hereinafter, specific contents of the waveform correction process of the inspection waveform decision process will be described with reference to FIGS. 27 to 29.

Figure 27:
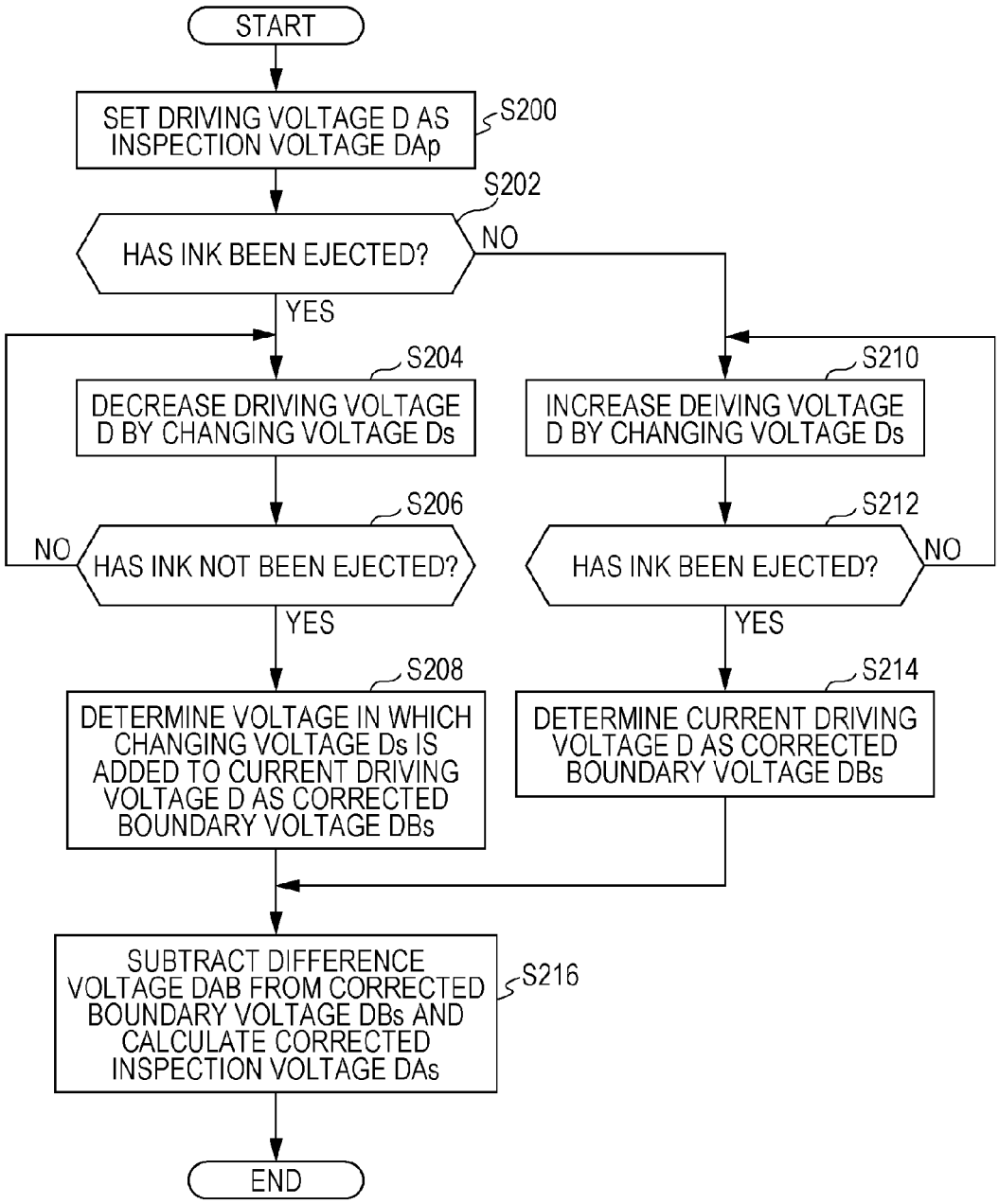
FIG. 27 is a flowchart illustrating the operation of the ink jet printer in a waveform correction process.

FIG. 27 is a flowchart illustrating an example of the operation of the ink jet printer 1 in the waveform correction process.

As illustrated in FIG. 27, the CPU 61 sets the driving voltage D of the driving signal Vin as the inspection voltage DAp decided in Step S108 and allows the ejection unit 35 to be driven by the driving signal Vin (Step S200). In addition, the process In Step S200 is an example of a "third setting process."

Next, the CPU 61 determines whether the ink is ejected from the ejection unit 35 based on the detection result output from the ejection detection unit 85 when the ejection unit 35 is driven in Step S200 (Step S202). Further, the process in Step S202 is an example of an "ejection determining process."

In a case where the determination result in Step S202 is positive (that is, in a case where the ink is ejected), the CPU 61 sets the driving voltage D of the driving signal Vin as a voltage decreased by the change voltage Ds with a predetermined size, and allows the ejection unit 35 to be driven by the driving signal Vin (Step S204).

Further, the CPU 61 determines whether the ejection state of the ink in the ejection unit 35 is non-ejection based on the detection result output from the ejection detection unit 85 when the ejection unit 35 is driven in Step S204 (Step S206).

In a case where the determination result in Step S206 is negative, the CPU 61 proceeds the process to Step S204. That is, the CPU 61 decreases the driving voltage D by the change voltage Ds from the inspection voltage DAp until the ejection state of the ink in the ejection unit 35 enters non-ejection.

In contrast, in a case where the determination result in Step S206 is positive, that is, the ejection state of the ink in the ejection unit 35 enters non-ejection for the first time, the CPU 61 decides the voltage (that is, the driving voltage D of the driving signal Vin supplied when the ink is ejected from the ejection unit 35 for the last time) in which the change voltage Ds is added to the driving voltage D of the driving signal Vin supplied to the ejection unit 35 for the last time in Step S204 as a correction boundary voltage DBs, and allows the value to be stored in the storage unit 62 (Step S208).

In a case where the determination result in Step S202 is negative (that is, in a case of non-ejection), the CPU 61 sets the driving voltage D of the driving signal Vin as a voltage increased by the change voltage Ds, and allows the ejection unit 35 to be driven by the driving signal Vin (Step S210).

Further, the CPU 61 determines whether the ink is ejected from the ejection unit 35 based on the detection result output from the ejection detection unit 85 when the ejection unit 35 is driven in Step S210 (Step S212).

In a case where the determination result in Step S212 is negative, the CPU 61 proceeds the process to Step S210. That is, the CPU 61 increases the driving voltage D by the change voltage Ds from the inspection voltage DAp until the ink is ejected from the ejection unit 35.

In contrast, in a case where the determination result in Step S212 is positive, that is, in a case where the ink is ejected from the ejection unit 35 for the first time, the CPU 61 decides the driving voltage D of the driving signal Vin supplied to the ejection unit 35 for the last time in Step S210 as a correction boundary voltage DBs, and allows the value to be stored in the storage unit 62 (Step S214).

Subsequently, the CPU 61 calculates the correction inspection voltage Das by subtracting the difference voltage DAB from the correction boundary voltage DBs, decides the calculated correction inspection voltage Das as the driving voltage D of the driving signal Vin for inspection, and allows the value to be stored in the storage unit 62 (Step S216).

Here, the difference voltage DAB is a predetermined voltage so as to be larger than a difference between the threshold voltage Dth and the maximum cycle voltage Dmx similarly to the waveform setting process and the value of the difference voltage DAB is stored in the storage unit 62.

Moreover, the processes in Steps S204 and S210 are examples of a "third change process." Further, the processes in Steps S208 and S214 are examples of a "correction boundary decision process." Furthermore, the process in Step S216 is an example of a "third decision process."

As described above, the CPU 61 functions as a "decision unit" (see FIG. 2) by performing at least one of processes in Step S100 to S108 illustrated in FIG. 24 and Steps S200 to S216 illustrated in FIG. 27.

Figure 28:
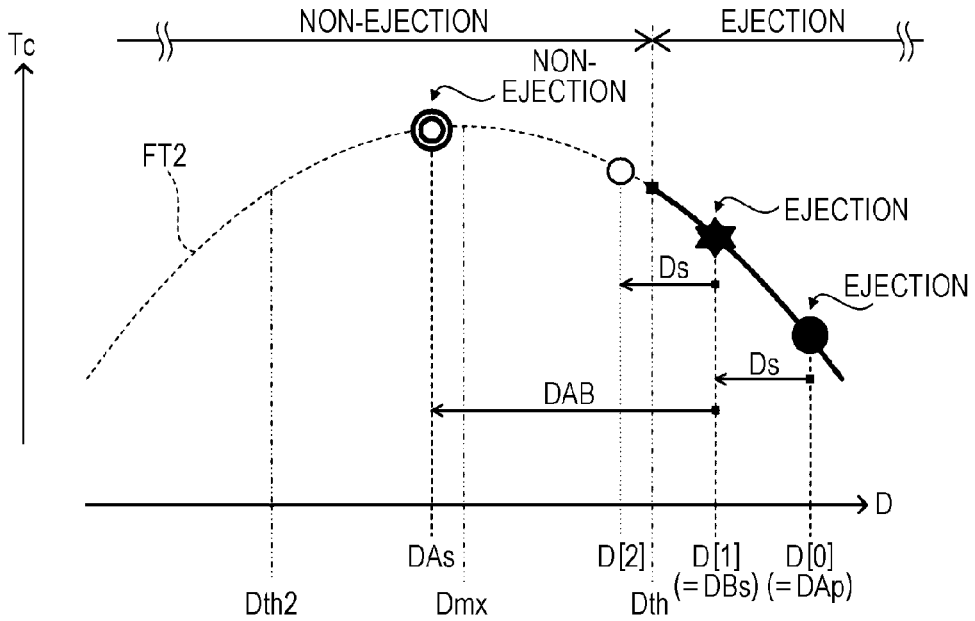
FIG. 28 is an explanatory diagram illustrating a relationship between the driving voltage of the driving signal supplied to the ejection unit and the cycle of the residual vibration in the ejection unit in the waveform correction process.
Figure 29:
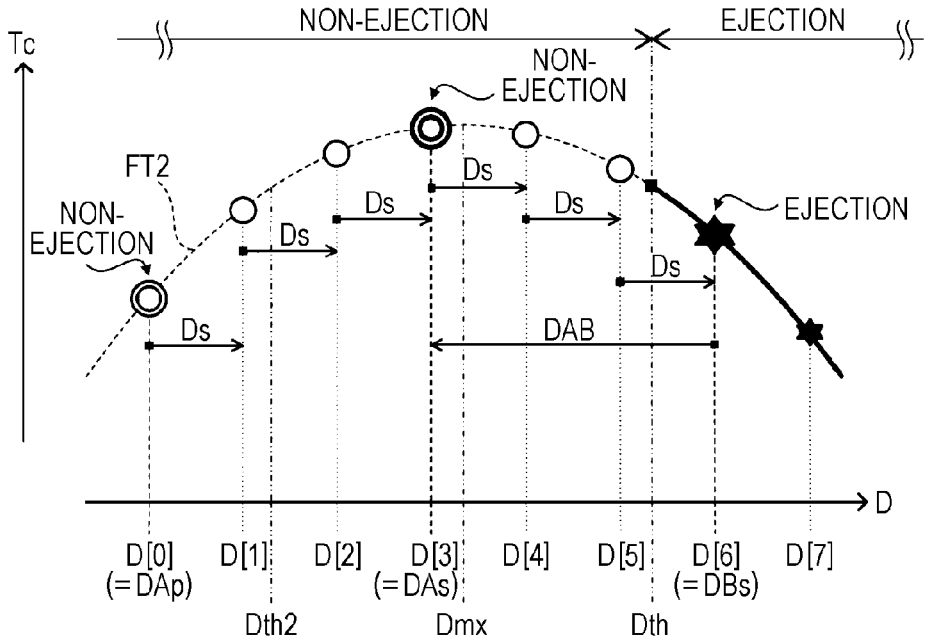
FIG. 29 is an explanatory diagram illustrating a relationship between the driving voltage of the driving signal supplied to the ejection unit and the cycle of the residual vibration in the ejection unit in the waveform correction process.

FIGS. 28 and 29 are explanatory diagrams illustrating examples of a relationship among the driving voltage D set in each step, the correction boundary voltage DBs and the correction inspection voltage DAs decided during the waveform correction process, and the cycle Tc of the residual vibration generated in the ejection unit 35 in a case where the waveform correction process illustrated in FIG. 27 is performed.

FIG. 28 illustrates an example a case in which the ink is ejected from the ejection unit 35 when the ejection unit 35 is driven by the driving signal Vin deciding the inspection voltage DAp as the driving voltage D (that is, a case in which the determination result in Step S202 is positive).

As illustrated in FIG. 28, the CPU 61 decreases the driving voltage D of the driving signal Vin supplied to the ejection unit 35 by the change voltage Ds so as to be D[1], D[2], . . . , and the like from the initial value D[0] set as the inspection voltage DAp in Step S204.

Moreover, the CPU 61 decides D[1] as the correction boundary voltage DBs which is the voltage in which the change voltage Ds is added to D[2] which is the driving voltage D of the driving signal Vin supplied to the ejection unit 35 for the last time in Step S204 when the ejection state of the ink in the ejection unit 35 is determined as non-ejection for the first time in Step S206.

Subsequently, the CPU 61 calculates the correction inspection voltage Das by subtracting the difference voltage DAB from the correction boundary voltage DBs (that is, D[1]) in Step S208.

On the other hand, FIG. 29 illustrates an example of a case in which the ink is not ejected from the ejection unit 35 when the ejection unit 35 is driven by the driving signal Vin deciding the inspection voltage DAp as the driving voltage D (that is, a case in which the determination result in Step S202 is negative).

As illustrated in FIG. 29, the CPU 61 increases the driving voltage of the driving signal Vin supplied to the ejection unit 35 by the change voltage Ds so as to be D[1], D[2], . . . , and the like from the initial value D[0] set as the inspection voltage DAp in Step S210.

In addition, the CPU 61 decides D[6] which is the driving voltage D of the driving signal Vin supplied to the ejection unit 35 for the last time in Step S210 as the correction boundary voltage DBs when it is determined that the ink is ejected from the ejection unit 35 for the first time in Step S212.

Subsequently, the CPU 61 calculates the correction inspection voltage Das by subtracting the difference voltage DAB from the correction boundary voltage DBs (that is, D[6]) in Step S214.

In this manner, in the waveform correction process, the correction inspection voltage DAs is acquired by correcting the inspection voltage DAp acquired in the waveform setting process and decides the correction inspection voltage DAs as the driving voltage D of the driving signal Vin for inspection. Accordingly, in a period from execution of the initialization operation to execution of the start operation, even in a case where the viscosity or the like of the ink in the inside of the ejection unit 35 is changed, it is possible to decide the waveform of the driving signal Vin for inspection according to the viscosity or the like of the ink in the inside of the ejection unit 35 at the time of execution of the start operation.

Moreover, in the waveform correction process, since the correction inspection voltage DAs is acquired by setting the initial value of the driving voltage D as the inspection voltage DAp, it is possible to minimize the number of execution of the process of increasing or decreasing the driving voltage D and to suppress a processing load by setting the initial value of the driving voltage D as the initial voltage Dini and comparing with the waveform setting process in which the inspection voltage DAp is acquired. Therefore, even in a case where the inspection waveform decision process is performed during the operation daily performed like the start operation, it is possible to perform the inspection waveform decision process without giving excessive burden to a user of the ink jet printer 1.

Moreover, the waveform correction process according to the invention is not limited to the processes illustrated in FIGS. 27 to 29. Accordingly, hereinafter, the waveform correction process illustrated in FIGS. 27 to 29 is referred to as a "first waveform correction process" in some cases.

In the waveform correction process according to the present embodiment, the difference voltage DAB is set a voltage larger than the difference between the threshold voltage Dth and the maximum cycle voltage Dmx, but the invention is not limited thereto, and the difference voltage DAB may be decided as a voltage more than or equal to the change voltage Ds. That is, in the waveform correction process, the driving voltage D of the driving signal Vin for inspection may be decided as a voltage larger than the threshold corresponding voltage Dth2 and smaller than the threshold voltage Dth.

Moreover, in the present embodiment, the initial value D[0] of the driving voltage D in the waveform correction process is set as the inspection voltage DAp, but, for example, the boundary voltage DBp may be the initial value D[0] of the driving voltage D.

In addition, in the present embodiment, the waveform setting process is performed in the initialization operation and the waveform correction process is performed in the start operation, but the invention is not limited thereto, and the waveform (driving voltage D) of the driving signal Vin for inspection may be decided by performing the waveform setting process in the initialization operation in the same manner as that in the start operation. That is, the initial value D[0] of the driving voltage D in the inspection waveform decision process performed in the start operation may be decided as the initial voltage Dini not the inspection voltage DAp.

Further, in the present embodiment, the waveform setting process is performed in the initialization operation, but the invention is not limited thereto, and the waveform (driving voltage D) of the driving signal Vin for inspection may be decided by performing the first waveform correction process illustrated in FIG. 27 in the initialization operation.

In the initialization operation, in a case where the inspection waveform decision process is performed by the first waveform correction process, the initial value D[0] of the driving voltage D may be decided as the initial voltage Dini instead of the inspection voltage DAp. In this case, even in a case where the ink is ejected from the ejection unit 35 when the driving signal Vin deciding the initial voltage Dini as the driving voltage D is supplied to the ejection unit 35, it is possible to acquire the appropriate inspection voltage DAp.

Moreover, in the initialization operation, in a case where the inspection waveform decision process is performed by the first waveform correction process, the initial value D[0] of the driving voltage D may be decided as an arbitrary voltage.

B. SECOND EMBODIMENT

In the above-described first embodiment, the first waveform setting process is performed in the initialization operation in the inspection waveform decision process. In contrast, an ink jet printer according to the second embodiment is different from the ink jet printer 1 according to the first embodiment in terms of performing the waveform setting process in the inspection waveform decision process by a process different from the first waveform setting process according to the first embodiment. That is, the ink jet printer according to the second embodiment is configured in the same manner as the ink jet printer 1 according to the first embodiment except that the control program stored in the storage unit 62 is different from that of the ink jet printer 1 according to the first embodiment.

In each mode exemplified below, detailed description on elements having actions or functions which are the same as those in the first embodiment will be omitted by denoting the same reference numerals referred in the description above (the same applies to embodiments and modified examples described below).

Hereinafter, a waveform setting process according to the second embodiment will be described with reference to FIGS. 30 to 32.

Figure 30:
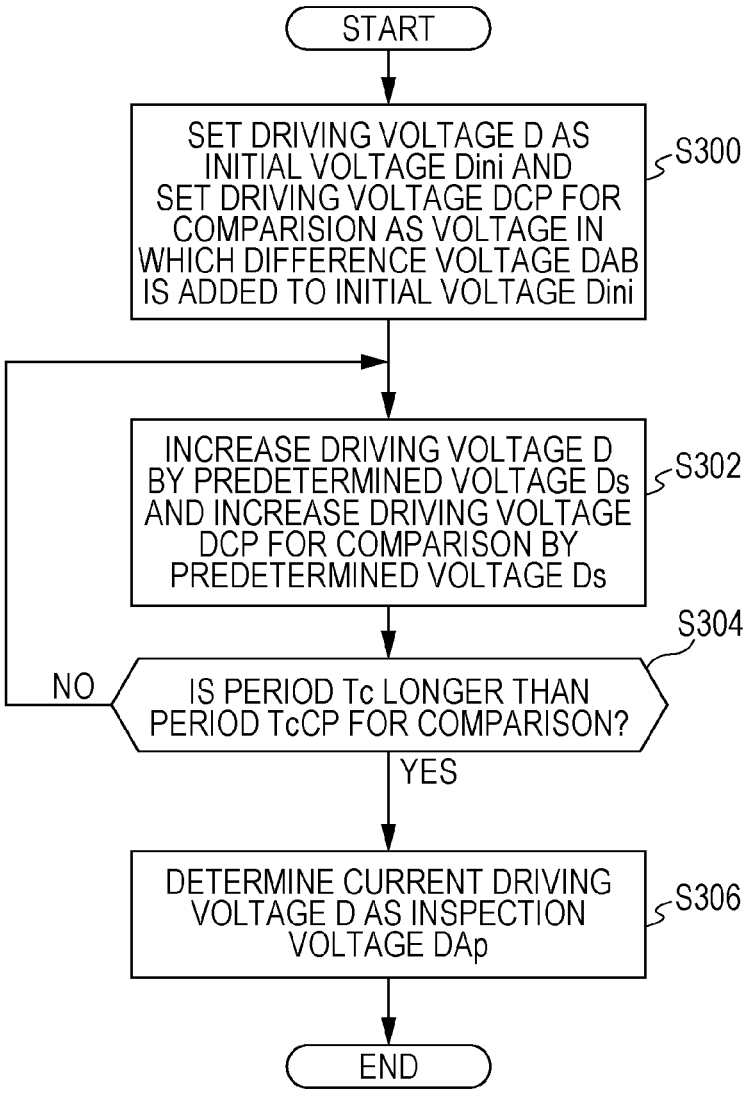
FIG. 30 is a flowchart illustrating an operation of an ink jet printer in a waveform setting process according to a second embodiment.

FIG. 30 is a flowchart illustrating an example of an operation of an ink jet printer 1 in the waveform setting process according to the second embodiment.

As illustrated in FIG. 30, in the waveform setting process according to the second embodiment, firstly, a CPU 61 sets a driving voltage D of a driving signal Vin as an initial voltage Dini, allows an ejection unit 35 to be driven by the driving signal Vin, sets a driving voltage DCP of a driving signal Vin for comparison as a voltage in which a difference voltage DAB is added to the initial voltage Dini, and allows the ejection unit 35 to be driven by the driving signal Vin for comparison (Step S300). In the process of Step S300 is an example of a "second setting process."

Moreover, as described above, in a case where the ejection unit 35 is driven by the driving signal Vin in which the driving voltage D is set as the initial voltage Dini, an ink is not ejected from the ejection unit 35. Consequently, as is obvious in FIG. 31 described below in Step S300, a cycle Tc (cycle Tc[0] in FIG. 31) of residual vibration generated in a case where the ejection unit 35 is driven by the driving signal Vin is shorter than a cycle (cycle TcCP[0] in FIG. 31) of the residual vibration generated in a case where the ejection unit 35 is driven by the driving signal Vin for comparison.

Next, the CPU 61 sets the driving voltage D of the driving signal Vin as a voltage increased by a change voltage Ds from the preset driving voltage D, allows the ejection unit 35 to be driven by the driving signal Vin, sets the driving voltage DCP of the driving signal Vin for comparison as a voltage increased by the change voltage Ds from the preset driving voltage DCP, and allows the ejection unit 35 to be driven by the driving signal Vin for comparison (Step S302). The process in Step S302 is an example of a "second change process."

In addition, the CPU 61 determines whether the cycle Tc of the residual vibration generated when the ejection unit 35 is driven by the driving signal Vin is longer than the cycle Tc of the residual vibration generated when the ejection unit 35 is driven by the driving signal Vin for comparison (hereinafter, referred to as a "cycle TcCP") based on the detection signal NTc output from an ejection abnormality detection unit 52 when the ejection unit 35 is driven in Step S302 (Step S304).

In a case where the determination result in Step S304 is negative, that is, in a case where the cycle Tc is less than or equal to the cycle TcCP, the CPU 61 proceeds the process to Step S302. That is, the CPU 61 sets the driving voltage D as the initial voltage Dini, maintains the interval between the driving voltage D and the driving voltage DCP by the difference voltage DAB, and increases the driving voltage D and the driving voltage DCP by the change voltage Ds until the cycle Tc exceeds the cycle TcCP for the first time.

In contrast, the determination result in Step S304 is positive and the cycle Tc exceeds the cycle TcCP for the first time, the CPU 61 decides the driving voltage D of the driving signal Vin supplied to the ejection unit 35 for the last time in Step S302, decides the inspection voltage DAp as the driving voltage D of the driving signal Vin for inspection, and allows the value to be stored in a storage unit 62 (Step S306). The process in Step S306 is an example of a "second decision process."

Moreover, the CPU 61 may decide the driving voltage DCP of the driving signal Vin for comparison supplied to the ejection unit 35 in Step S304 as a boundary voltage DBp in a case where the determination result is positive in Step S304.

As described above, the CPU 61 functions as a "decision unit" by performing processes in Steps S300 to S306 illustrated in FIG. 30 (see FIG. 2).

Figure 31:
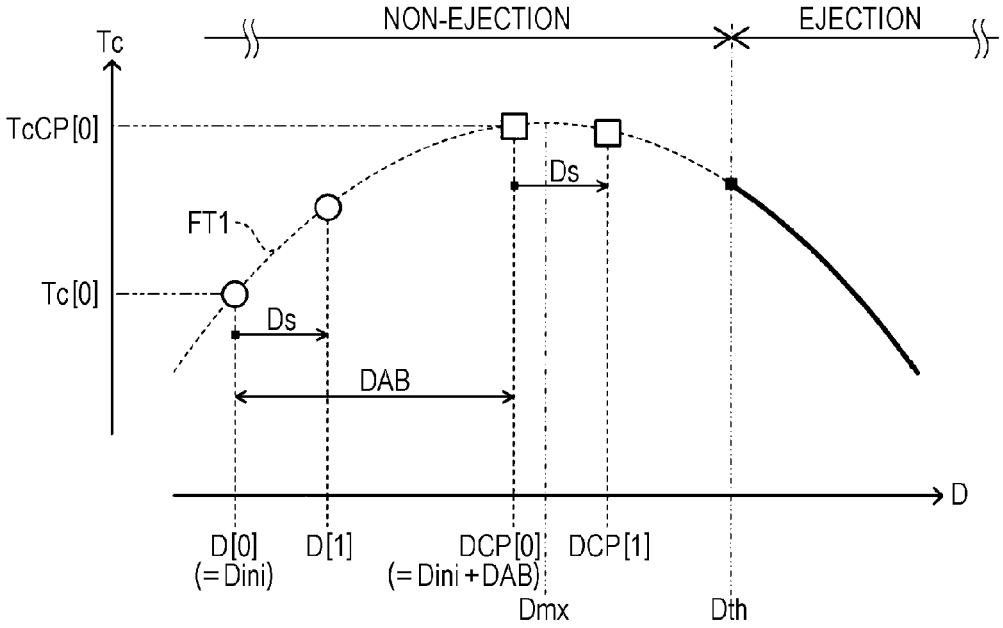
FIG. 31 is an explanatory diagram illustrating a relationship between the driving voltage of the driving signal supplied to the ejection unit and the cycle of the residual vibration in the ejection unit in the waveform setting process.
Figure 32:
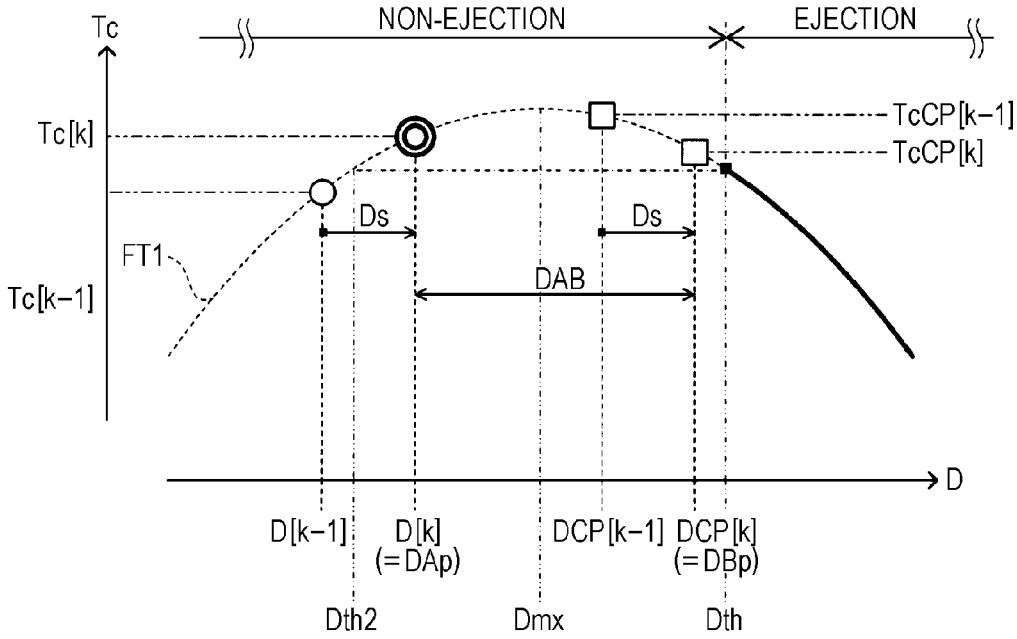
FIG. 32 is an explanatory diagram illustrating a relationship between the driving voltage of the driving signal supplied to the ejection unit and the cycle of the residual vibration in the ejection unit in the waveform setting process.

FIGS. 31 and 32 are explanatory diagrams illustrating a relationship among the driving voltage D (D[0], D[1], D[2], . . . , and the like) and the driving voltage DCP (DCP[0], DCP[1], DCP[2], . . . , and the like) set in each step, the inspection voltage DAp (and the boundary voltage DBp) decided during the waveform setting process, and the cycle Tc and the cycle TcCP of the residual vibration generated in the ejection unit 35 in a case where the waveform setting process according to the second embodiment illustrated in FIG. 30 is performed.

As illustrated in FIGS. 31 and 32, the CPU 61 increases the driving voltage D of the driving signal Vin supplied to the ejection unit 35 by the change voltage Ds so as to be D[1], D[2], . . . , D[k] from the initial value D[0] set as the initial voltage Dini and increases the driving voltage DCP of the driving signal Vin for comparison by the change voltage Ds so as to be DCP[1], DCP[2], . . . , DCP[k] from the initial value DCP[0] (k is a natural value of 2 or more) in Steps S300, S302, and S304.

Further, in a case where the cycle Tc exceeds the cycle TcCP for the first time in Step S304, the CPU 61 decides the driving voltage D[k] of the driving signal Vin supplied to the ejection unit 35 for the last time in Step S302 as the inspection voltage DAp in Step S306.

In other words, as illustrated in FIG. 32, the CPU decides the driving voltage D[k] as the inspection voltage DAp and decides the driving voltage DCP[k] as the boundary voltage DBp in a case where a cycle Tc[k−1] of the residual vibration generated when the ejection unit 35 is driven by the driving signal Vin deciding the driving voltage D[k−1] as the driving voltage D becomes shorter than or equal to a cycle TcCP[k−1] of the residual vibration generated when the ejection unit 35 is driven by the driving signal Vin for comparison deciding the driving voltage DCP[k−1] as the driving voltage DCP and a cycle Tc[k] of the residual vibration generated when the ejection unit 35 is driven by the driving signal Vin deciding the driving voltage D[k] as the driving voltage D becomes longer than a cycle TcCP[k] of the residual vibration generated when the ejection unit 35 is driven by the driving signal Vin for comparison deciding the driving voltage DCP[k] as the driving voltage DCP. In addition, the CPU 61 decides the inspection voltage DAp as the driving voltage D of the driving signal Vin for inspection.

In this manner, in the waveform setting process according to the second embodiment, since the driving voltage D of the driving signal Vin is decided as the inspection voltage DAp in a case where the cycle Tc exceeds the cycle TcCP for the first time, it is possible to decide the inspection voltage DAp as a value less than or equal to the maximum cycle voltage Dmx. Accordingly, in a case where the ejection unit 35 is driven by the driving signal Vin for inspection, it is possible to prevent ejection of the ink from the ejection unit 35.

Further, since the driving voltage D of the driving signal Vin is decided as the inspection voltage DAp when the cycle Tc exceeds the cycle TcCP, it is possible to make the driving voltage D of the driving signal Vin for inspection larger than the threshold corresponding voltage Dth2 and to accurately determine the ejection state of the ejection unit 35.

Hereinafter, the waveform setting process illustrated in FIGS. 30 to 32 is referred to as a "second waveform setting process" in some cases.

In the waveform setting process according to the second embodiment, the interval between the driving voltage D and the driving voltage DCP is maintained by the difference voltage DAB and the driving voltage D and the driving voltage DCP are increased by the change voltage Ds, but the invention is not limited thereto.

For example, the interval between the driving voltage D and the driving voltage DCP (difference voltage DAB) may vary and the width of change between the driving voltage D and the driving voltage DCP (change voltage Ds) may vary. Further, both steps of a step in which the driving voltage D and the driving voltage DCP are increased and a step in which the driving voltage D and the driving voltage DCP are decreased may be included.

Specifically, the waveform setting process may be performed by the procedures described below. That is, firstly, the CPU 61 allows the interval between the driving voltage D and the driving voltage DCP to be maintained by the first difference voltage and increases the driving voltage D and the driving voltage DCP by the first change voltage until the cycle Tc exceeds the cycle TcCP. Secondly, the CPU 61 allows the interval between the driving voltage D and the driving voltage DCP to be maintained by the second difference voltage which is smaller than the first difference voltage and decreases the driving voltage D and the driving voltage DCP by the second change voltage which is smaller than the first change voltage until the cycle TcCP exceeds the cycle Tc. Thirdly, the CPU 61 allows the interval between the driving voltage D and the driving voltage DCP to be maintained by the third difference voltage which is smaller than the second difference voltage and increases the driving voltage D and the driving voltage DCP by the third change voltage which is smaller than the second change voltage until the cycle Tc exceeds the cycle TcCP. Fourthly, the CPU 61 decides the driving voltage D when the cycle Tc exceeds the cycle TcCP as the inspection voltage DAp. In this manner, it is possible to decrease the number of steps (processing load) in the waveform setting process and to decide the driving voltage D of the driving signal Vin for inspection as a value close to the maximum cycle voltage Dmx by making the interval and the width of change of the driving voltage D and the driving voltage DCP variable (preferably, by gradually decreasing).

Moreover, in the second embodiment, the second waveform setting process is performed in the waveform setting process and the first waveform correction process is performed in the start operation, but the invention is not limited thereto, and the waveform (driving voltage D) of the driving signal for inspection may be decided by performing the waveform setting process (the first waveform correction process or the second waveform correction process) in the start operation in the same manner as that in the initialization operation.

C. THIRD EMBODIMENT

In the above-described first and second embodiments, the first waveform correction process is performed in the waveform correction process in the inspection waveform decision process.

In contrast, an ink jet printer according to the third embodiment is different from the ink jet printer 1 according to the first and second embodiments in terms of performing the waveform correction process in the inspection waveform decision process by a process different from the first waveform correction process according to the first and second embodiments. That is, the ink jet printer according to the third embodiment is configured in the same manner as the ink jet printer 1 according to the first embodiment except that the control program stored in the storage unit 62 is different from that of the ink jet printer 1 according to the first embodiment.

Hereinafter, a waveform correction process according to the third embodiment will be described with reference to FIGS. 33 to 37.

Figure 33:
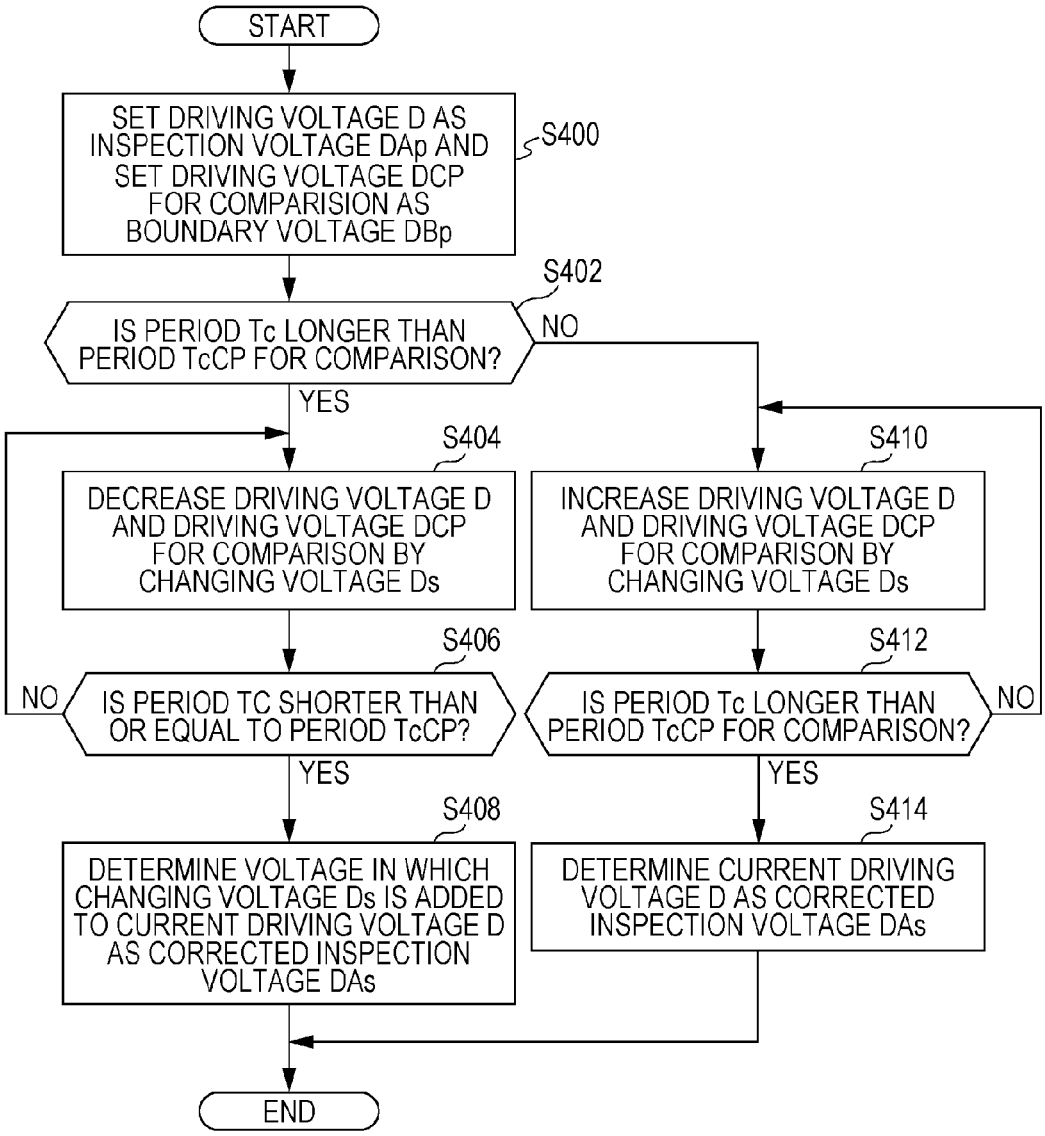
FIG. 33 is a flowchart illustrating an operation of an ink jet printer in a waveform correction process according to a third embodiment.

FIG. 33 is a flowchart illustrating an example of an operation of an ink jet printer 1 in the waveform correction process according to the third embodiment.

As illustrated in FIG. 33, in the waveform correction process according to the third embodiment, firstly, a CPU 61 sets a driving voltage D of a driving signal Vin as an inspection voltage DAp decided in Step S108 or S306, allows an ejection unit 35 to be driven by the driving signal Vin, sets a driving voltage DCP of a driving signal Vin for comparison as a voltage (that is, a boundary voltage DBp) in which a difference voltage DAB is added to the inspection voltage DAp, and allows the ejection unit 35 to be driven by the driving signal Vin for comparison (Step S400). In the process of Step S400 is an example of a "fourth setting process."

In addition, the CPU 61 determines whether the cycle Tc of the residual vibration generated when the ejection unit 35 is driven by the driving signal Vin is longer than the cycle TcCP of the residual vibration generated when the ejection unit 35 is driven by the driving signal Vin for comparison based on the detection signal NTc output from an ejection abnormality detection unit 52 when the ejection unit 35 is driven in Step S400 (Step S402).

In a case where the determination result in Step S402 is positive, that is, in a case where the cycle Tc is longer than the cycle TcCP, the CPU 61 sets the driving voltage D of the driving signal Vin as a voltage decreased by the change voltage Ds, allows the ejection unit 35 to be driven by the driving signal Vin, sets the driving voltage DCP of the driving signal Vin for comparison as a voltage decreased by the change voltage Ds, and allows the ejection unit 35 to be driven by the driving signal Vin for comparison (Step S404).

In addition, the CPU 61 determines whether the cycle Tc of the residual vibration generated when the ejection unit 35 is driven by the driving signal Vin is longer than or equal to the cycle TcCP of the residual vibration generated when the ejection unit 35 is driven by the driving signal Vin for comparison (Step S406) based on the detection signal NTc output from the ejection abnormality detection unit 52 when the ejection unit 35 is driven in Step S404.

In a case where the determination result in Step S406 is negative, that is, the cycle Tc is longer than the cycle TcCP, the CPU 61 proceeds the process to Step S404. That is, the CPU 61 sets the driving voltage D as the inspection voltage DAp, sets the driving voltage DCP as the boundary voltage DBp, allows the interval of the driving voltage D and the driving voltage DCP to be maintained by the difference voltage DAB, and decreases the driving voltage D and the driving voltage DCP by the change voltage Ds until the cycle Tc is shorter than or equal to the cycle TcCP for the first time.

In contrast, in a case where the determination result in Step S406 is positive, that is, in a case where the cycle Tc becomes shorter than the cycle TcCP for the first time, the CPU 61 decides the voltage in which the change voltage Ds is added to the driving voltage D of the driving signal Vin supplied to the ejection unit 35 for the last time in Step S404 as the correction inspection voltage DAs, decides the correction inspection voltage DAs as the driving voltage D of the driving signal Vin for inspection, and allows the value to be stored in the storage unit 62 (Step S408).

In a case where the determination result in Step S202 is negative, that is, in a case where the cycle Tc is shorter than or equal to the cycle TcCP, the CPU 61 sets the driving voltage D of the driving signal Vin as a voltage increased by the change voltage Ds, allows the ejection unit 35 to be driven by the driving signal Vin, sets the driving voltage DCP of the driving signal Vin for comparison as a voltage increased by the change voltage Ds, and allows the ejection unit 35 to be driven by the driving signal Vin for comparison (Step S410).

In addition, the CPU 61 determines whether the cycle Tc of the residual vibration generated when the ejection unit 35 is driven by the driving signal Vin is longer than the cycle TcCP of the residual vibration generated when the ejection unit 35 is driven by the driving signal Vin for comparison (Step S412) based on the detection signal NTc output from the ejection abnormality detection unit 52 when the ejection unit 35 is driven in Step S410.

In a case where the determination result in Step S412 is negative, that is, the cycle Tc is shorter than or equal to the cycle TcCP, the CPU 61 proceeds the process to Step S410. That is, the CPU 61 sets the driving voltage D as the inspection voltage DAp, sets the driving voltage DCP as the boundary voltage DBp, allows the interval of the driving voltage D and the driving voltage DCP to be maintained by the difference voltage DAB, and increases the driving voltage D and the driving voltage DCP by the change voltage Ds until the cycle Tc exceeds the cycle TcCP for the first time.

In contrast, in a case where the determination result in Step S412 is positive, that is, in a case where the cycle Tc becomes longer than or equal to the cycle TcCP for the first time, the CPU 61 decides the driving voltage D of the driving signal supplied to the ejection unit 35 for the last time in Step S410 as the correction inspection voltage DAs, decides the correction inspection voltage DAs as the driving voltage D of the driving signal Vin for inspection, and allows the value to be stored in the storage unit 62 (Step S414).

Moreover, the CPU 61 may decide a voltage in which the change voltage Ds is added to the driving voltage DCP of the driving signal Vin for comparison supplied to the ejection unit 35 in Step S404 as the boundary voltage DBp in a case where the determination result in Step S406 is positive and may decide the driving voltage DCP of the driving signal Vin for comparison supplied to the ejection unit 35 in Step S410 as the boundary voltage DBP in a case where the determination result in Step S412 is positive.

In addition, the processes in Steps S404 and S410 are examples of a "fourth change process." Further, the processes in Steps S408 and S414 are examples of a "fourth decision process."

As described above, the CPU 61 functions as a "decision unit" (see FIG. 2) by performing Steps S400 to S414 illustrated in FIG. 33.

FIGS. 34 to 37 are explanatory diagrams illustrating examples of a relationship among the driving voltage D set in each step, the correction boundary voltage DBs and the correction inspection voltage DAs decided during the waveform correction process, and the cycle Tc of the residual vibration generated in the ejection unit 35 in a case where the waveform correction process according to the third embodiment illustrated in FIG. 33 is performed.

Figure 34:
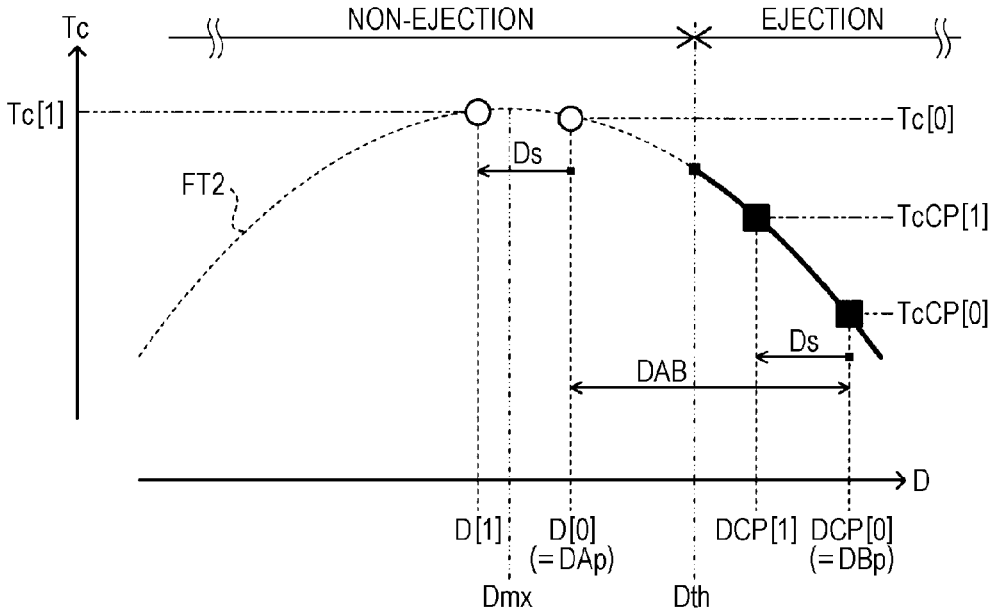
FIG. 34 is an explanatory diagram illustrating a relationship between the driving voltage of the driving signal supplied to the ejection unit and the cycle of the residual vibration in the ejection unit in the waveform correction process.
Figure 35:
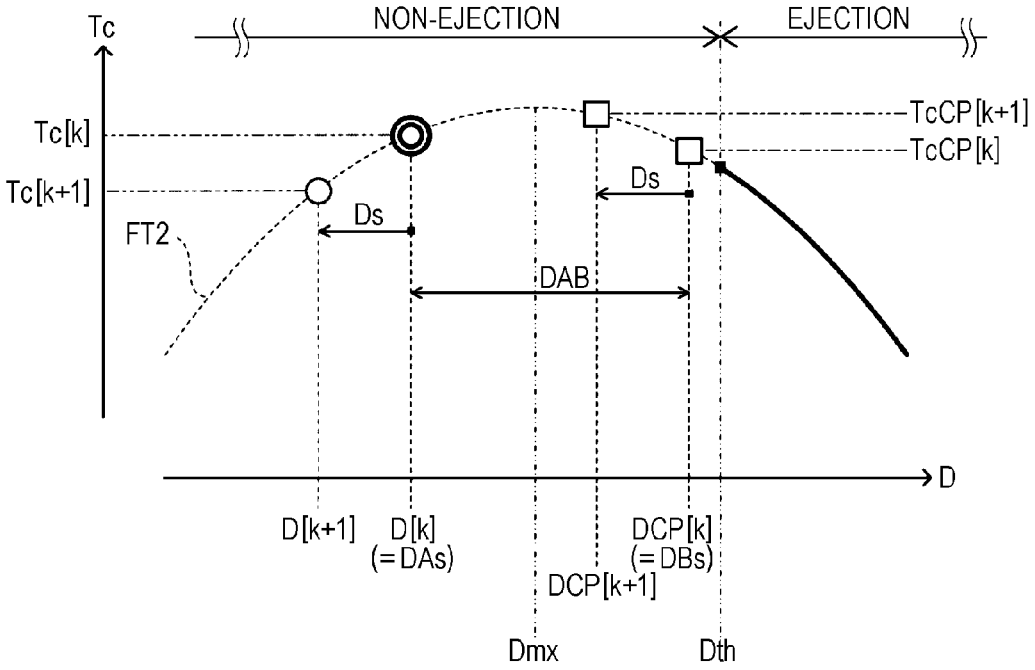
FIG. 35 is an explanatory diagram illustrating a relationship between the driving voltage of the driving signal supplied to the ejection unit and the cycle of the residual vibration in the ejection unit in the waveform correction process.

FIGS. 34 and 35 illustrate examples of a case in which the determination result in Step S402 is positive (that is, a case in which the cycle Tc exceeds the cycle TcCP when the inspection voltage DAp is decided as the driving voltage D and the boundary voltage DBp is decided as the driving voltage DCP).

As illustrated in FIG. 34, the CPU 61 decreases the driving voltage D of the driving signal Vin supplied to the ejection unit 35 by the change voltage Ds so as to be D[1], D[2], . . . , D[k] from the initial value D[0] set as the inspection voltage DAp in Step S404 and decreases the driving voltage DCP of the driving signal Vin for comparison by the change voltage Ds so as to be DCP[1], DCP[2], . . . DCP[k] from the initial value DCP[0] set as the boundary voltage DBp.

In addition, in a case where the cycle Tc is shorter than or equal to the cycle TcCP for the first time in Step S406, the CPU 61 decides the voltage in which the change voltage is subtracted from the driving voltage D of the driving signal Vin supplied to the ejection unit 35 for the last time in Step S404 as the correction inspection voltage DAs in Step S408.

In other words, as illustrated in FIG. 35, the CPU 61 decides the driving voltage D[k] as the inspection voltage DAs and decides the driving voltage DCP[k] as the correction boundary voltage DBs in a case where a cycle Tc[k+1] of the residual vibration generated when the ejection unit 35 is driven by the driving signal Vin deciding the driving voltage D[k+1] as the driving voltage D becomes shorter than or equal to a cycle TcCP[k+1] of the residual vibration generated when the ejection unit 35 is driven by the driving signal Vin for comparison deciding the driving voltage DCP[k+1] as the driving voltage DCP and a cycle Tc[k] of the residual vibration generated when the ejection unit 35 is driven by the driving signal Vin deciding the driving voltage D[k] as the driving voltage D becomes longer than a cycle TcCP[k] of the residual vibration generated when the ejection unit 35 is driven by the driving signal Vin for comparison deciding the driving voltage DCP[k] as the driving voltage DCP. Further, the CPU 61 decides the inspection voltage DAp as the driving voltage D of the driving signal Vin for inspection.

Figure 36:
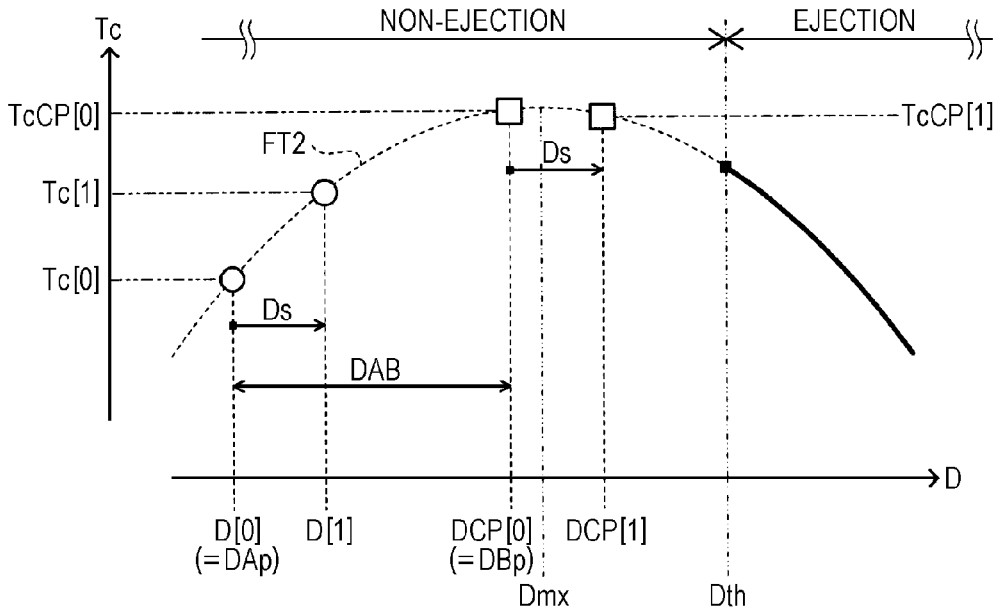
FIG. 36 is an explanatory diagram illustrating a relationship between the driving voltage of the driving signal supplied to the ejection unit and the cycle of the residual vibration in the ejection unit in the waveform correction process.
Figure 37:
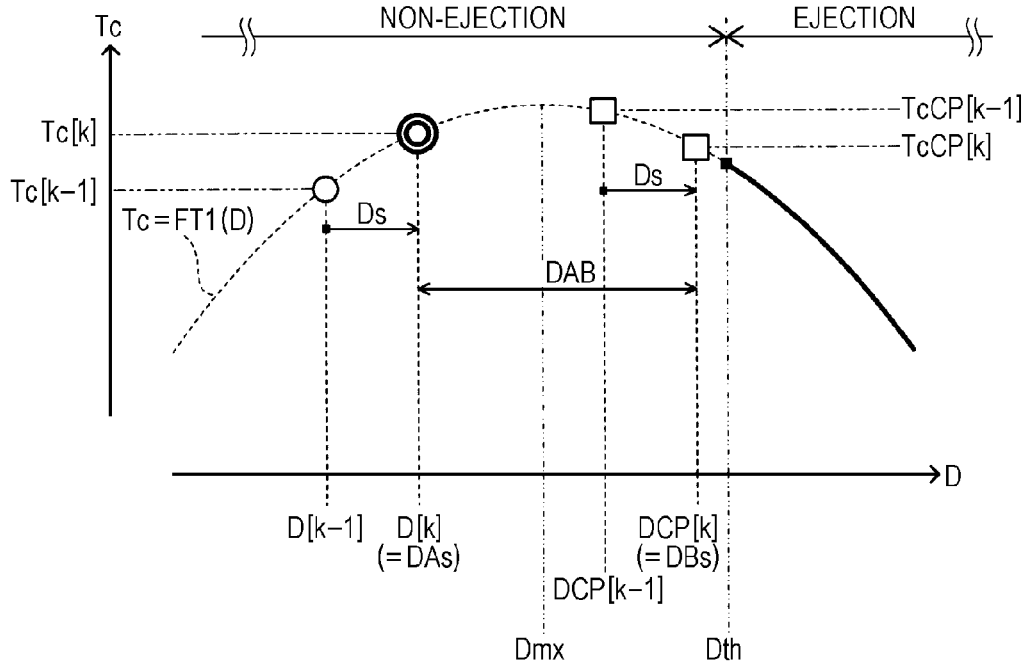
FIG. 37 is an explanatory diagram illustrating a relationship between the driving voltage of the driving signal supplied to the ejection unit and the cycle of the residual vibration in the ejection unit in the waveform correction process.

FIGS. 36 and 37 illustrate a case in which the determination result in Step S402 is negative.

As illustrated in FIG. 36, the CPU 61 increases the driving voltage D of the driving signal Vin supplied to the ejection unit 35 by the change voltage Ds so as to be D[1], D[2], . . . , D[k] from the initial value D[0] set as the inspection voltage DAp in Step S410 and increases the driving voltage DCP of the driving signal Vin for comparison by the change voltage Ds so as to be DCP[1], DCP[2], . . . DCP[k] from the initial value DCP[0] set as the boundary voltage DBp.

In addition, in a case where the cycle Tc exceeds the cycle TcCP for the first time in Step S412, the CPU 61 decides the driving voltage D of the driving signal Vin supplied to the ejection unit 35 for the last time in Step S410 as the correction inspection voltage DAs in Step S414.

In other words, as illustrated in FIG. 37, the CPU decides the driving voltage D[k] as the correction inspection voltage DAs and decides the driving voltage DCP[k] as the correction boundary voltage DBs in a case where the cycle Tc[k−1] of the residual vibration generated when the ejection unit 35 is driven by the driving signal Vin deciding the driving voltage D[k−1] as the driving voltage D becomes shorter than or equal to the cycle TcCP[k−1] of the residual vibration generated when the ejection unit 35 is driven by the driving signal Vin for comparison deciding the driving voltage DCP[k−1] as the driving voltage DCP and the cycle Tc[k] of the residual vibration generated when the ejection unit 35 is driven by the driving signal Vin deciding the driving voltage D[k] as the driving voltage D becomes longer than the cycle TcCP[k] of the residual vibration generated when the ejection unit 35 is driven by the driving signal Vin for comparison deciding the driving voltage DCP[k] as the driving voltage DCP. Further, the CPU 61 decides the inspection voltage DAp as the driving voltage D of the driving signal Vin for inspection.

In this manner, in the waveform correction process according to the third embodiment, since the correction inspection voltage DAS is acquired by correcting the inspection voltage DAp acquired in the waveform setting process, it is possible to decide the waveform of the driving signal Vin for inspection according to the viscosity or the like of the ink of the ejection unit 35 at the time of execution of the start operation even in a case where the viscosity or the like of the ink in the ejection unit 35 is changed in the period from the execution of the initialization operation to the execution of the start operation.

Moreover, in the waveform correction process according to the third embodiment, since the correction inspection voltage DAs is acquired by setting the initial value of the driving voltage D as the inspection voltage DAp, it is possible to minimize the number of execution of the process of increasing or decreasing the driving voltage D and to suppress a processing load by setting the initial value of the driving voltage D as the initial voltage Dini and comparing with the waveform setting process in which the inspection voltage DAp is acquired.

Hereinafter, the waveform correction process illustrated in FIGS. 33 to 37 is referred to as a "second waveform correction process" in some cases.

In addition, in the waveform correction process according to the third embodiment, the interval between the driving voltage D and the driving voltage DCP is maintained by the difference voltage DAB and the driving voltage D and the driving voltage DCP are increased by the change voltage Ds, but the interval between the driving voltage D and the driving voltage DCP may be variable in the same manner as that in the waveform setting process according to the second embodiment and the width of changing the driving voltage D and the driving voltage DCP may be variable. Further, in the same manner as that in the waveform setting process according to the second embodiment, both steps of a step of increasing the driving voltage D and the driving voltage DCP and a step of decreasing the driving voltage D and the driving voltage DCP may be included.

Further, in the third embodiment, the waveform setting process (the first waveform setting process or the second waveform setting process) is performed in the initialization operation, but the invention is not limited thereto, and the waveform (driving voltage D) of the driving signal Vin for inspection may be decided by performing the second waveform correction process illustrated in FIG. 33 in the initialization operation.

In the initialization operation, in a case where the inspection waveform decision process is performed by the second waveform correction process, the initial value D[0] of the driving voltage D may be decided as the initial voltage Dini instead of the inspection voltage DAp. In this case, even in a case where the ink is ejected from the ejection unit 35 when the driving signal Vin deciding the initial voltage Dini as the driving voltage D is supplied to the ejection unit 35, it is possible to acquire the appropriate inspection voltage DAp.

Moreover, in the initialization operation, in a case where the inspection waveform decision process is performed by the second waveform correction process, the initial value D[0] of the driving voltage D may be decided as an arbitrary voltage.

D. MODIFIED EXAMPLE

The above-described modes can be modified in various ways. Specific aspects of modifications will be exemplified below. Two or more aspects arbitrarily selected from the examples below may be appropriately combined within a range without mutual contradiction.

Modified Example 1

In the waveform correction process (first waveform correction process and the second waveform correction process)

according to the above-described embodiments, with regard to the initial value D[0] of the driving voltage D of the driving signal Vin supplied to the ejection unit 35, the correction inspection voltage DAs is acquired as the inspection voltage DAp, but the invention is not limited thereto. In a case where the waveform correction process is performed in the related art, that is, in a case where values of the correction inspection voltage DAS acquired in the related art are present in the storage unit 62, the waveform correction process may be performed using the correction inspection voltage DAs acquired in the related art as the initial value D[0] of the driving voltage D.

That is, the waveform correction process is not limited to the process of acquiring the correction inspection voltage DAs by correcting the inspection voltage DAp, and the correction inspection voltage DAs may be acquired by correcting the correction inspection voltage DAs acquired in the related art.

Modified Example 2

In the above-described embodiments and the modified example, the driving voltage D of the driving signal Vin for inspection (the inspection voltage DAp or the correction inspection voltage DAs) is decided for every ejection unit 35 by performing the inspection waveform decision process for every ejection unit 35, but the invention is not limited thereto. The inspection waveform decision process is performed only on a representative ejection unit 35 or a plurality ejection units 35 among the M ejection units 35, and one or a plurality of inspection voltages DAp or the correction inspection voltage DAs obtained as a result of the process may be applied to the ejection units 35 which are not objects of the inspection waveform decision process.

Even in this case, it is possible to decide the driving voltage D of the driving signal Vin for inspection which performs the ejection abnormality detecting process without allowing the ink to be ejected from all of the M ejection units 35 by deciding the difference voltage DAB as an appropriate value.

Modified Example 3

In the above-described embodiments and modified examples, the ejection abnormality detection unit 52 includes M ejection abnormality detection circuit DT in one-to-one correspondence with the M ejection units 35, but the ejection abnormality detection unit 52 may include at least one ejection abnormality detection circuit DT.

In this case, the control unit 6 may select one ejection unit 35 as an object of the ejection abnormality detecting process among the M ejection units 35 in one unit operation period Tu in a case where the ejection abnormality detecting process is performed and may supply the switching control signal Sw to the switching unit 53 such that the selected ejection unit 35 is electrically connected to the ejection abnormality detection circuit DT.

Modified Example 4

In the above-described embodiments and the modified examples, the driving waveform signals Com include three signals of Com-A, Com-B, and Com-C, but the invention is not limited thereto. The driving waveform signals Com may be formed of one signal (for example, only Com-A) or formed of arbitrary number of two or more signals (for example, Com-A and Com-B).

Moreover, in the above-described embodiments and modified examples, the control unit 6 supplies the driving waveform signals Com-A and Com-B (hereinafter, referred to as a "driving waveform signal for printing") for generating the driving signal Vin for printing and the driving waveform signal Com-C (hereinafter, referred to as a "driving waveform signal for inspection") for generating the driving signal Vin for inspection in each of the unit operation periods Tu, but the invention is not limited thereto. For example, the control unit 6 may change waveforms of each signal included in the driving waveform signals Com according to the types of processes performed in each of the unit operation periods Tu like supplying the driving waveform signals Com (for example, Com-A and Com-B) including only the driving waveform signal for printing in a case where the printing process is performed in a specific unit operation period Tu and supplying the driving waveform signals Com (for example, Com-C instead of Com-A) including only the driving waveform signal for inspection in a case where the ejection abnormality detecting process or the inspection waveform decision process is performed in a specific unit operation period Tu.

Further, the number of bits of the printing signal SI is not particularly limited to 3 bits and may be appropriately decided by gradation to be displayed and the number of signals included in the driving waveform signals Com.

Modified Example 5

In the above-described embodiments and the modified examples, a serial printer in which the main scanning direction of the head unit 30 and the sub scanning direction to which the recording paper P is transported are different from each other has been described as an example, but the invention is not limited thereto, and a line printer whose width of the head unit 30 becomes larger than or equal to the width of the recording paper P may be used. Since the determination of the ejection state due to the residual vibration can be performed without ejection of the ink to the recording paper P, it is possible to perform inspection of the ejection state during printing in the line printer.

The entire disclosure of Japanese Patent Application No. 2013-186455, filed Sep. 9, 2013 is expressly incorporated by reference herein.

What is claimed is:

1. A printing apparatus, comprising:

an ejection unit that includes a piezoelectric element that is displaced according to a driving signal, a pressure chamber whose inside is filled with a liquid and in which a pressure inside is increased or decreased by the displacement of the piezoelectric element based on the driving signal, and a nozzle that communicates with the pressure chamber and capable of ejecting the liquid filled into the inside of the pressure chamber through the increase or decrease of the pressure in the inside of the pressure chamber;

a driving signal supply unit that supplies the driving signal to the piezoelectric element;

a detection unit that detects change of an electromotive force of the piezoelectric element as a residual vibration signal based on the change of the pressure in the inside of the pressure chamber, which is generated after the driving signal is supplied to the piezoelectric element;

a determination unit that determines an ejection state of the liquid in the ejection unit based on the detection result of the detection unit in a case where the driving signal for inspection is supplied to the piezoelectric element; and a decision unit that is capable of performing a first process of deciding a waveform of the driving signal for inspection such that the liquid is not ejected from the nozzles when the driving signal for inspection is supplied to the piezoelectric element and a second process of correcting the waveform decided in the first process and deciding the corrected waveform as a waveform of the driving signal for inspection, wherein, in the second process, the decision unit decides the corrected waveform such that the liquid is not ejected from the nozzles when the driving signal for inspection which has the corrected waveform is supplied to the piezoelectric element.

2. The printing apparatus according to claim 1, wherein the decision unit performs the first process when the printing apparatus is activated for the first time.

3. The printing apparatus according to claim 1, wherein the decision unit performs the second process when the printing apparatus is activated for the second or subsequent time.

4. The printing apparatus according to claim 1, wherein the decision unit decides a waveform of the driving signal for inspection such that a cycle of a waveform indicated by the residual vibration signal detected by the detection unit when the driving signal for inspection is supplied to the piezoelectric element becomes longer than any cycle of the waveform indicated by the residual vibration signal detected by the detection unit when the liquid is ejected from the nozzles due to the displacement of the piezoelectric element according to the driving signal.

5. The printing apparatus according to claim 1, wherein the ejection unit is driven such that the liquid is ejected or not ejected from the nozzles due to the increase of the pressure in the inside of the pressure chamber, which is generated by a potential indicated by the driving signal being changed by the driving voltage, and the decision unit performs a first setting process of setting the driving voltage as an initial voltage such that the liquid is not ejected from the nozzles when the driving signal is not supplied to the piezoelectric element, a first change process of allowing the driving voltage of the driving signal supplied to the piezoelectric element to be increased by a predetermined change voltage from the initial voltage, a boundary decision process of deciding the driving voltage of the driving signal supplied to the piezoelectric element when the liquid is ejected from the nozzles for the first time in the first change process as a boundary voltage, and a first decision process of deciding an inspection voltage in which a difference voltage having a size of more than or equal to the change voltage is subtracted from the boundary voltage as the driving voltage of the driving signal for inspection.

6. The printing apparatus according to claim 5, wherein the decision unit performs a third setting process of setting the driving voltage of the driving signal as the inspection voltage in the second process, an ejection determining process of determining whether the liquid is ejected from the nozzles when the driving signal using the inspection voltage as the driving voltage is supplied to the piezoelectric element, a third change process of allowing the driving voltage of the driving signal supplied to the piezoelectric element to be decreased by the change voltage from the inspection voltage in a case where a result of determination in the ejection determining process is positive and allowing the driving voltage of the driving signal supplied to the piezoelectric element to be increased by the change voltage from the inspection voltage in a case where the result of determination in the ejection determining process is negative, a corrected boundary decision process of deciding the driving voltage of the driving signal supplied to the piezoelectric element in a case where the liquid is ejected from the nozzles for the last time in the third change process as a corrected boundary voltage when the result of determination in the ejection determining process is positive and deciding the driving voltage of the driving signal supplied to the piezoelectric element in a case where the liquid is ejected from the nozzles for the first time in the third change process as the corrected boundary voltage when the result of determination in the ejection determining process is negative, and a third decision process of deciding a corrected inspection voltage in which the difference voltage is subtracted from the corrected boundary voltage as the driving voltage of the driving signal for inspection.

7. The printing apparatus according to claim 5, wherein the decision unit performs a fourth setting process of setting the driving voltage of the driving signal as the inspection voltage in the second process and setting a driving voltage of a driving signal for comparison as a voltage in which the difference voltage is added to the inspection voltage, a fourth change process of allowing the driving voltage of the driving signal supplied to the piezoelectric element to be increased or decreased by at least the change voltage from the inspection voltage and allowing the driving voltage of the driving signal for comparison supplied to the piezoelectric element to be increased or decreased such that the difference between the driving voltage of the driving signal and the driving voltage of the driving signal for comparison is maintained by the difference voltage, and a fourth decision process of deciding the driving voltage of the driving signal as a corrected inspection voltage and deciding the corrected inspection voltage as the driving voltage of the driving signal for inspection, in a case where the cycle of the waveform indicated by the residual vibration signal detected by the detection unit when the driving signal is supplied to the piezoelectric element is longer than the cycle of the waveform indicated by the residual vibration signal detected by the detection unit when the driving signal for comparison is supplied to the piezoelectric element, and in a case where the cycle of the waveform indicated by the residual vibration signal detected by the detection unit when the signal in which the driving voltage of the driving signal is decreased by the change voltage is supplied to the piezoelectric element becomes shorter than the cycle of the waveform indicated by the residual vibration signal detected by the detection unit when the signal in which the driving voltage of the driving signal for comparison is decreased by the change voltage is supplied to the piezoelectric element.

8. The printing apparatus according to claim 1, wherein the ejection unit is driven such that the liquid is ejected or not ejected from the nozzles due to the increase of the pressure in the inside of the pressure chamber, which is generated by the potential indicated by the driving signal being changed by the driving voltage, and the decision unit performs a second setting process of setting the driving voltage of the driving signal as the initial voltage and setting a driving voltage of a driving signal for comparison as a voltage in which the difference voltage is added to the initial voltage, a second change process of allowing the driving voltage of the driving signal supplied to the piezoelectric element to be increased or decreased by at least a predetermined change voltage from the initial voltage and allowing the driving voltage of the driving signal for comparison to be supplied to the piezoelectric element to be increased or decreased such that a difference between the driving voltage of the driving signal and the driving voltage of the driving signal for comparison is maintained by the difference voltage, and a second decision process of deciding the driving voltage of the driving signal as an inspection voltage and deciding the inspection voltage as a driving voltage of a driving signal for inspection, in a case where a cycle of a waveform indicated by the residual vibration signal detected by the detection unit when the driving signal is supplied to the piezoelectric element becomes longer than a cycle of a waveform indicated by the residual vibration signal detected by the detection unit when the driving signal for comparison is supplied to the piezoelectric element, and in a case where the cycle of the waveform indicated by the residual vibration signal detected by the detection unit when a signal in which the driving voltage of the driving signal is decreased by the change voltage is supplied to the piezoelectric element becomes shorter than the cycle of the waveform indicated by the residual vibration signal detected by the detection unit when a signal in which the driving voltage of the driving signal for comparison is decreased by the change voltage is supplied to the piezoelectric element.

9. A method of controlling a printing apparatus that includes an ejection unit including a piezoelectric element that is displaced according to a driving signal, a pressure chamber whose inside is filled with a liquid and in which a pressure inside is increased or decreased by the displacement of the piezoelectric element based on the driving signal, and a nozzle that communicates with the pressure chamber and capable of ejecting the liquid filled into the inside of the pressure chamber through the increase or decrease of the pressure in the inside of the pressure chamber; a driving signal supply unit that supplies the driving signal to the piezoelectric element; a detection unit that detects change of an electromotive force of the piezoelectric element as a residual vibration signal based on the change of the pressure in the inside of the pressure chamber, which is generated after the driving signal is supplied to the piezoelectric element; and a determination unit that determines an ejection state of the liquid in the ejection unit based on the detection result of the detection unit in a case where the driving signal for inspection is supplied to the piezoelectric element, the method comprising:

a first process of deciding a waveform of the driving signal for inspection such that the liquid is not ejected from the nozzles when the driving signal for inspection is supplied to the piezoelectric element, and a second process of correcting the waveform decided in the first process and deciding the corrected waveform as a waveform of the driving signal for inspection, wherein, in the second process, the corrected waveform is decided such that the liquid is not ejected from the nozzles when the driving signal for inspection which has the corrected waveform is supplied to the piezoelectric element.

* * * * *